US011637355B1

(12) United States Patent
Zhang et al.

(10) Patent No.: US 11,637,355 B1
(45) Date of Patent: Apr. 25, 2023

(54) FULLY INTEGRATED PARITY-TIME SYMMETRIC ELECTRONICS

(71) Applicants: Xuan Zhang, St. Louis, MO (US); Lan Yang, St. Louis, MO (US); Weidong Cao, St. Louis, MO (US); Weijian Chen, St. Louis, MO (US)

(72) Inventors: Xuan Zhang, St. Louis, MO (US); Lan Yang, St. Louis, MO (US); Weidong Cao, St. Louis, MO (US); Weijian Chen, St. Louis, MO (US)

(73) Assignee: Washington University, St. Louis, MO (US)

( * ) Notice: Subject to any disclaimer, the term of this patent is extended or adjusted under 35 U.S.C. 154(b) by 125 days.

(21) Appl. No.: 17/446,000

(22) Filed: Aug. 26, 2021

Related U.S. Application Data

(60) Provisional application No. 62/706,578, filed on Aug. 26, 2020.

(51) Int. Cl.
*H01P 1/32* (2006.01)
*H01P 1/38* (2006.01)
*H01P 1/36* (2006.01)

(52) U.S. Cl.
CPC ..... *H01P 1/38* (2013.01); *H01P 1/32* (2013.01); *H01P 1/36* (2013.01)

(58) Field of Classification Search
CPC ..... H01P 1/32; H01P 1/36; H01P 1/38; H01P 1/397; H01P 1/393; H01P 1/365; H01P 1/37; H01P 1/375
See application file for complete search history.

(56) References Cited

U.S. PATENT DOCUMENTS 9,531,150 B2 12/2016 Ozdemir et al.
11,349,186 B2 * 5/2022 Nagulu ..... H01P 1/36
(Continued)

FOREIGN PATENT DOCUMENTS

CN 104977733 A 10/2015
CN 109193174 A 1/2019
(Continued)

OTHER PUBLICATIONS

Kottos, Tsampikos et al., Synthetic Structures with Parity-Time Symmertry, Springer Science+Buesiness Media Dordrecht, 2016, Chapter 9, pp. 147-162.
(Continued)

*Primary Examiner* — Stephen E. Jones
(74) *Attorney, Agent, or Firm* — Armstrong Teasdale LLP

(57) ABSTRACT

An integrated circuit is disclosed. The integrated circuit includes a first resonator, a second resonator, and a coupling element. The first resonator has a first terminal and a second terminal, where the first resonator comprises a gain resistor, a gain capacitor, and a gain inductor in parallel and electrically coupling the first terminal with the second terminal. The second resonator has a third terminal and a fourth terminal, where the second resonator includes a loss resistor, a loss capacitor, and a loss inductor in parallel and electrically coupling the third terminal with the fourth terminal. The coupling element selectively couples the first terminal of the first resonator with the third terminal of the second resonator.

20 Claims, 54 Drawing Sheets
(50 of 54 Drawing Sheet(s) Filed in Color)

(56) References Cited

U.S. PATENT DOCUMENTS

| | | | | |
|---|---|---|---|---|
| 2016/0020959 | A1 | 7/2016 | Bahl | |
| 2018/0115294 | A1 | 4/2018 | Gong et al. | |
| 2019/0235169 | A1 | 8/2019 | Bahl et al. | |
| 2019/0245255 | A1 | 8/2019 | Hou et al. | |
| 2019/0305397 | A1 | 10/2019 | Dinc et al. | |
| 2019/0372190 | A1 | 12/2019 | Kord et al. | |
| 2020/0106414 | A1* | 4/2020 | Andrews | H01P 1/32 |
| 2020/0257946 | A1* | 8/2020 | Kananian | G06K 19/00 |
| 2021/0242552 | A1* | 8/2021 | Nagulu | H03D 7/1441 |
| 2022/0385107 | A1* | 12/2022 | Assawaworrarit | H02J 50/12 |

FOREIGN PATENT DOCUMENTS

| | | | |
|---|---|---|---|
| CN | 109814202 | A | 5/2019 |
| CN | 110212865 | A | 9/2019 |
| CN | 110501821 | A | 11/2019 |

OTHER PUBLICATIONS

Schinder, Joseph et al., Experimental study of active LRC circuits with PT symmetries, Physical Review A, 2011, vol. 84, No. 4, pp. 040101-1-040101-5.

* cited by examiner

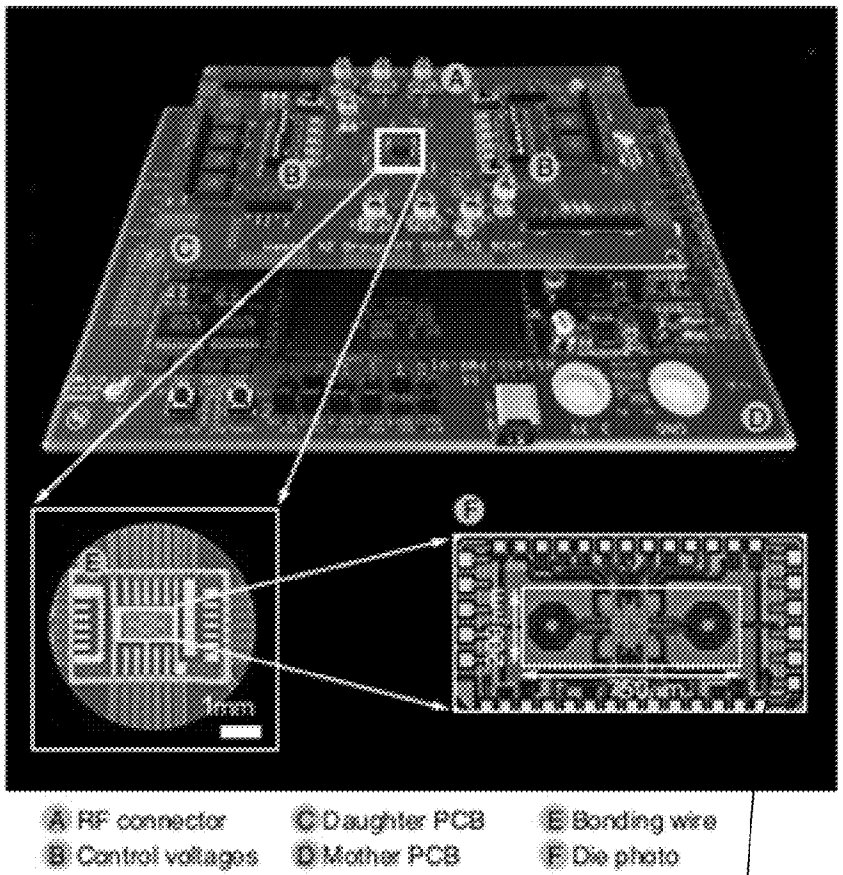
FIG. 15D
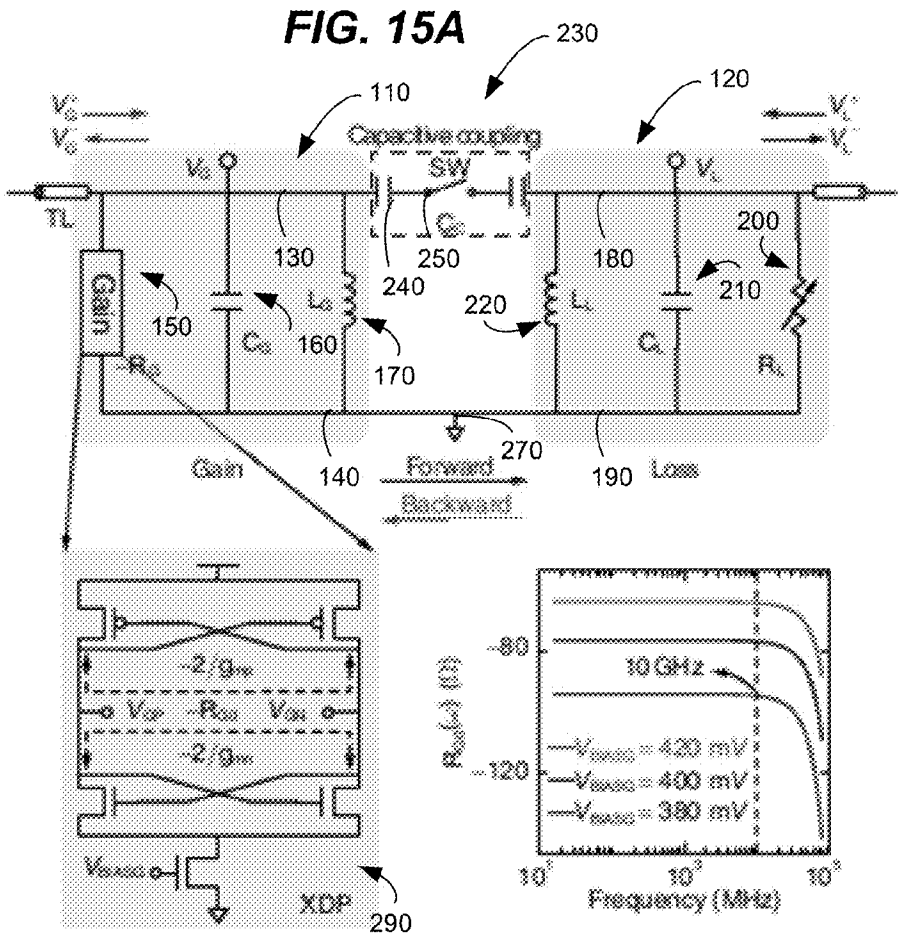

| Works | Baseline Oscillator | Our PT-symmetric System |
|---|---|---|
| Technology (nm) | 130 | 130 |
| Supply (V) | 1.2 | 1.2 |
| Power (mW) | 4.31 | 4.31 |
| Area ($mm^2$) | 0.15 | 0.15 |
| $f_{min}$ (GHz) | 2.93 | 2.63 |
| $f_{max}$ (GHz) | 3.23 | 3.20 |
| LC Tuning parameter | $L = 1.85$ nH; $C \in [1.35, 1.55]$ pF | $L = 1.85$ nH; $C_C = 500$ fF; $C \in [1.35, 1.55]$ pF. |
| R tuning | N/A | $R \in [80, 260]$ Ω |
| FTR (%) | 9.70 | 20.17 |
| PN(dBc/Hz@1MHz ) (Average) | 118.72 | 120.28 |

*FIG. 34*

| Works | Our System | PRL '13 [19] | Nature Electron '19 [20] | Nature Electron '20 [21] |
|---|---|---|---|---|
| Power threshold | −21 dBm | 9 dBm | 17 dBm | −20 dBm |
| Isolation | 20 dB | <5 dB | 35 dB | 10 dB |
| Bandwidth | [2.75 ~ 3.10] GHz | [38 ~ 40] KHz | [700 ~ 800] MHz | 200 MHz |
| Insertion gain? | 5 dB | No | No | No |
| Fully integrated? | Yes | No | No | No |

*FIG. 38*

FULLY INTEGRATED PARITY-TIME SYMMETRIC ELECTRONICS

CROSS-REFERENCE TO RELATED APPLICATIONS

This patent application claims priority to, and thus the benefit of an earlier filing date from, U.S. Provisional Patent Application No. 62/706,578, filed on Aug. 26, 2020 and titled "FULLY INTEGRATED PARITY-TIME SYMMETRIC ELECTRONICS", the entire contents of which are incorporated herein by reference.

This invention was made with government support under EFMA1641109 and CNS-1657562 awarded by the National Science Foundation (NSF) and W911NF-12-1-0026 and W911NF-17-1-0189 awarded by ARMY/ARO. The government has certain rights in this invention.

BACKGROUND

Symmetries are ubiquitous in the physical world and play an indispensable role in many essential properties preserved in both classical and quantum systems. In particular, modern standard integrated circuits (ICs) have widely adopted geometric symmetry as an important design principle to improve the robustness of circuit performances. Parity-time-(PT-) symmetry has been extensively studied in classical wave fields including optics, optomechanics, acoustics, and electronics, enabling abundant novel applications.

Nonreciprocal devices play an important role in many aspects of modern microwave and photonic communication systems, such as gyrators achieving active filter design and miniaturization, optical isolators preventing components from excessive signal reflection, and millimeter-wave circulators enabling an inexpensive duplexer in wireless communication. Nonreciprocal components today in RF domain dominantly rely on ferromagnetic materials. However, they are typically bulky, expensive and not compatible with a conventional integrated circuit. Spatial-temporal parametric modulation can also achieve nonreciprocity but they need complex modulation techniques and are hard to scale in millimeter (mm)-wave domain. Parity-time-reversal (PT) symmetry is an emerging strategy to achieve non-reciprocity in wave transport. Nonlinear PT-symmetric integrated electronics enables strong nonreciprocal in broadband and can be easily scaled to smaller technology nodes to enable mm-wave isolator and circulator, which may bring revolution for 5G communication.

Developing a magnetic-free, non-reciprocity technology based on parity-time-reversal (PT) symmetric electronics to achieve extraordinary asymmetric transport behavior across a wide microwave spectrum (sub GHz to sub 100's GHz) is highly desired. Exploiting the novel property of such PT-symmetric electronics in the PT-symmetry-breaking phase using standard CMOS technology to create non-reciprocal microwave devices with unprecedented performance such as high isolation, wide bandwidth, low insertion loss, and large-scale modular integration, as well as configurability would provide numerous advantages.

BRIEF DESCRIPTION

In one aspect, an integrated circuit is disclosed. The integrated circuit includes a first resonator, a second resonator, and a coupling element. The first resonator has a first terminal and a second terminal, where the first resonator comprises a gain resistor, a gain capacitor, and a gain inductor in parallel and electrically coupling the first terminal with the second terminal. The second resonator has a third terminal and a fourth terminal, where the second resonator includes a loss resistor, a loss capacitor, and a loss inductor in parallel and electrically coupling the third terminal with the fourth terminal. The coupling element selectively couples the first terminal of the first resonator with the third terminal of the second resonator.

In another aspect, a Parity-Time (PT) symmetric integrated circuit is disclosed that generates a broadband nonreciprocal microwave transmission. The PT integrated circuit includes a first resonator, a second resonator, and at least one coupling member. The first resonator has a first terminal and a second terminal, and includes an active gain resistor, a gain capacitor and a gain inductor in parallel and electrically coupling the first terminal with the second terminal. The gain inductor includes a first coil tap. The second resonator has a third terminal and a fourth terminal, and the second resonator includes a loss resistor, a loss capacitor, and a loss inductor in parallel and electrically coupling the third terminal with the fourth terminal, where the loss inductor includes a second coil tap electrically coupled to the first coil tap of the gain inductor. The at least one coupling member selectively couples at least one of the first terminal with the third terminal, and the second terminal with the fourth terminal, where each coupling member includes at least one capacitor in series with a switch. A negative resistance of the active gain resistor is approximately equal to a magnitude of a resistance of the loss capacitor. An inductance of the gain inductor is approximately equal to an inductance of the loss inductor, and a capacitance of the gain capacitor is approximately equal to a capacitance of the loss capacitor.

In yet another embodiment, a Parity-Time (PT) symmetric integrated circuit is disclosed. The PT symmetric integrated circuit includes a first resonator, a second resonator, and a coupling member. The first resonator has a first terminal and a second terminal, where the first resonator includes an active gain resistor, a gain capacitor, and a gain inductor in parallel and electrically coupling the first terminal with the second terminal. The active gain resistor has a negative resistance, and the gain inductor includes a first coil tap. The second resonator has a third terminal and a fourth terminal, where the second resonator includes a loss resistor, a loss capacitor, and a loss inductor in a parallel and electrically coupling the third terminal with the fourth terminal. The second terminal is electrically coupled to the fourth terminal at a ground node for the first resonator and the second resonator, and the loss inductor includes a second coil tap electrically coupled to the first coil tap of the gain inductor. The coupling member selectively couples the first terminal of the first resonator with the third terminal of the second resonator. The coupling member includes at least one capacitor in series with a switch. The negative resistance of the active gain resistor is approximately equal to a magnitude of a resistance of the loss resistor, the inductance of the gain inductor is approximately equal to an inductance of the loss inductor, and a capacitance of the gain capacitor is approximately equal to a capacitance of the loss capacitor.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

These and other features, aspects, and advantages of the present disclosure will become better understood when the following detailed description is read with reference to the accompanying drawings in which like characters represent like parts throughout the drawings, wherein:

FIGS. 15A-15D depict a fully integrated PT-symmetric electronic system;

FIG. 34 is a table comparing a microwave generator between a fully integrated PT-symmetric electronic system and a baseline oscillator;

FIG. 38 is table comparing non-reciprocity between a fully integrated PT-symmetric electronic system and standard isolators;

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

This disclosure is directed toward introducing PT-symmetry into IC designs by implementing a fully integrated PT-symmetric electronic system operating at 3.2 GHz in a standard commercial 130-nanometer complementary metal-oxide-semiconductor (CMOS) process, as well as introducing magnetic-free, transmission non-reciprocity based on nonlinear PT-symmetric electronics with a fully on-chip microwave isolator that integrates all the components on CMOS technology.

Figure 1A:
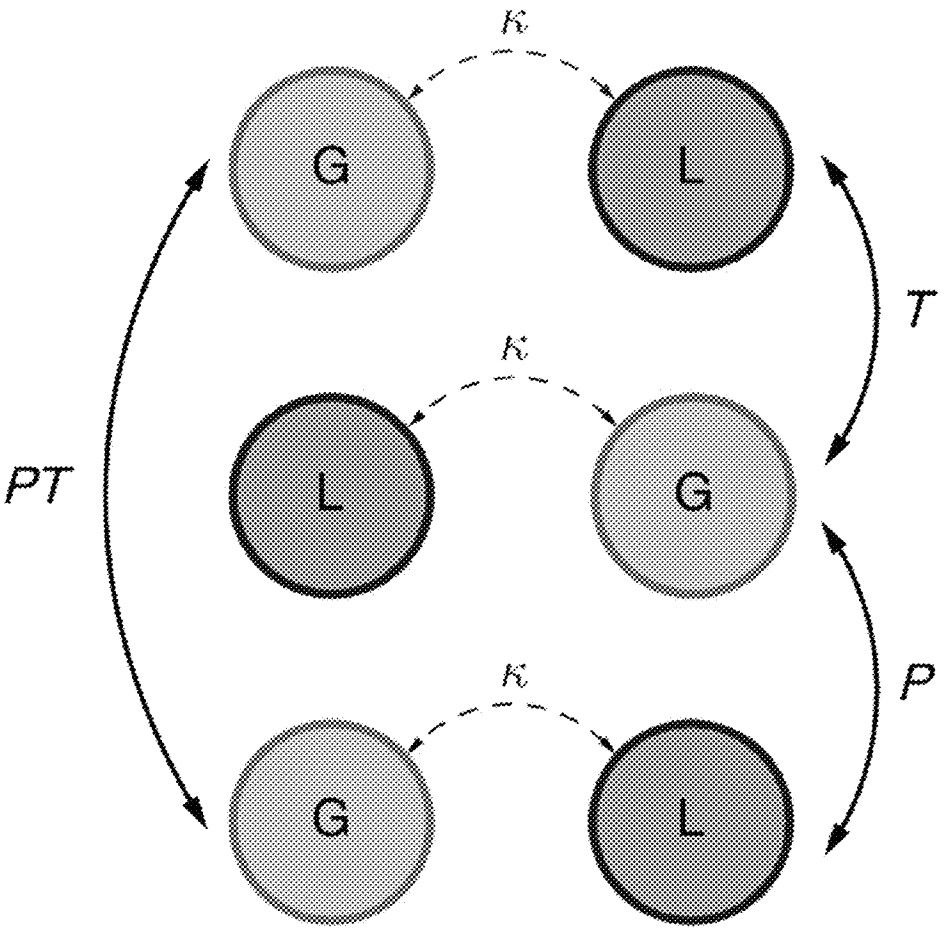
FIG. 1A is a graph of two coupled structures with loss and gain forming a PT-symmetry system.

Symmetries are the most essential notions to explain the physical world and influence the fundamental properties of physical systems in many aspects. In physics, symmetries refer to the invariant features of a system under certain operations. For example, parity- (P-) symmetry requires that a system remains invariant under spatial inversion; time reversal- (T-) symmetry represents the invariance of evolution when reversing the time flow. Specially, quantum systems whose Hamiltonians commute with the joint PT operator ($PT\hat{H}=\hat{H}PT$), possess a special kind of symmetry, known as the parity-time- (PT-) symmetry. In general, an open quantum system interacting with the environment can be described by non-Hermitian Hamiltonians, where the Hamiltonian preserves complex eigenvalues. However, a system preserving PT-symmetry possesses purely real eigenspectra in certain parameter regimes whereas the eigenstates are non-orthogonal to each other. PT-symmetry has been realized on various platforms with a typical configuration of two coupled units with a judiciously tailored gain-loss distribution and intermodal coupling, as shown in FIG. 1A, such as coupled waveguides and resonators. When the coupling coefficient is stronger than a threshold determined by the gain-loss contrast, the PT-symmetry is unbroken and the eigenvalues are real, corresponding to an oscillating field with an even energy distribution in two units. Otherwise, the system enters the broken PT-symmetry regime, where the eigenvalues have opposite imaginary parts, i.e., two eigenstates are strongly localized in the two units and evolve with amplification and dissipation respectively. This PT-symmetry phase transition accompanied by spontaneous symmetry breaking creates non-trivial physics and has been shown in optics, optomechanics acoustics and electronics, enabling a number of novel applications, such as coherent perfect absorber-lasers (CPA), single-mode micro-ring lasers, ultra-sensitive sensors, non-reciprocal devices, and robust wireless energy transfer.

Figure 1B:
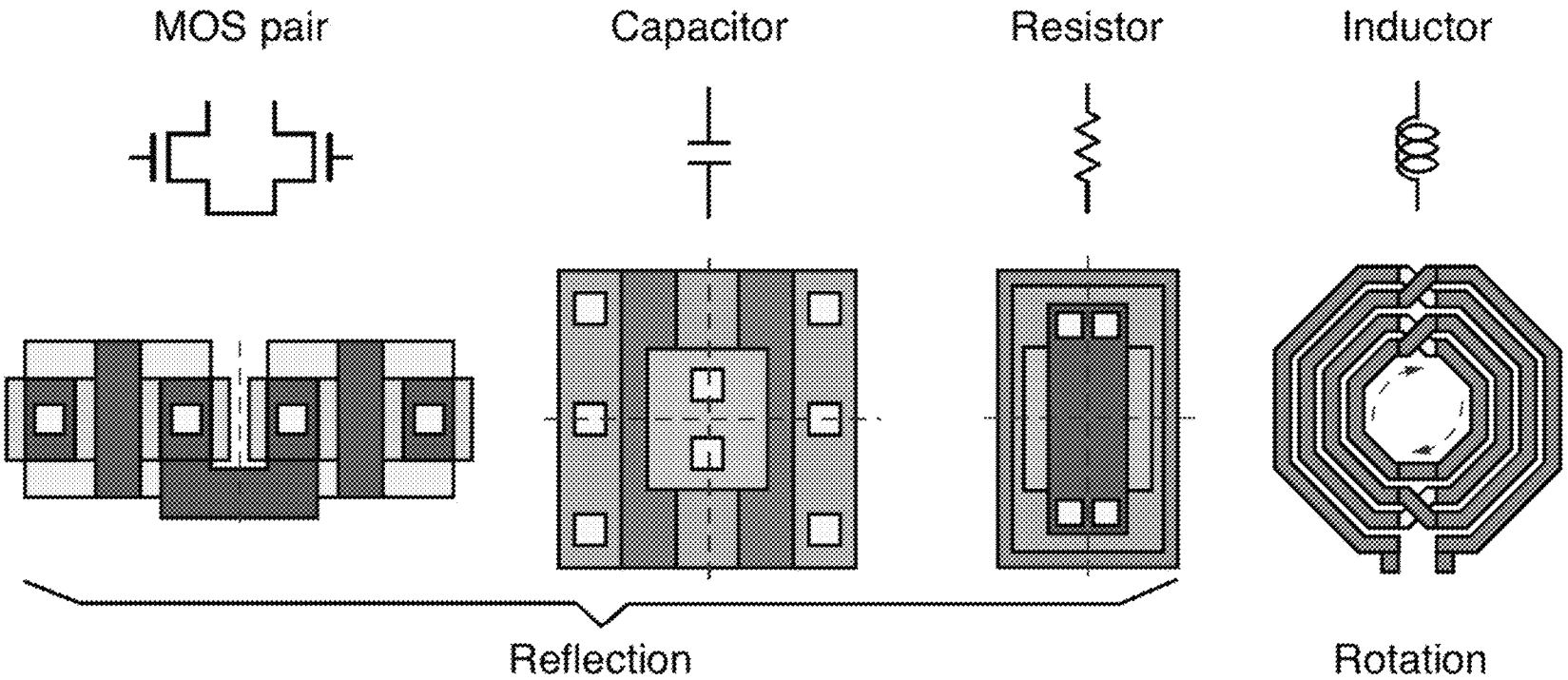
FIG. 1B are symmetrical physical layouts of MOS devices, capacitors, resistors and inductors widely used in the standard IC designs.

Modem integrated circuits (ICs) that embed millions of microscopic individual elements shown in FIG. 1B, such as transistors, capacitors (C), resistors (R), and inductors (L), have played an important role in modern life. Geometric symmetry, shown in FIG. 1B, such as reflective symmetry and rotational symmetry, has been widely employed as an important design principle to improve circuit performance. For example, geometric symmetry lays the foundation of differential circuit structures (e.g., a MOS pair), which utilize differential signals to reduce their sensitivities to process, voltage, and temperature (PVT) variations. In another instance, geometric symmetry also manifests itself in the physical layout of on-chip passive components (e.g., directional couplers, 90° hybrid and 180° hybrid), which leverage the symmetric scattering property to minimize the reflection of signal transmission. However, PT-symmetry remains missing in IC systems, though both gain and loss are common phenomena there. PT-symmetry in IC systems has remained unexplored because gain is often desirable in IC designs, while loss is not.

Figure 1C:
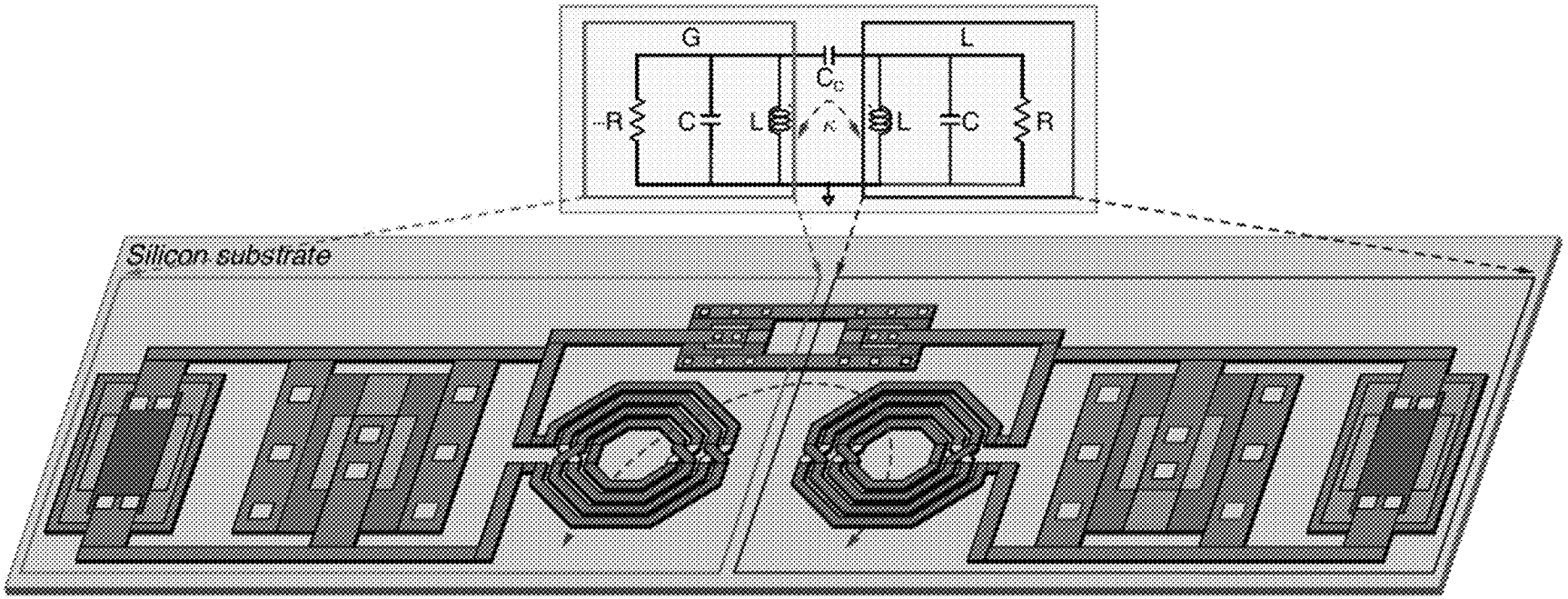
FIG. 1C is a standard IC with PT-symmetry by using two coupled RLC resonators, one with gain and the other one with equivalent loss.

Bringing PT-symmetry into modern IC design methodology as a new principle enriches IC capabilities and efficiencies. There exists tremendous synergy between PT-symmetry and IC technology. PT-symmetry enhances the reactive property of on-chip devices through the strategic manipulation of gain-loss contrast, while IC technology provides a versatile and scalable platform to create highly-integrated PT-symmetric structures with multiple coupling mechanisms shown in FIG. 1C. First, loss is abundant in ICs, often intentionally introduced by polysilicon resistors or transistors. Second, gain can be obtained from the transconductance $g_m$ of a transistor, defined as the partial derivative between the drain current $I_D$ and gate voltage $V_G$, namely, $g_m=\partial I_D/\partial V_G$. As both $I_D$ and $V_G$ decrease with the downscaling of IC technology, $g_m$ remains constant, enabling the same amount of gain to be generated with smaller power consumption. Third, the coupling between the gain and loss units can be realized not only by capacitive coupling via varactor or capacitor array, but also by inductive coupling via electromagnetic interrogation. In addition, the whole system can be robustly controlled by either manual or programmable external electrical biases with high fidelity.

Figure 2A:
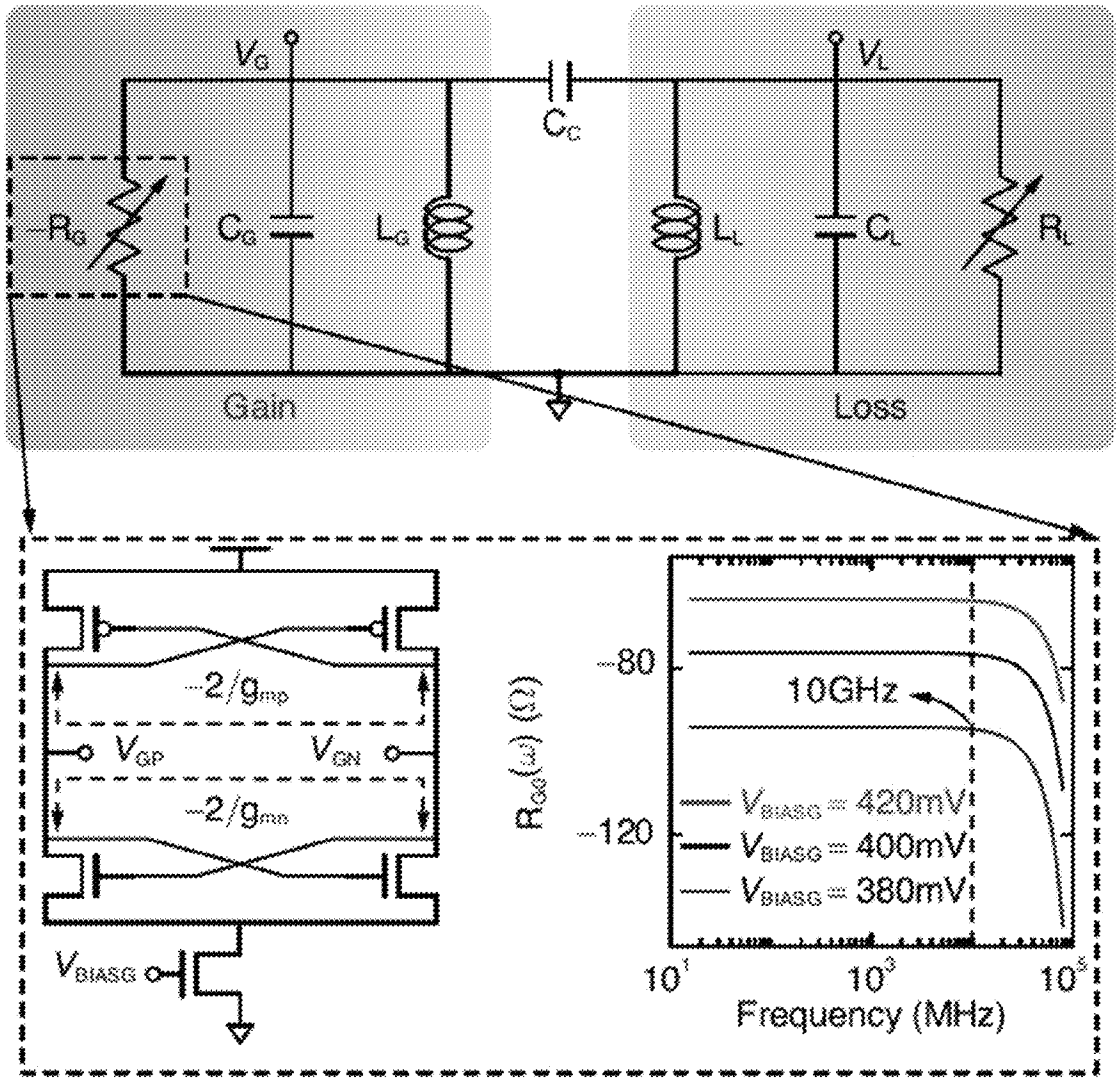
FIG. 2A is a schematic diagram of a fully integrated PT-symmetric electronic system.
Figure 3:
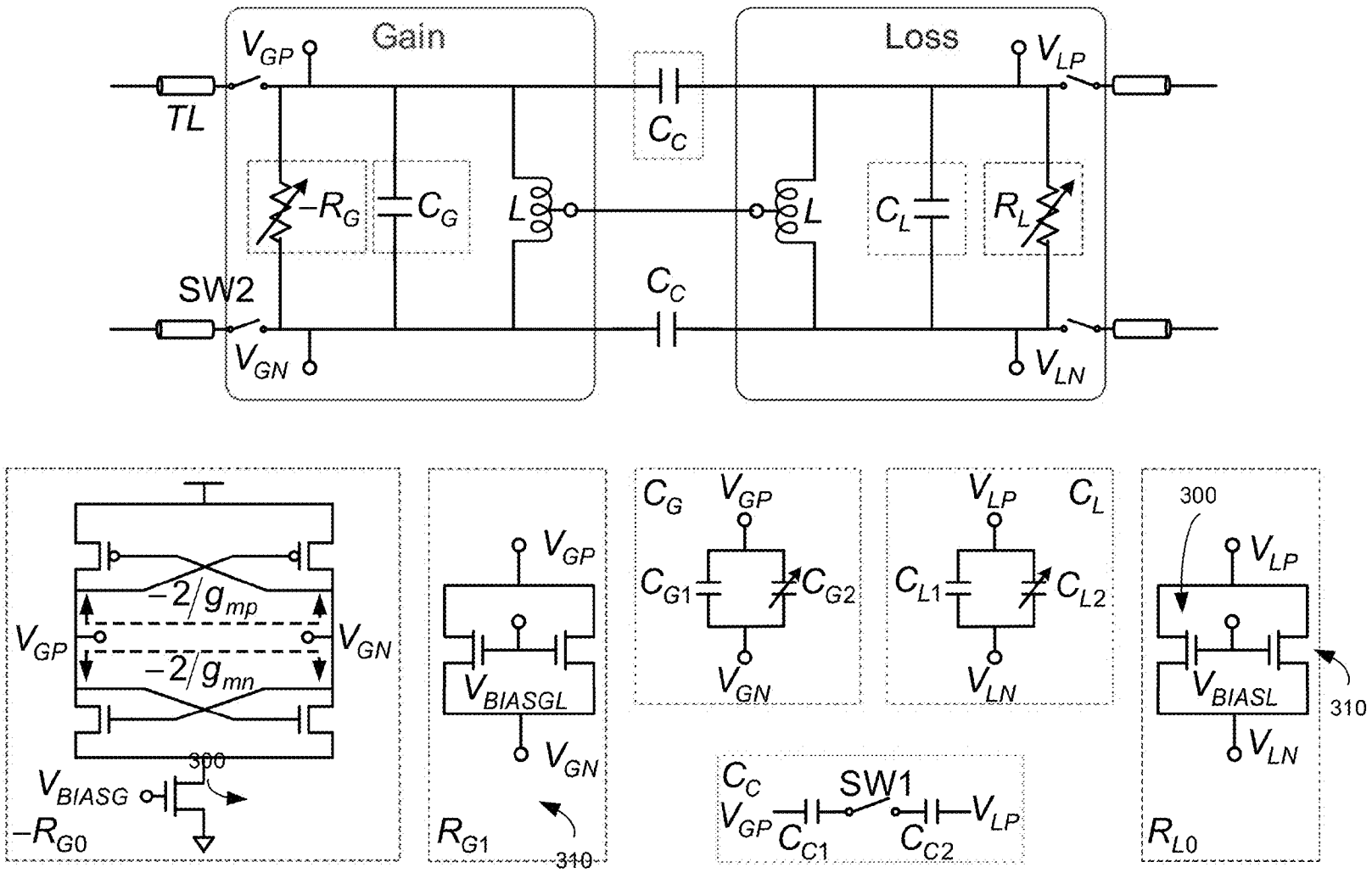
FIG. 3 is a circuit schematic of a fully integrated PT-symmetric electronic system with differential architecture.

A PT-symmetric electronic system is composed of two capacitively coupled parallel-connected RLC resonators, one with gain and the other one with equivalent loss shown in FIG. 2A. A differential architecture is implemented, which has superior device matching and better robustness against noise and interference. The detailed design of the differential architecture on the fabricated chip is shown in FIG. 3. The system shown in FIG. 3 was implemented with a differential topology, in contrast with the single-ended architecture commonly used in board-level and MEMs-level PT-symmetric electronic system. It should be understood that, unless otherwise specified, components shown in the figures and described in this application may represent individual components, combinations of like components (e.g., a single resistor representing a series and/or parallel combination of resistors), ideal components, real components with parasitic elements not separately illustrated, or parasitic elements of other components (whether illustrated or not). The differential architecture has the advantage to overcome device mismatch and noise interference. The system shown in FIG. 3 consists of two RLC resonators, one with active gain $-R_G$ and the other one with passive loss $R_L$. The gain $-R_G$ is the parallel resistance of $-R_{G0}$, $R_{G1}$ and $R_{G2}$, namely, $-R_G=-R_{G0}\|R_{G1}\|R_{G2}$. Here, $-R_{G0}$ is generated by the cross-coupled differential pair (XDP); $R_{G1}$ is a variable resistor realized by two NMOS transistors whose gates are connected to each other; $R_{G2}$ is the inherent loss of the gain resonator. Similarly, the loss $R_L$ is the parallel resistance of $R_{L0}$ and $R_{L1}$, that is $R_L=R_{L0}\|R_{L1}$. Here, $R_{L0}$ is a variable resistor realized by in the same way as $R_{G1}$; $R_{L1}$ is the inherent loss of the passive resonator. By controlling the bias V voltage $V_{BIASGL}$ ($V_{BIASL}$) of gain (loss) side, $-R_G$ ($R_L$) can be continuously adjusted. The capacitor $C_G$ ($C_L$) in each resonator is composed of a parasitic capacitance $C_{G0}$ ($C_{L0}$), a fixed Metal-Insulator-Metal (MIM) capacitor $C_{G1}$ ($C_{L1}$) with high-quality factor (high-Q) and an adjustable varactor $C_{G2}$ ($C_{L2}$) with small tuning range. The varactor takes up a small proportion of the total capacitance and is used to compensate for the fabricated mismatch between the fixed MIM capacitors on both sides. The coupling capacitance $C_C$ is designed by two equal MIM capacitors $C_{C1}$ and $C_{C2}$ in serial connection via an on-chip switch (SW1). The two resonators can also be coupled or decoupled by turning on or off the SW1.

Figure 2B:
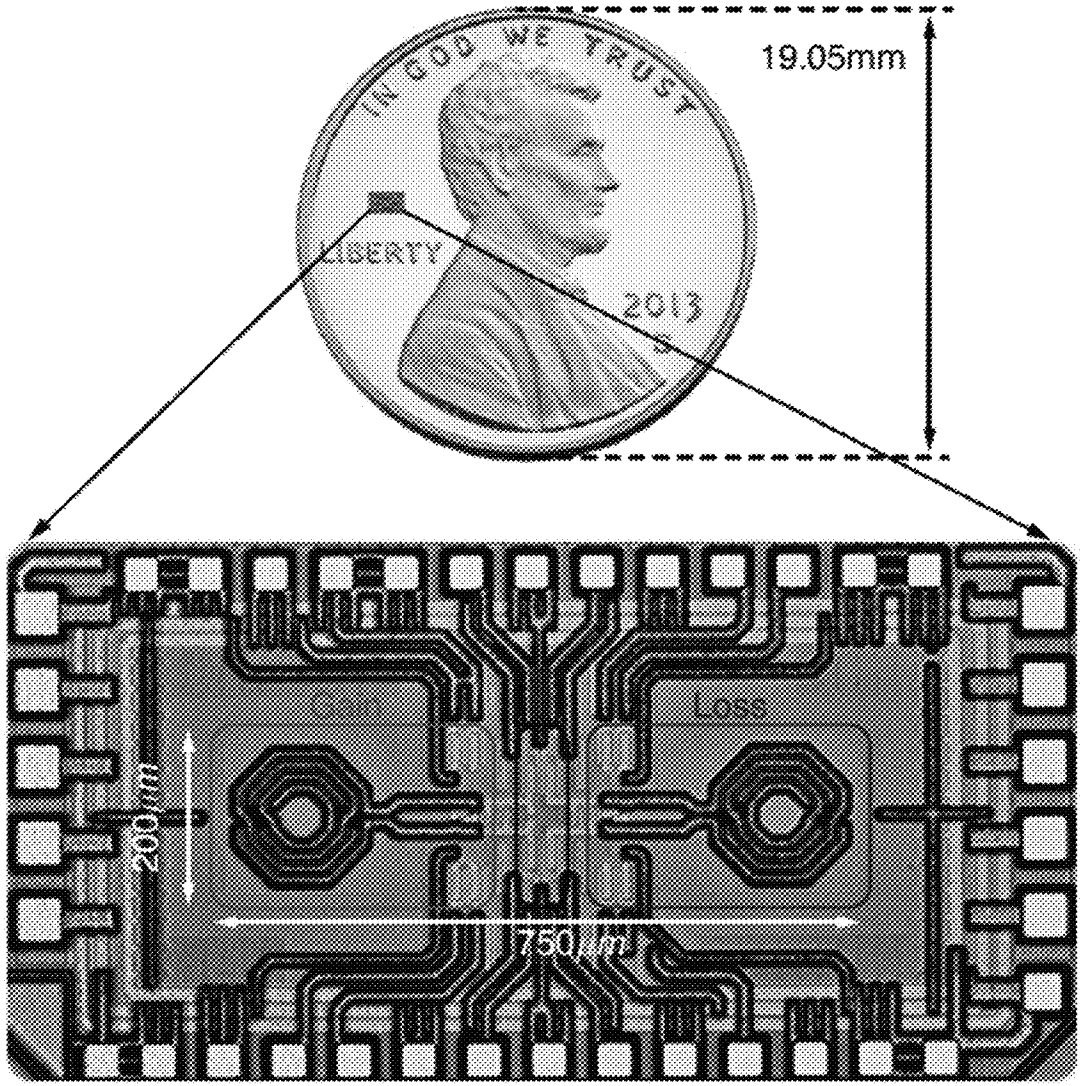
FIG. 2B is a die photo of the fully integrated PT-symmetric electronic system fabricated on 130 nm CMOS.
Figure 4A:
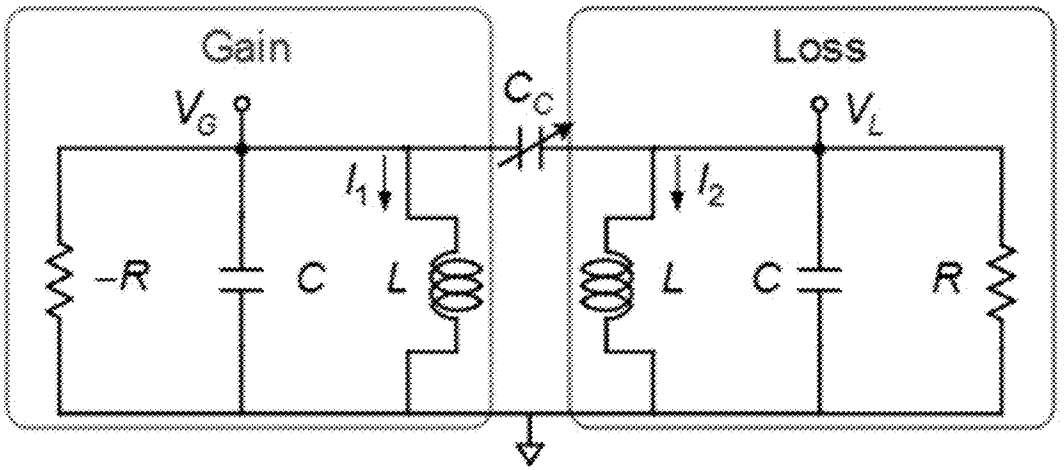
FIG. 4A is coupling-tuning architecture implementing a fully integrated PT-symmetric electronic system.
Figure 4B:
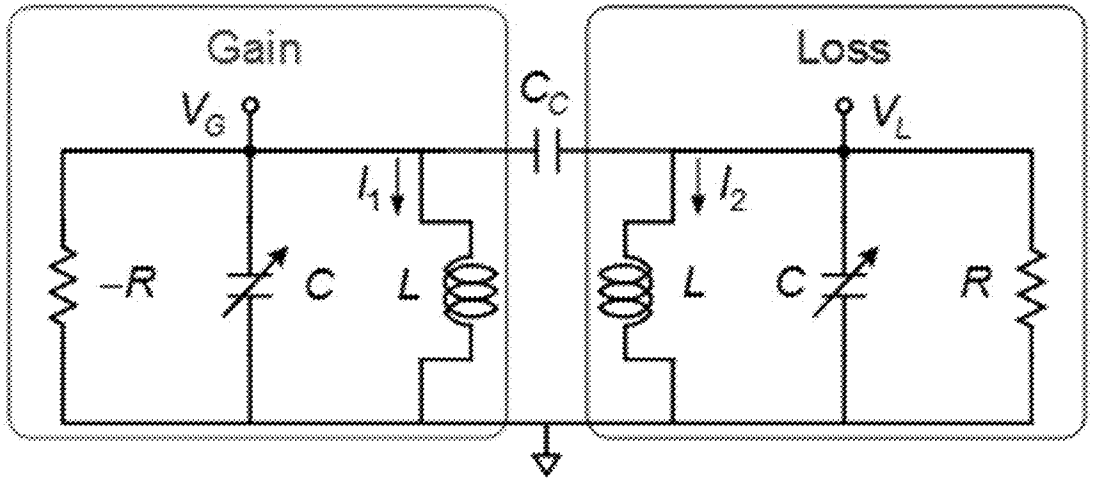
FIG. 4B is capacitive tuning architecture implementing a fully integrated PT-symmetric electronic system.

Referring again to FIG. 2A, an equivalent single-ended circuit schematic of the design is used to simplify the analysis. The active resonator has a gain rate $-R_{G0}$ (a negative resistance), a variable loss rate $R_{G1}$, and an inherent loss rate $R_{G2}$, yielding a total gain of $-R_G=-RG_0|RG_1\|RG_2$. A cross-coupled differential pair (XDP, shown in FIG. 2A) represents a negative resistance converter (NRC) in the system. This NRC can better conserve energy than an operational-amplifier (op-amp) based NRC21-24 or Colpitts-type based NRC while generating the same amount of gain. It can also provide a constant and stable transconductance across a broad frequency range, as shown in FIG. 2A. The loss resonator has a loss rate of $R_L=RL_0\|RL_1$ where $RL_0$ is a variable loss and $RL_1$ is the inherent loss. Both the gain, −RG, and loss, RL, can be flexibly adjusted by external voltage biases, and both resonators have the same natural frequency, $\omega_0$=3.2 GHz, as well. All the devices and components are integrated on one monolithic chip using standard commercial 130 nm CMOS technology, achieving a full integration of a PT-symmetric electronic system whose core area is 200×750 $\mu m^2$, as shown in FIG. 2B. The PT-symmetry condition is satisfied by setting RG RL≈RL=R, LG≈LL=L, and CG≈CL=C. Alternative on-chip PT-symmetric structures using different tuning setting mechanisms could also be implemented, as shown in FIG. 4A and FIG. 4B.

In addition to the proposed architecture described further below based on the gain or loss tuning, it is straightforward for to implement other architectures for the system by leveraging the flexible tuning mechanisms of IC. Two variants of the system are proposed by using 130 nm CMOS technology shown in FIG. 4A and FIG. 4B. FIG. 4A is based on coupling-tuning architecture. In this architecture, all the components are fixed except for the coupling capacitance $C_C$. The $C_C$ can be realized as a capacitance array controlled by binary digital codes or varactor. The second variant in FIG. 4B uses a capacitance-tuning mechanism. In this architecture, all the components are fixed except for the resonator capacitance $C_G$ ($C_L$). The $C_G$ ($C_L$) can also be realized by a capacitance array controlled by binary digital codes or varactor. Although they are different in tuning mechanism, the theory of the PT-symmetry spontaneous breaking keeps the same. Based on EQ. 4 discussed below, in the coupling-tuning architecture, $\gamma_{EP}$ and $\gamma_{up}$ are evolving with the capacitance ratio c while $\gamma$ is fixed. In the capacitance-tuning architecture, all $\gamma$, $\gamma_{EP}$ and $\gamma_{up}$ are evolving with the resonator capacitance C with $\gamma_{EP}$ and $\gamma_{up}$ changing faster.

We first numerically analyze the PT-symmetry transition of the system based on the small signal model which is commonly used in analyzing analog circuits. The system is considered as a linear time invariant system, which is valid for small signal inputs. By applying Kirchoff's law on the equivalent circuit, as shown in FIG. 2A, four normalized eigenfrequencies are found, i.e $$\omega_{1,2} = \pm\frac{\sqrt{\gamma_{EP}^2-\gamma^2}-\sqrt{\gamma_{UP}^2-\gamma^2}}{2\sqrt{1+2c}},\ \omega_{3,4} = \pm\frac{\sqrt{\gamma_{EP}^2-\gamma^2}+\sqrt{\gamma_{UP}^2-\gamma^2}}{2\sqrt{1+2c}}.$$

Here $\gamma_{EP}$ denotes the phase transition point (also termed as the exceptional point, EP) and $\gamma_{up}$ is the upper critical point; c is defined as the capacitive coupling ratio between the coupling capacitance $C_c$ and resonator capacitance C; and $\gamma$ is the normalized tuning parameter of gain or loss, defined as $\sqrt{L/C}/R$. In the exact phase ($0<\gamma/\gamma_{EP}<1$), the system is characterized by four purely real eigenfrequencies, with two of them positive ($W_1$, $W_3$) and the other two negative ($W_2$, $W_4$). The corresponding phase difference between the fields in two resonators can be expressed as $$\phi_{1,3} = \pi/2 - \tan^{-1}\left[\frac{1}{\gamma}\cdot\left(\frac{1}{\omega_{1,3}} - (1+c)\cdot\omega_{1,3}\right)\right].$$

In the broken phase ($\gamma/\gamma_{EP}>1$, $\gamma/\gamma_{UP}<1$), the eigenfrequencies are complex conjugate pairs with non-vanishing real parts, with a single phase difference between the fields in the two resonators. Above $\gamma/\gamma_{EP}>1$, the eigenfrequencies become two complex conjugate pairs with purely imaginary parts.

Figure 5B:
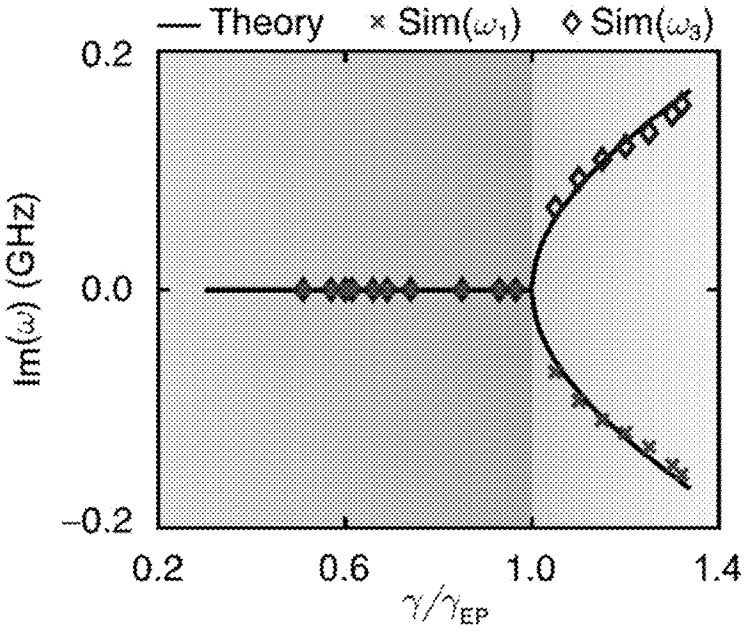
FIG. 5B is a graph of the imaginary parts of eigenfrequencies and phase transition of the fully integrated PT-symmetric electronic system with the evolution of coupling factor.
Figure 5A:
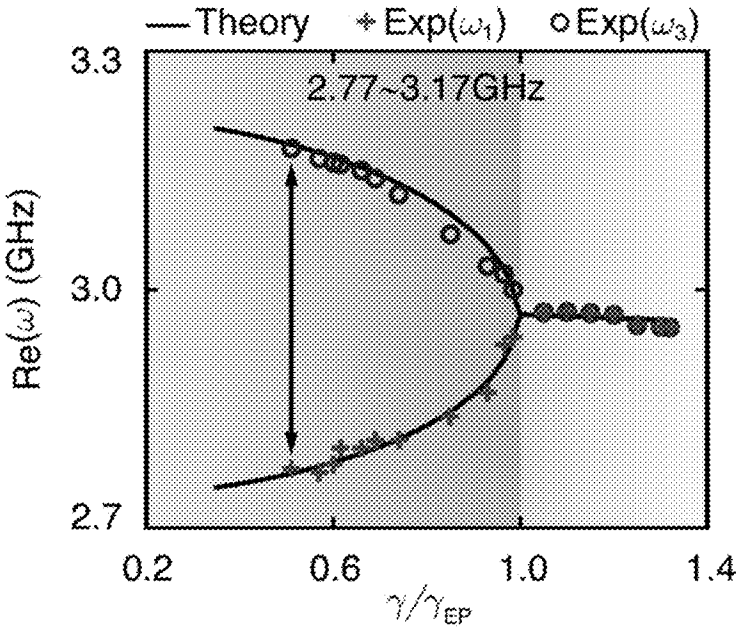
FIG. 5A is a graph of the real parts of eigenfrequencies and phase transition of the fully integrated PT-symmetric electronic system with the evolution of coupling factor.

Experimentally, $\gamma$ is engineered by adjusting the gain (loss) and maintaining other circuit parameters unchanged; thus the bifurcation of the eigenfrequencies with respect to the coupling factor $\gamma/\gamma_{Ep}$ is shown in FIG. 5A. In the exact phase, the system has two purely real eigenfrequencies. When $\gamma$ increases, the system undergoes a phase transition at the EP($\gamma/\gamma_{Ep}=1$), where the real eigenfrequencies branch out into the complex plane. In the broken phase, the system possesses two supermodes with single resonance frequency but with amplification and dissipation respectively. The imaginary parts of the eigenfrequencies in the broken phase were obtained by Simulation Program with Integrated Circuits Emphasis (SPICE), since the oscilloscope used could not capture the fast-changing dynamics of the exponentially oscillating amplitudes at the terminals ($V_G$ and $V_L$) of the resonators. In the simulation, exponential growth rather than decay was observed, and the results of decay shown in FIG. 5B are the mirror image of those for amplification. The two resonators had the same magnitude of voltage in the exact phase, and the oscillation exponentially grew (ended up at a saturation level) in the broken phase.

Figure 5D:
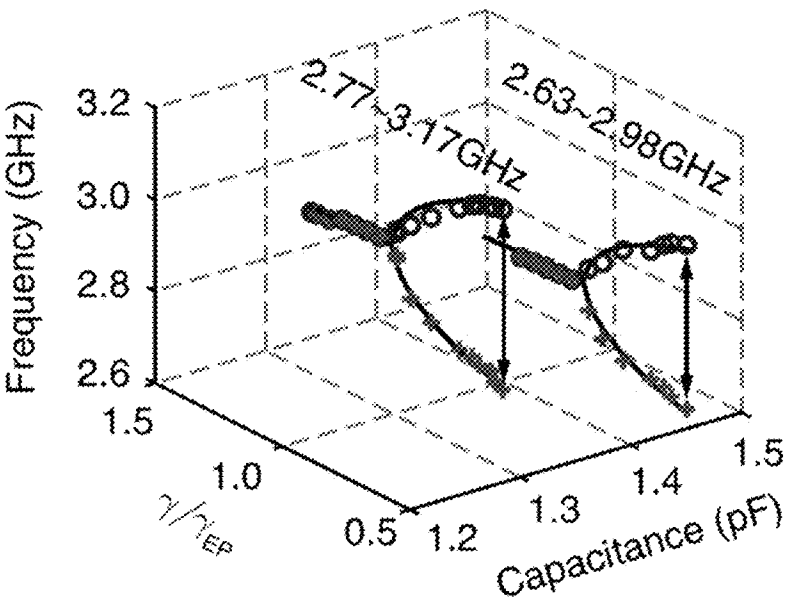
FIG. 5D is a graph of frequency tuning range of a fully integrated PT-symmetric electronic system when tuning the capacitors of resonators at two fixed capacitances, C=1.3 pF and C=1.45 pF.
Figure 5C:
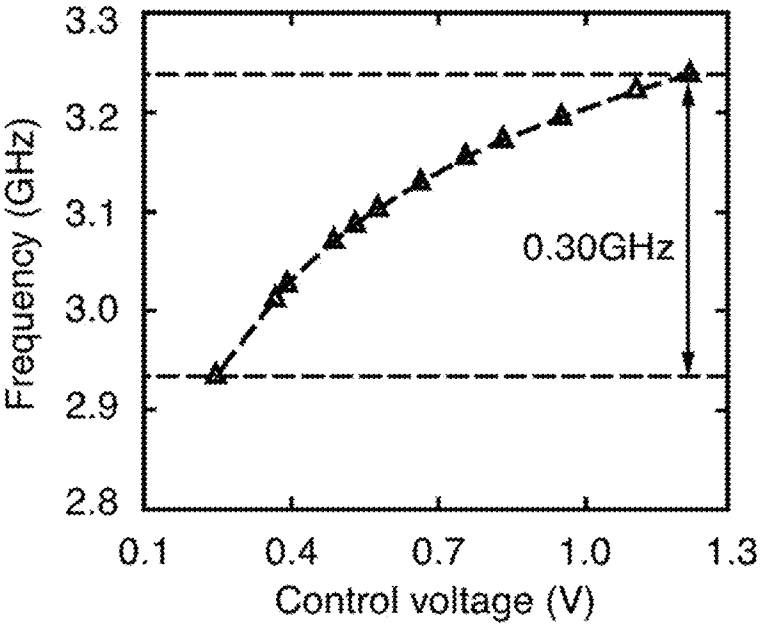
FIG. 5C is a graph of frequency tuning range of a traditional LC voltage controlled oscillator (VCO)
Figure 6C:
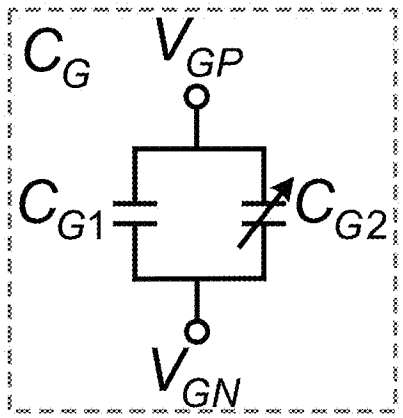
FIG. 6C is a circuit design of a capacitor in the circuit schematic of FIG. 6A and the circuit diagram of FIG. 6B.
Figure 6B:
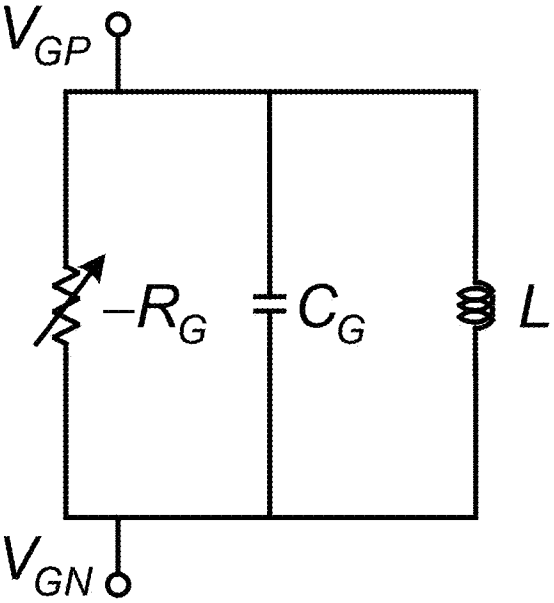
FIG. 6B is a circuit diagram of the circuit schematic in FIG. 6A.
Figure 6A:
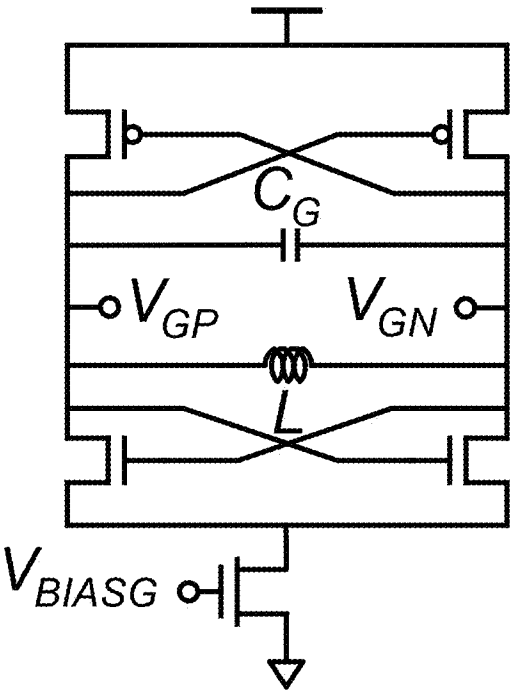
FIG. 6A is a circuit schematic view of a LC voltage controlled oscillator (VCO) as a gain resonator.
Figure 7A:
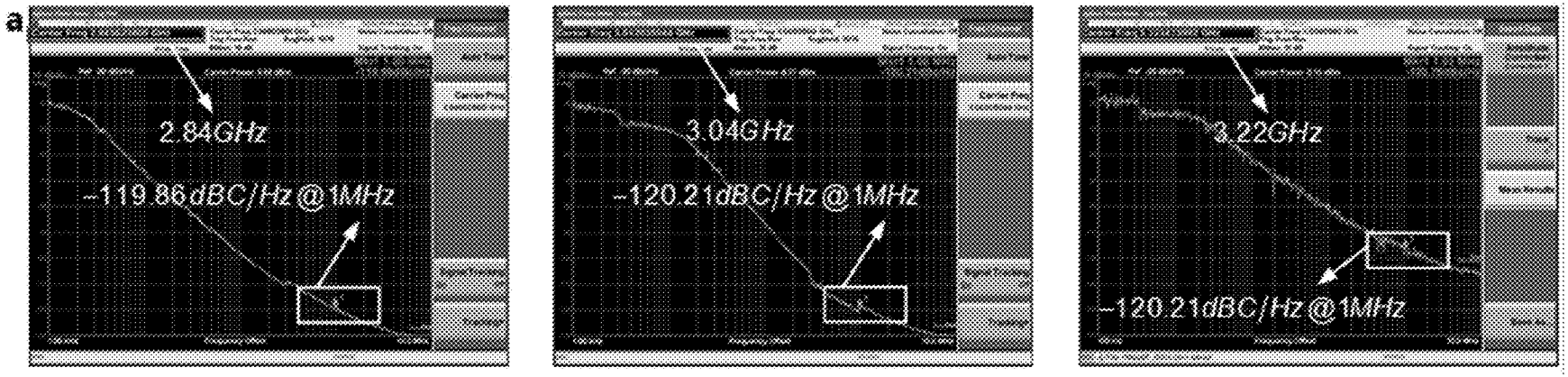
FIG. 7A are graphs of comparison of phase noise between PT-symmetric electronic system and an LC voltage controlled oscillator (VCO) at a first low, medium, and high frequency.
Figure 7B:
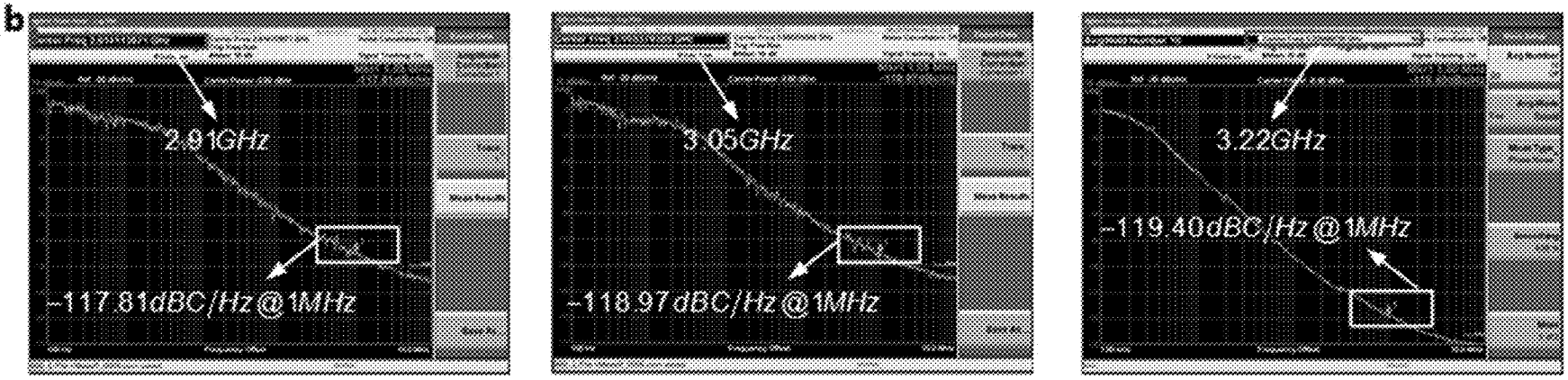
FIG. 7B are graphs of comparison of phase noise between PT-symmetric electronic system and an LC voltage controlled oscillator (VCO) at a second low, medium, and high frequency.

The phase transition feature of the system provides a new strategy to implement a different kind of high-speed voltage-controlled oscillator (VCO) with both capacitive and resistive tuning mechanisms, distinguishing itself from conventional LC VCOs that use only capacitive tuning mechanism or inductive tuning mechanism. For comparison, a traditional LC VCO with capacitive tuning, shown in FIG. 6A, FIG. 6B, and FIG. 6C was obtained in experiments by decoupling the two RLC resonators, which was capable to achieve a 0.30 GHz (2.933.23 GHz) tuning range by adjusting the capacitance with external biases as was done in FIG. 5C. In contrast, the fully integrated PT-symmetric electronic system can achieve a 0.54 GHz (2.633.17 GHz) tuning range with two degrees of freedom as was done in FIG. 5D, enabling an 80% improvement of the oscillation frequency tuning range. FIG. 6A shows a schematic view of the LC VCO. FIG. 6B shows an equivalent model of the LC VCO, which is the gain resonator in the system. FIG. 6C shows the design of capacitor in the LC VCO. It is also observed that the phase noise performances of the system are generally better than the traditional LC VCO across different oscillation frequencies. FIG. 7A and FIG. 7B show this comparison of phase noise between PT-symmetric electronic system and the LC VCO. FIG. 7A shows phase noise of PT-symmetric system at different frequencies: 2.84 GHz (low frequency), 3.04 GHz (medium frequency), and 3.22 GHz (high frequency). This can be attributed to the fact that PT-symmetry can enhance the intrinsic Q-factor of on-chip passive devices. These experiments demonstrate that PT-symmetry provides more degrees of freedom to improve the tuning range of VCOs with good phase noise. An extended tuning range is especially important to oscillators in the millimeter-(mm-) wave domain, where on-chip passive devices (e.g., C, L) have limited tuning range (smaller than 5 percentage). PT-symmetry has the potential to achieve widely tunable mm-wave VCOs with extra dimension of resistive tuning.

Figure 8:
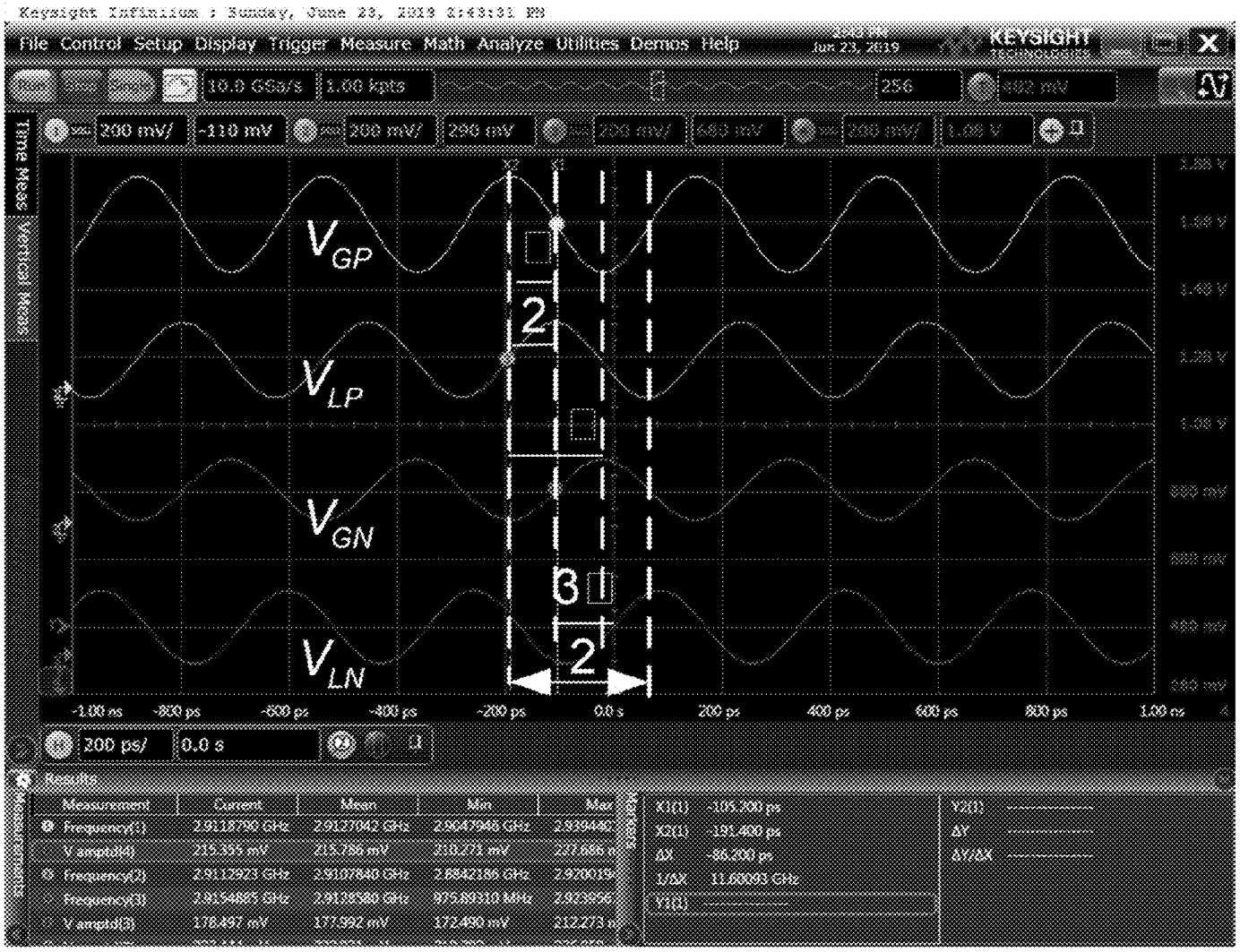
FIG. 8 is a graph showing quadrature voltage controlled oscillator (VCO) enabled by a PT-symmetric electronic system.

In addition, a further derivation shows that $\pi/2$ at EP when the coalescence frequency $\omega_1=\omega_3=c$. Thus the phase of $V_{GP}$, $V_{GN}$, $V_{LP}$, and $V_{LN}$ are 0, $\pi$, $\pi/2$, and 3 $\pi/2$ in the differential architecture, respectively. Therefore, the EP in the system provides a new mechanism to design high-speed quadrature VCOs which is an important component to generate four-phase wireless communication systems. FIG. 8 shows the experimental results of the quadrature-VCO enabled by the system.

Figure 9A:
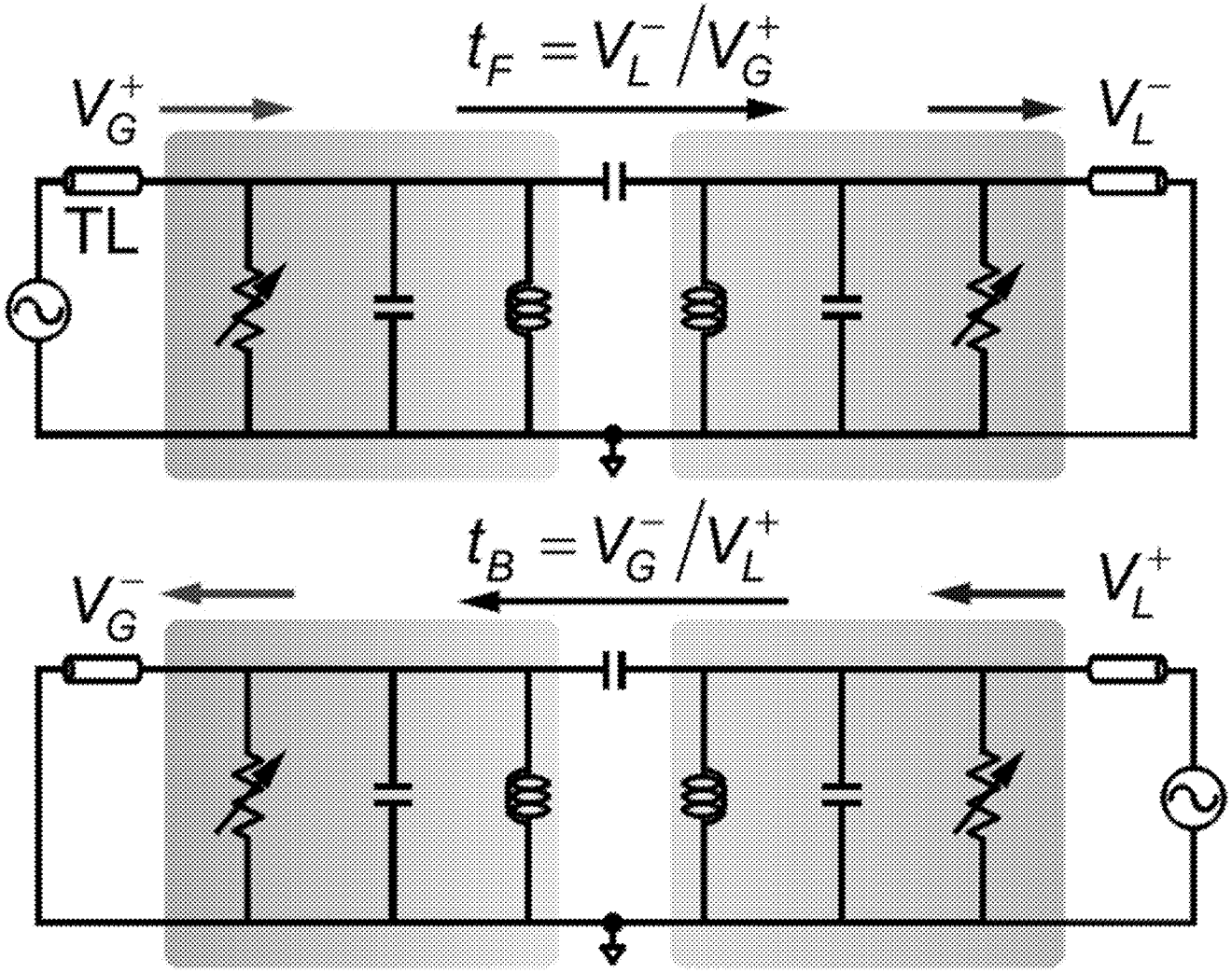
FIG. 9A is a circuit diagram for experimental setup for testing forward transmission and backward transmission to investigate scattering of a fully integrated PT-symmetric electronic system.
Figure 9B:
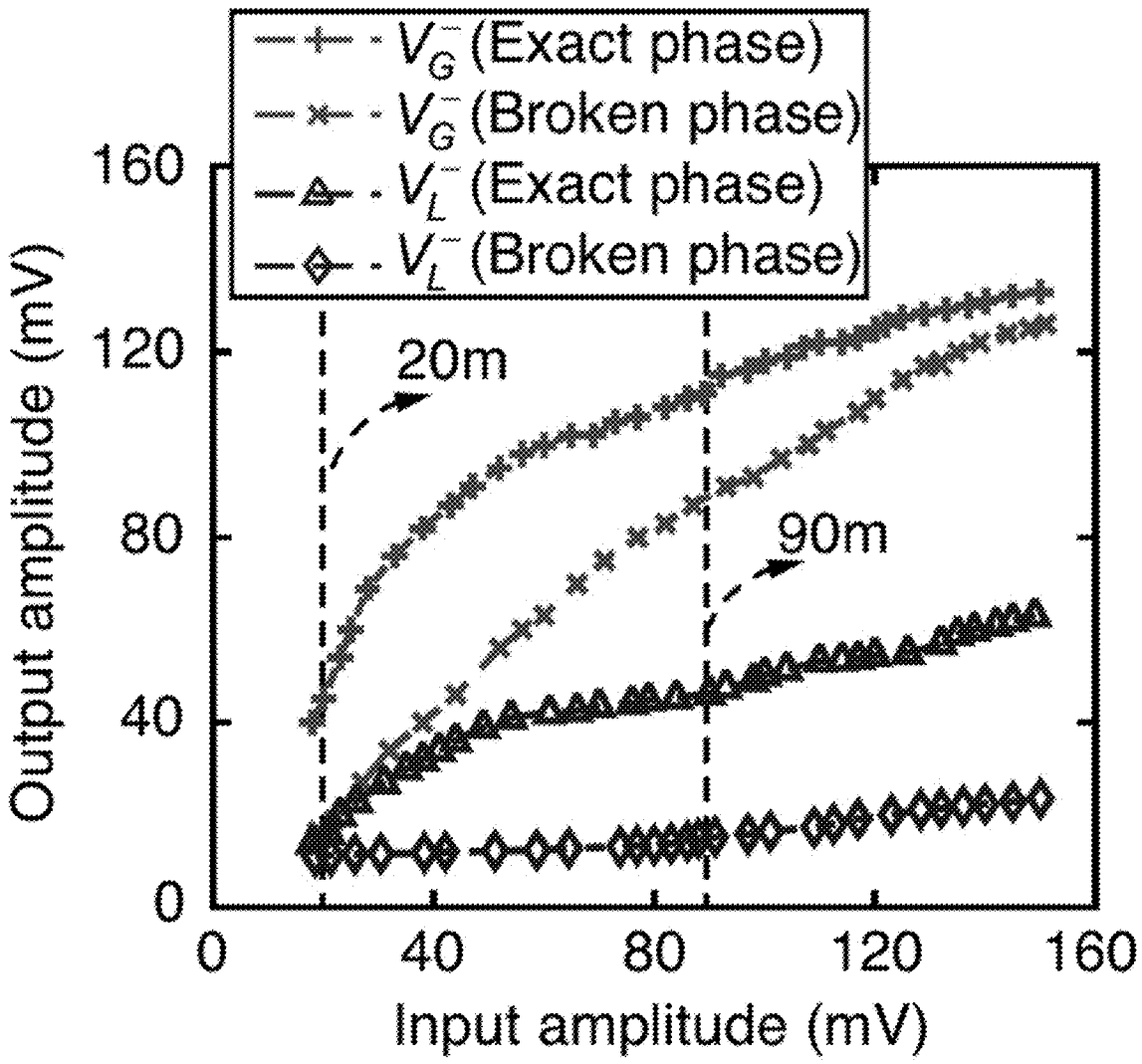
FIG. 9B is a graph of backward and forward input-output responses in both the exact phase and broken phase during an experiment to investigate scattering of a fully integrated PT-symmetric electronic system.

Next, the linear and nonlinear working regions of the system were characterized. Although the small signal model is used to simplify the analysis, nonlinearities are prevalent in CMOS integrated systems working at high frequency and in a large signal domain. The XDP in the system is inherently a nonlinear gain generator and provides both a frequency-dependent and complex high-order amplitude-dependent negative conductance, in contrast to the simple low-order amplitude-dependent gain in conventional PT-symmetric electronics. To experimentally characterize the nonlinearity of the system, the equivalent of a transmission line (TL) with characteristic impedance $Z_0$ was attached to both sides of the system through an on-chip switch in the form of a resistor $R_0=Z_0$. The system was biased in either the exact or the broken phase and then monitored the output voltage $V_G^-$ ($V_L^-$) at the gain (loss) side by sourcing the amplitude-varying input $V_L$ or $V_G$, into the loss or gain side shown in FIG. 9A. FIG. 9A shows the experimental setup for testing forward transmission $t_F$, and backward transmission $t_B$. In both phases, a nonlinear response was clearly observed with a large input voltage, consistent with the fact that nonlinearity is ubiquitous in electronic components. Yet stronger nonlinearity appears in the broken phase for small input amplitudes shown in FIG. 9B. FIG. 9B shows backward/forward input-output responses in both the exact phase and broken phase. In particular, linear response is observed in exact phase under small input voltages (20 mV), in contrast to the nonlinear response in broken phase with the same small input voltage. This finding shows that the nonlinearity is enhanced in the broken phase due to the field localization in the gain resonator.

Figure 9C:
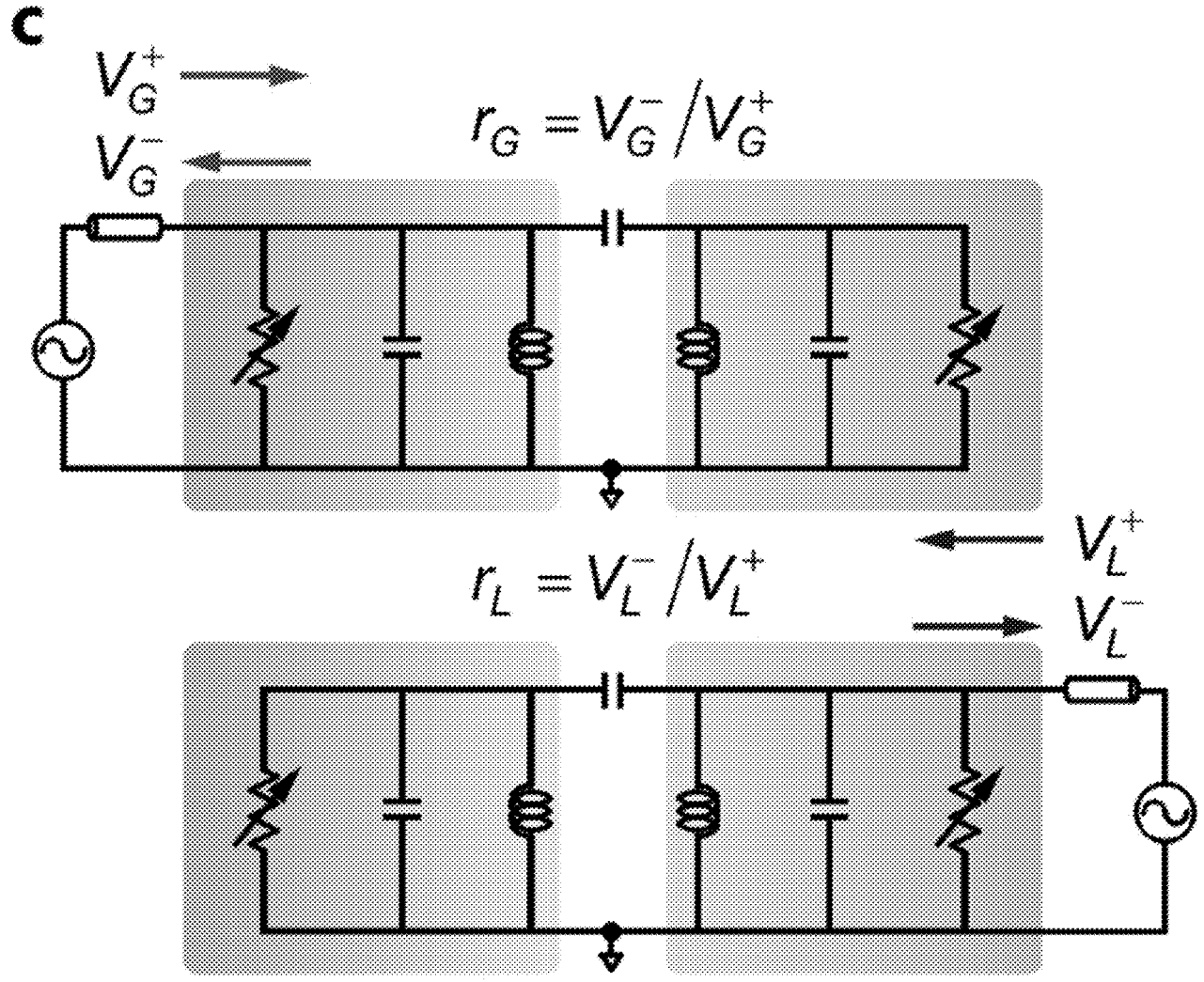
FIG. 9C is a circuit diagram demonstrating conceptual illustration of a scattering experiment setup of a fully integrated PT-symmetric electronic system.
Figure 9D:
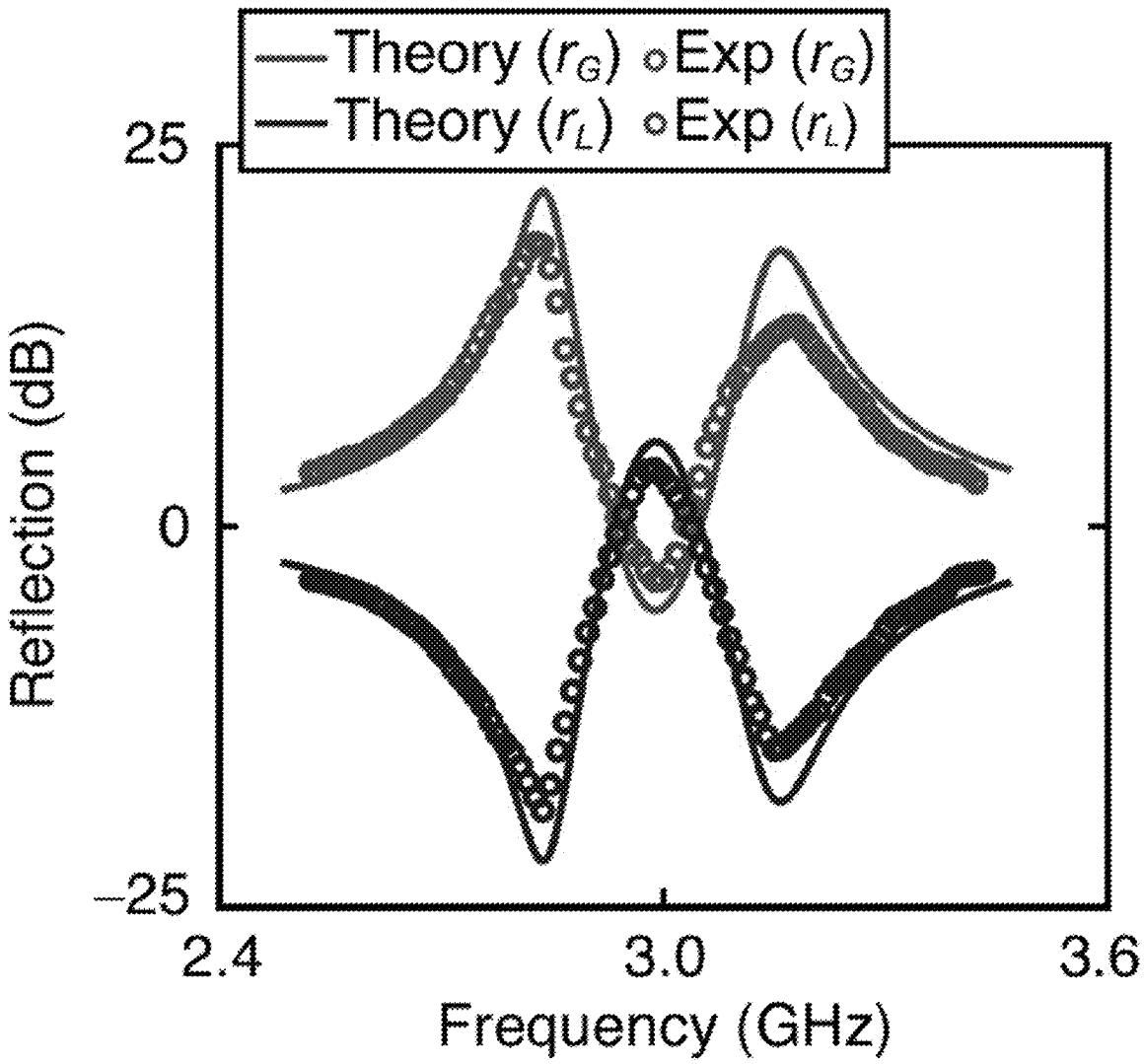
FIG. 9D is a graph showing comparison of reflection coefficients between experimental measurements and PT-symmetry theory in the linear region of the exact phase.

Based on the characterization, the scattering property of the system in the linear region was studied. The theory of linear PT-symmetric systems has shown that their scattering property fulfills generalized unitary relationships, i.e., the gain side reflection $r_G$ and the loss side reflection $r_L$, satisfy $r_G \cdot r_L=1$ across the spectrum. A TL was connected at the gain or loss side shown in FIG. 9C as a conceptual illustration of the scattering experiment setup and the system biased in the exact phase. Then, a sinusoidal signal with varied frequency was applied into the system. Note that the signal power was chosen to set the system in the linear region. The incident wave $V_G$ ($V_L$) and the reflected wave $V_G$–($V_L$–) were extracted from the voltages at either side of the TL, from which the scattering coefficients $r_G=V_G^-/V_G$ and $r_L=V_L^-/V_L$ were calculated. The measured scattering coefficients shown in FIG. 9D generally match well with the predictions based on the scattering theory. FIG. 9D shows the comparison of reflection coefficients $r_G$, $r_L$ between experimental (Exp)

measurements (empty circles) and PT-symmetry theory (solid curves) in the linear region of the exact phase.

Lastly, the nonreciprocal wave transport of the system operating in nonlinear region was investigated. Previous studies in PT-symmetric optics have demonstrated that inherent nonlinearities can break Lorentz reciprocity and lead to nonreciprocal transmission. The nonreciprocal transmission of the system was measured with a fixed input power (black dashed line in FIG. 9B) at different coupling factors $\gamma/\gamma_{EP}$. In these experiments, the same experimental setup was adopted as shown in FIG. 9A. The signal was introduced into gain or loss side and captured at the loss or gain side. By measuring the incident wave $V_G$ or $V_L$ at the gain or loss side and the transmitted wave $V_L^-(V_G^-)$ at the corresponding loss or gain side, both the forward transmission $t_F=V_L^-/V_G$ and the backward transmission $t_B=V_G^-/V_L$ were obtained.

Figure 10B:
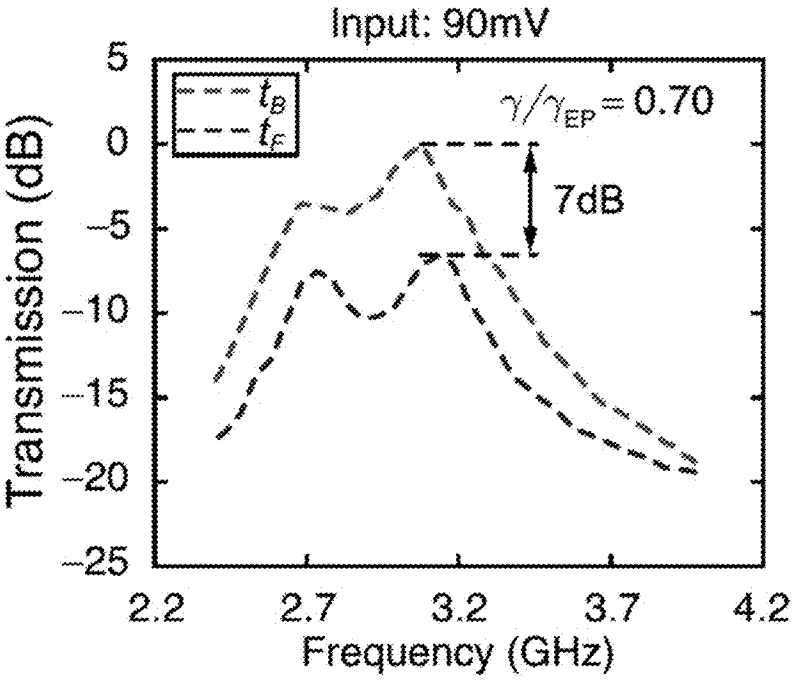
FIG. 10B is a graph showing nonreciprocal transmission in the exact phase with increased input power for a fully integrated PT-symmetric electronic system.
Figure 10A:
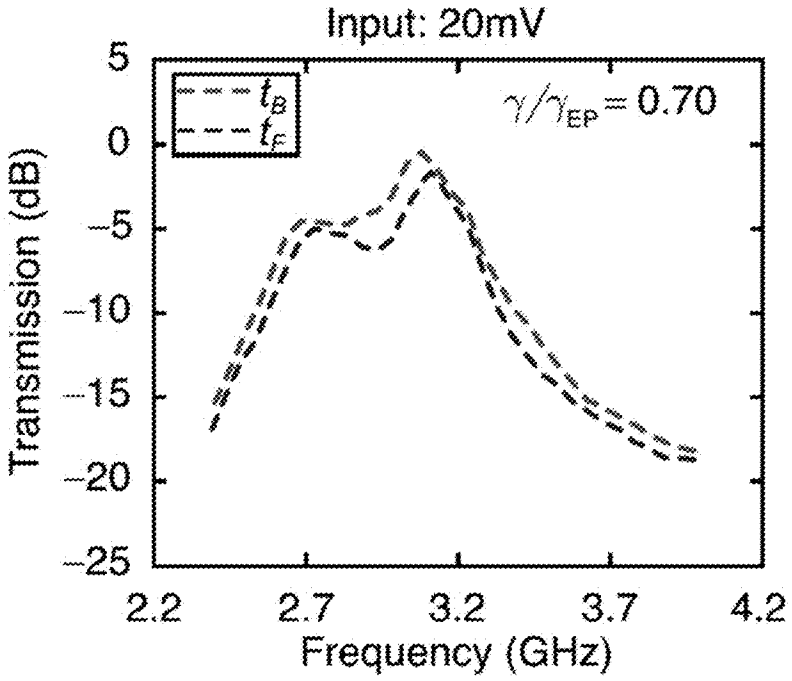
FIG. 10A is a graph showing reciprocal transmission in the exact phase with a small input power for a fully integrated PT-symmetric electronic system.
Figure 10D:
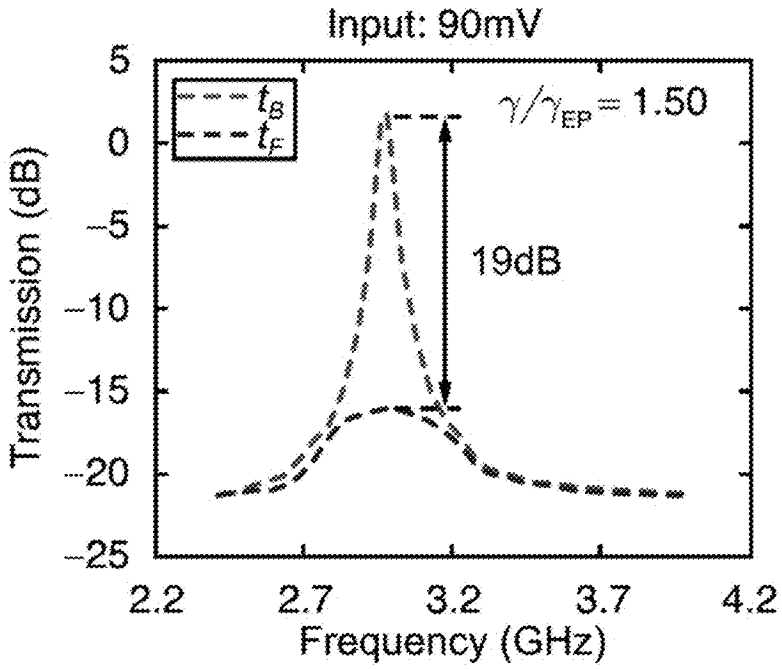
FIG. 10D is a graph showing enhanced nonreciprocal transmission in the broken phase with increased input power for a fully integrated PT-symmetric electronic system.
Figure 10C:
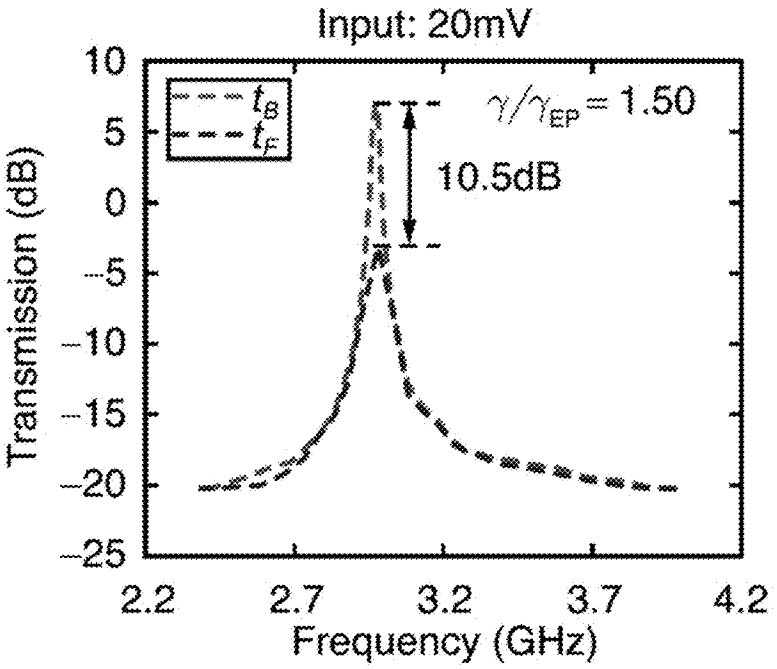
FIG. 10C is a graph showing nonreciprocal transmission in the broken phase with a single peak at a small input power for a fully integrated PT-symmetric electronic system.

In the exact phase shown in FIG. 10A and FIG. 10B, the transmission spectra in both directions shows double resonances. However, reciprocal transmission is observed with a 20 mV input voltage while nonreciprocal transmission is observed with a 90 mV input voltage: the forward transmission is up to −7 dB, and the backward transmission is 0.1 dB. In the broken phase shown in FIG. 10C and FIG. 10D, the transmission spectra in both directions show single resonances. In addition, nonreciprocal transmissions are observed under both input cases with different input voltages, and the case with the large input voltage shows more significant nonreciprocal transmission. In addition, comparison of the different phases under the same 90 mV input voltage shown in FIG. 10B and FIG. 10D shows that the nonlinearity is greatly enhanced in the broken phase owing to the field localization in the resonator with gain, and therefore the nonreciprocity is also enhanced: $t_F$ reduces to −16.5 dB, and the $t_B$ slightly increases to 2.5 dB. By sweeping the coupling factor $\gamma/\gamma_{EP}$ at a fixed 90 mV input voltage, this nonreciprocal behavior was observed to cover a broad bandwidth (2.7~3.2 GHz) at the resonance with the minimum isolation ($I_{ISO}=t_B-t_F$) over 7 dB.

Conventionally, nonreciprocal devices in the radio-frequency (RF) and microwave domains have been implemented using ferromagnetic materials, which tend to be bulky, heavy, costly, and poorly suited for integration with the IC fabrication process, due to the incompatibility of those materials with semiconductor materials. Although fundamentally relying on nonlinearity-induced nonreciprocity, PT-symmetry enhances the intrinsic system nonlinearity by creating field localization in the gain medium. These observations of nonreciprocal transport promisingly show the potential of nonlinear PT-symmetric electronics in designing fully-integrated, CMOS-compatible, broadband nonreciprocal electronic devices in the microwave domain, which can find abundant applications such as sensing and radar systems, where strict linearity is not required. The experimental results also demonstrate that the fully integrated PT-symmetric electronic system requires lower power intensity to generate nonreciprocity and has interesting features, such as insertion gain, compared with the nonreciprocal transmission of previously nonlinear systems.

The fully-integrated PT-symmetric electronic system was implemented in a differential topology as shown in FIG. 3. The gain −RG is the parallel resistance of $-R_{G0}$, $-R_{G1}$ and $R_{G2}$. $-R_{G0}$ is generated by the XDP. $R_{G1}$ is realized by two NMOS transistors whose gates are connected by tuning bias $V_{BIASGL}$. The loss $R_{LO}$ is realized in the same way as $R_{G1}$. By fixing the bias voltage $V_{BIASG}$ Of $-R_{G0}$ and controlling the bias voltage $V_{BIASGL}$ ($V_{BIASL}$) of gain or loss side, $-R_G$ ($R_L$) can be continuously adjusted. The capacitor $C_G$ ($C_L$) in each resonator is composed of high-quality factor (high-Q) MIM capacitor $C_{G1}$ ($C_{L1}$) and a varactor $C_{G2}$ ($C_{L2}$). The varactor only takes up a small proportion of the total capacitance and is used to compensate for the minor mismatch between the fixed MIM capacitor on both sides. The coupling capacitance Cc is designed by two equal MIM capacitors $C_{C1}$ and $C_{C2}$ which are serially connected with each other through an on-chip switch (SW). The inductance $L_G$ ($L_L$) in the both resonators comes from high-Q symmetrical parallel inductor (symindp) with low resistance and low parasitic capacitance, which is ideally suited for use in differential circuits. In the practical implementation, the equivalent of a transmission line (TL) with characteristic impedance $Z_0$ was attached to both sides of the system through an on-chip SW in the form of an on-chip resistor $R_0=Z_0$. By controlling the SW, the system could be flexibly configured to test one-port scattering or nonreciprocal transmission.

In differential architecture, each signal is transmitted by a pair of differential wires where the signal is represented by the amplitude difference between the differential wires. For example, in the design, each voltage $V_G$ ($V_L$) at the terminal of resonator is represented by a pair of differential signals ($V_{GP}$ and $V_{GN}$ for $V_G$, $V_{LP}$ and $V_{LN}$ for $V_L$). The differential architecture is symmetric with its virtual ground and can be divided into two equal parts. Either of them is the equivalent single-ended representation of the differential one and can be used to derive the PT-symmetry concept. Note that in single-ended architecture, the gain $-R_G$, loss $R_L$, and inductor $L_G$ ($L_L$) will be half, and the capacitor $C_G$ ($C_L$) will be double. The PT-symmetry condition is satisfied by setting $R_G\approx R_L=R$, $L_G\approx L_L=L$, $C_L\approx C_L=C$. In the system $R\in[90,380]$ Ω, L=1.85 nH, $C\in[1300,1500]$ f F, $C_c$=500 f, $Z_0$=280Ω. Therefore, the natural frequency is $\omega_0=1/2\pi\sqrt{LC}$=3.2 Ghz.

Applying Kirchhoff's law on the equivalent circuit representation shown in FIG. 2A yields the following expression $$V_G=i\omega' L/2\cdot I_1, I_1-V_G/(R/2)+i\omega' 2C\cdot V_G+i\omega' C_C\cdot(V_G-V_L)=0, \quad \text{EQ. 1}$$

$$V_L=i\omega' L/2\cdot I_2, I_2+V_L/(R/2)+i\omega' 2C\cdot V_L+i\omega' C_C\cdot(V_L-V_G)=0. \quad \text{EQ. 2}$$

Here ω' is the angular frequency. Eliminating the current from the relations, scaling the frequency and time by $\omega_0=1/\sqrt{LC'}$ and taking $c=C_c/2C$, $\gamma=\sqrt{L/C}/R$ gives the following matrix equation:

$$\begin{bmatrix} 1/\omega - j\gamma - \omega(1+c) & \omega c \\ \omega c & 1/\omega + j\gamma - \omega(1+c) \end{bmatrix} \cdot \begin{bmatrix} V_G \\ V_L \end{bmatrix} = \begin{bmatrix} 0 \\ 0 \end{bmatrix} \quad \text{EQ. 3}$$

Here ω is the normalized frequency. This linear homogeneous has four normal mode frequencies, as required to fulfill any arbitrary initial condition for voltage and current, given by $$\omega_{1,2} = \pm\frac{\sqrt{\gamma_{EP}^2-\gamma^2}+\sqrt{\gamma_{UP}^2-\gamma^2}}{2\sqrt{1+2c}}, \quad \text{EQ. 4}$$

$$\omega_{3,4} = \pm\frac{\sqrt{\gamma_{EP}^2-\gamma^2}-\sqrt{\gamma_{UP}^2-\gamma^2}}{2\sqrt{1+2c}},$$

where PT-symmetric breaking point ($\gamma_{EP}$) and the upper critical point ($\gamma_{UP}$) are identified as $\gamma_{EP}=|1-\sqrt{1+2c}|$, $\gamma_{UP}=1+$ $\sqrt{1+2c}$. The corresponding phase difference between the two resonators can be expressed as $$\phi_{1,3} = \frac{\pi}{2} - \tan^{-1}\left[\frac{1}{\gamma}\cdot\left(\frac{1}{\omega_{1,3}} - (1+c)\cdot\omega_{1,3}\right)\right] \quad \text{EQ. 5}$$

All the CMOS devices were prepared in Cadence Virtuoso (an industry-standard design tool for frontend design). All designs satisfy the standard CMOS manufacturing rules of IBM's commercial 130 nm CMOS8RF process, with physical verification performed using Mentor Graphics Calibre. The design was submitted to Metal Oxide Semiconductor Implementation Service (MOSIS) for fabrication.

The chip was bonded on a 4-layer FR4 PCB daughterboard by gold wires, forming all 38 electrical connections including power and ground, from the chip to the PCB. The bonding wires were properly designed for use at frequencies above 50 GHz. The experimental setup comprised a bonded chip in a daughterboard, a motherboard, a power supply, a mixed signal oscilloscope (MSO, Agilent 9404A), an arbitrary wave generator (AWG, KEYSIGHT M9502A) and a PC. The daughter board provided control biases to the chip. These biases had two main functions: 1) compensating for the mismatch of RLC components to minimize the unbalance between two resonators; 2) tuning the gain or loss such that the system can evolve from exact phase to broken phase. The mother board acted as a power board to supply all kinds of power voltages to the daughter board. Power supply was the main power source and used to power the motherboard. The MSO has four pairs of differential channels, and its highest sampling rate is 20 GSa/s. The AWG has four pairs of differential channels, each pair of which can generate arbitrary waves up to 50 GHz with independently varying phase.

In the phase transition experiments, the outputs of two resonators were connected to the MSO, where both the eigenfrequencies and phase differences could be directly observed on the panel. In the scattering experiments, the AWG sourced sinusoidal signals with varying frequencies or phase into the chip through TL. Then signals on both terminals of the TL were sent into the MSO such that the incident wave and reflected wave could be captured. In the nonreciprocal experiments, the AWG fed sinusoidal signals with varying frequencies into the system through the gain or loss side TL. Then both the incident wave on the input terminal of the gain or loss side TL and the reflected wave on the output terminal of loss or gain side TL could be captured by MSO. During the scattering experiments and nonreciprocal transport experiments, the AWG were controlled by software on a PC to generate frequency-varying signals.

By tailoring the gain-loss contrast, the system clearly exhibits the phase transition of PT-symmetry with an oscillation tuning range of 0.47 GHz, and a broadband nonreciprocal microwave transport from 2.7 GHz to 3.2 GHz, extending critical IC performances beyond the normal ranges achievable using conventional design methodology. Introduction of PT-symmetry to IC design allows for strategic manipulation of gain and loss to dramatically alter the eigenspectra response of IC systems, leading to enhanced reactive property of on-chip devices that complements the constraints from chip-level integration. The synergistic exploitation of PT-symmetry in IC design can enable many direct applications such as oscillators for wireless communication and broadband non-reciprocal devices for remote sensing and radar systems.

In summary, PT-symmetry as a new principle into modern IC design methodology has been introduced. This synergistic exploitation of PT-symmetry in standard IC systems can manifest itself through enhanced tuning range of passive reactive on-chip components, as well as heightened nonlinear nonreciprocity through localized energy field, enabling many practical applications, such as high-speed oscillators for wireless communication, and nonreciprocal device for radar systems with superior performance beyond what is achievable with conventional IC design methodology. Moreover, combining the system flexibility, and the scalability of IC technology, one can extend the core system beyond two coupled RLC resonators into higher-dimensional topological structures, benefiting topological electronics in the microwave and mm-wave domains. Implementations of these higher-dimensional topological structures are magnetic-free, active transmission nonreciprocity based on nonlinear PT-symmetric integrated electronics, specifically a fully on-chip microwave isolator (>3 GHz) that integrates all the components on 130 nm CMOS technology. This PT-symmetric integrated electronic system demonstrates a full-integrated PT module with asymmetric transport at GHz as well as highly integrated 1D and 2D PT lattice with enhanced non-reciprocity. By developing the theoretical methodology and experimental hardware platform for large-scale reconfigurable PT array non-reciprocal microwave devices with unprecedented performance may be created.

Figure 11A:
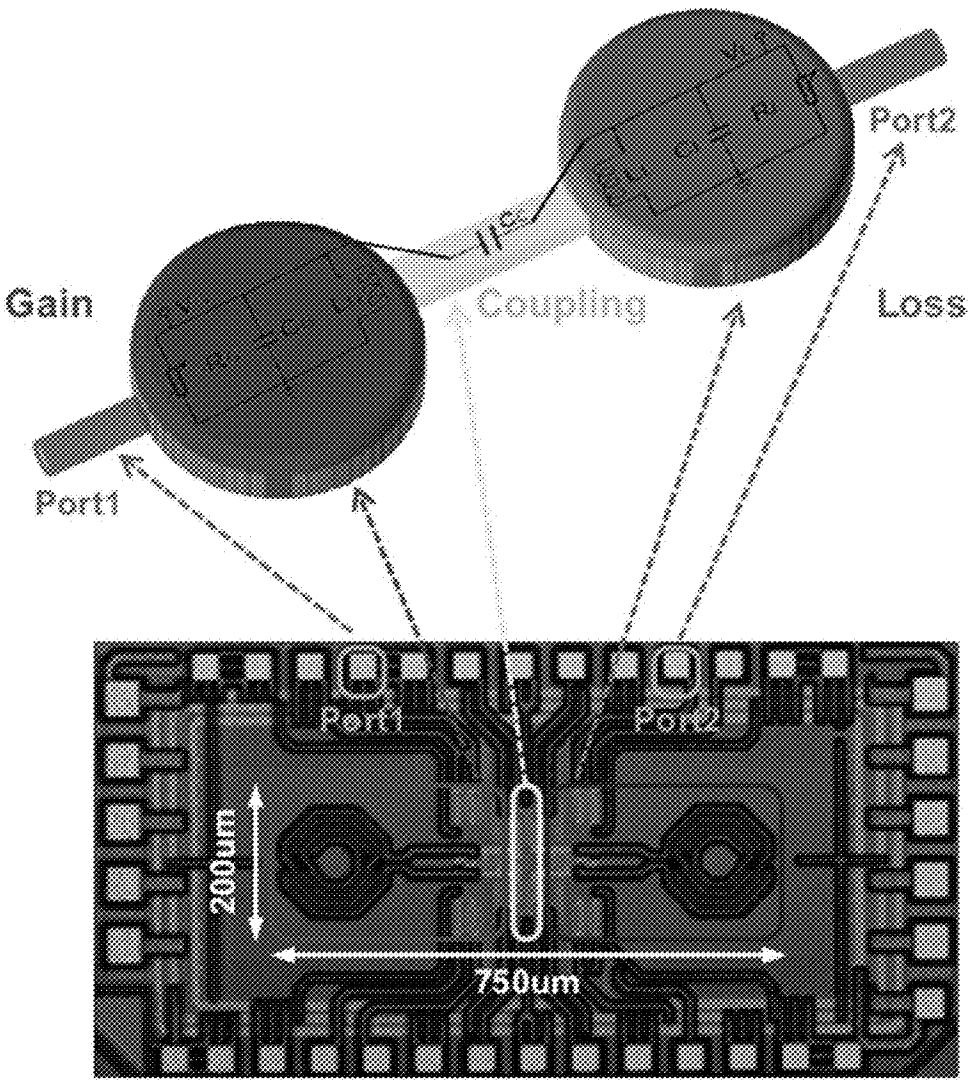
FIG. 11A is circuit schematic of a PT-symmetric integrated electronic dimer in equivalent single side architecture and a chip die photo of a PT-symmetric fully integrated electronic system.
Figure 11C:
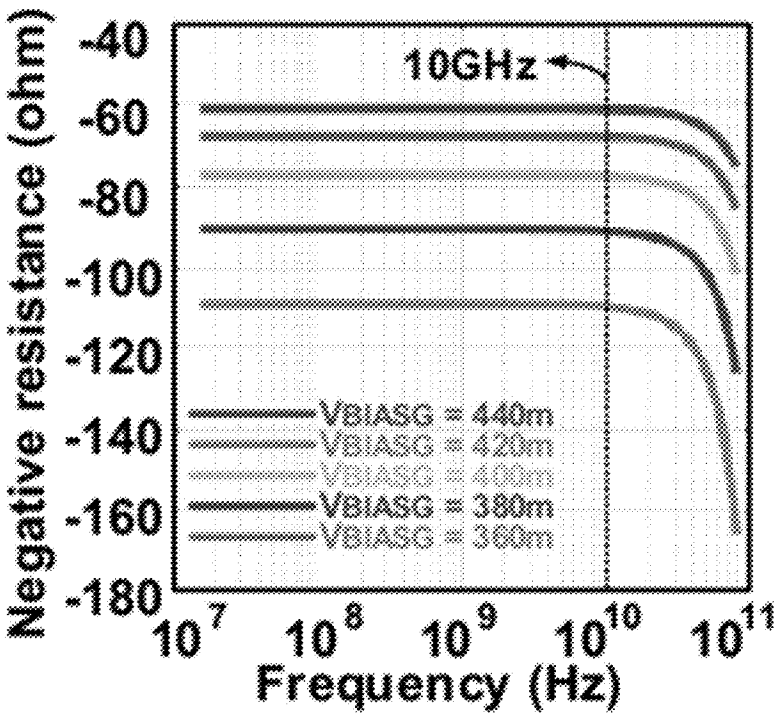
FIG. 11C is a graph showing the characterization of negative resistance in frequency domain under different bias for a PT-symmetric fully integrated electronic system.
Figure 11B:
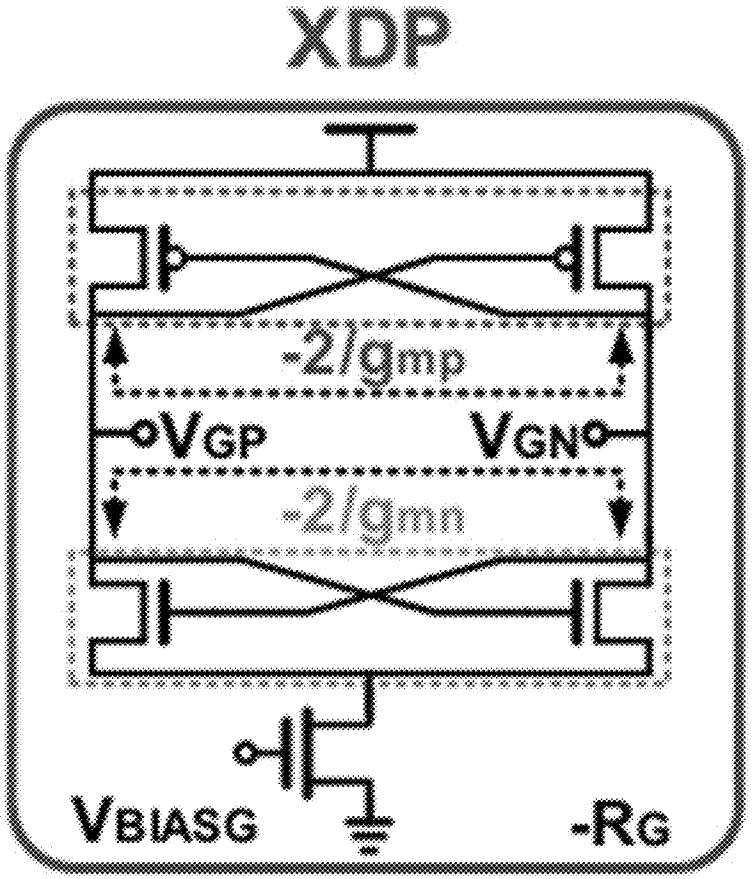
FIG. 11B is circuit schematic of XDP which acts as a negative resistance converter.

To minimize the volume and maximize the operation frequency of PT-symmetric electronics, a PT-symmetric integrated electronic system was designed using CMOS technology. The system consists of two RLC resonators which are connected only by capacitance coupling C, with equal gain ($-R_G$) and loss ($R_L$). The equivalent single side of circuit schematic is shown in FIG. 11A and differential system was implemented on chip. The active part ($-R_G$) is realized by an XDP also shown in FIG. 11A, plays as a negative resistance convertor (NRC). The gain ($-1/R_G=-2/g_{m,p}-2/g_{m,n}$) is the sum reciprocal of small signal trans-conductance of PMOS pair ($-2/g_{m,p}$) and NMOS pair ($-2/g_{m,n}$). The schematic of the XDP is shown in FIG. 11B. The XDP has special advantage in generating negative resistance: 1) 75% power consumption saved compared with Colpitts-based NRC; 2) a constant trans-conductance in a wide frequency range (~10 GHz) compared with Op-Amp shown in FIG. 11C. All these enable a power efficient but microwave domain PT-symmetric electronic system. The gain can be adjusted flexibly by tuning the current source at the bottom of XDP. The loss of passive side is realized by a MOSFET with drain and source terminals connected to the both sides of resonator. By adjusting the bias voltage of gate terminal, the loss can also be flexibly changed. The capacitor on both sides consists of a fixed Metal-Insulator-Metal (MIM) capacitor and an adjustable varactor. The varactor only takes up a small proportion of total capacitor and it is used to compensate for the mismatch between the fixed MIM capacitor on both sides. By tuning the bias of gain, loss and varactors, the system can achieve the balanced state. To be totally different with previous PT-symmetric electronic systems, the system was implemented on 130 nm CMOS technology, enabling a fully integrated PT-symmetric electronic system. The core area of PT-symmetric integrated electronic system is only 200 um×750 um.

The basic property of a linear PT-symmetric system is that it can exhibit two phases, depending on the magnitude of the gain/loss relative to the coupling strength. If the parameter controlling the coupling strength is lower than a threshold, the PT-symmetry system remains in the unbroken/exact phase, where all the eigenfrequencies keep real and the energy is equally distributed between the gain and loss regions. Otherwise, if the parameter exceeds this critical value, the system stays in broken phase, where all the eigenfrequencies become complex with one growing exponentially and the other one decaying exponentially. To theoretically analyze the behavior of system, the small signal model is used—a general model in analyzing analog circuit, to simplify the PT-symmetric integrated electronic system such it can be considered as linear system. The basic concept of the linear PT-symmetry underlying the circuits can be obtained by applying the Kirchhoff s law on the equivalent circuit representation in FIG. 11A:

$$V_G=i\omega' L\cdot I_1, I_1-V_G/R+i\omega' C\cdot V_G+i\omega' C_c\cdot(V_G-V_L)=0, \quad \text{EQ. 6}$$

$$V_L=i\omega' L\cdot I_2, I_2+V_L/R+i\omega' C\cdot V_L+i\omega' C_c\cdot(V_L-V_G)=0. \quad \text{EQ. 7}$$

Eliminating the current from the relations, scaling frequency and time by $\omega_0=\sqrt{L/C}$, and taking $c=C_c/C$, $\gamma=\sqrt{L/C}/R$ gives the matrix equation:

$$\begin{bmatrix} 1/\omega - j\gamma - \omega(1+c) & \omega c \\ \omega c & 1/\omega - j\gamma - \omega(1+c) \end{bmatrix} \cdot \begin{bmatrix} V_G \\ V_L \end{bmatrix} = \begin{bmatrix} 0 \\ 0 \end{bmatrix}. \quad \text{EQ. 8}$$

This linear homogenous system has four normal mode frequencies, as required to full any arbitrary initial condition for voltage and current, given by $$\omega_{1,2} = \pm\frac{\sqrt{\gamma_1^2-\gamma^2}+\sqrt{\gamma_2^2-\gamma^2}}{2\sqrt{1+2c}}, \quad \omega_{3,4} = \pm\frac{\sqrt{\gamma_1^2-\gamma^2}-\sqrt{\gamma_2^2-\gamma^2}}{2\sqrt{1+2c}}, \quad \text{EQ. 9}$$

where, the PT-symmetric breaking point identified and the upper critical point by as $$\gamma_1=|1-\sqrt{1+2c}|, \gamma_2=1+\sqrt{1+2c}. \quad \text{EQ. 10}$$

Based on EQ. 9 and EQ. 10, if all the design parameters are fixed except for R, continuously tuning of the normalized oscillation frequency may be achieved. Particularly, when $0<\gamma<\gamma 1$, the system is characterized by four purely real eigenfrequencies coming in two pairs of positive ($\omega_1$, $\omega_3$) and negative ($\omega_2$, $\omega^4$) values. When $\gamma 1<\gamma<\gamma 2$, the eigenfrequencies are coming in complex conjugate pairs with non-vanishing real parts, and above $\gamma_2$, as two purely imaginary complex conjugate pairs. the phase difference of two coupled resonators under different eigenfrequencies was examined. During the exact phase, the phase difference between two resonators can be expressed as $$\phi_{1,3} = \frac{\pi}{2} - \tan^{-1}\left[\frac{1}{\gamma}\cdot\left(\frac{1}{\omega_{1,3}} - (1+c)\cdot\omega_{1,3}\right)\right]. \quad \text{EQ. 11}$$

Figure 12B:
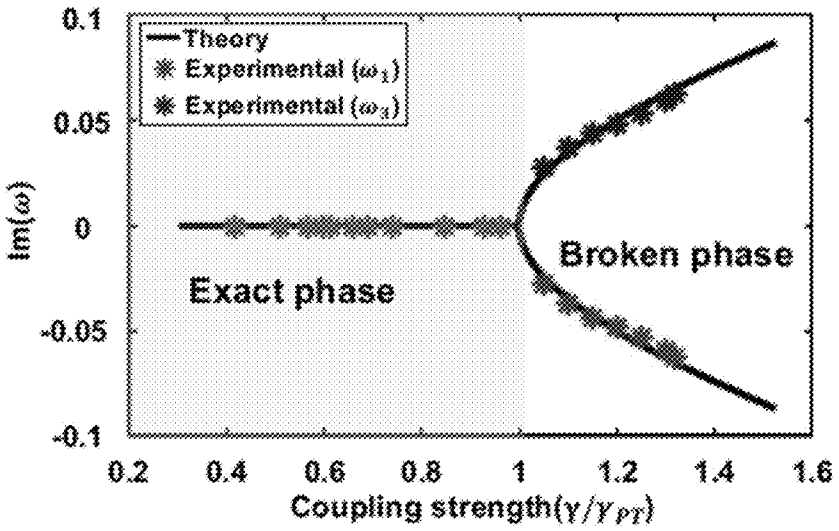
FIG. 12B is a graph showing parametric evolution of the simulated imaginary part of eigenfrequencies, vs. the normalized gain/loss parameter (coupling strength) for frequency splitting and phase transition of a PT-symmetric integrated electronic system.
Figure 12A:
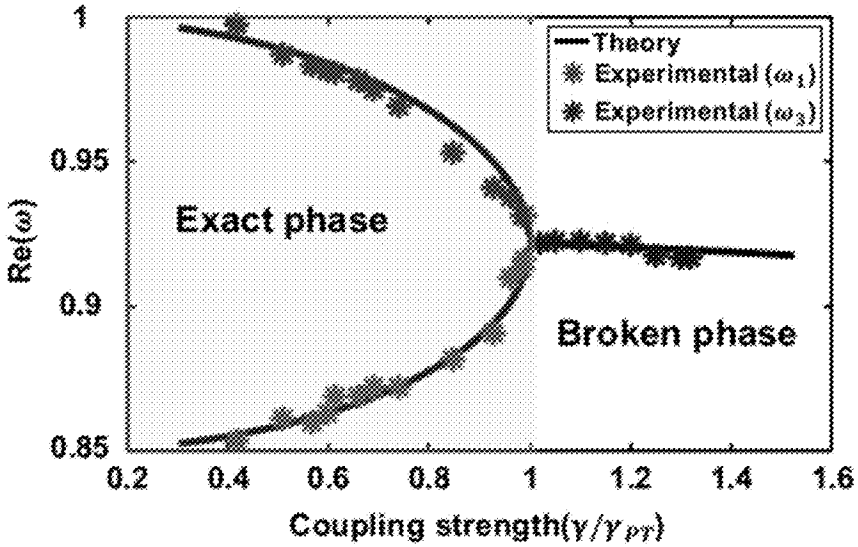
FIG. 12A is a graph showing parametric evolution of the experimentally measured real part of eigenfrequencies vs. the normalized gain/loss parameter (coupling strength) for frequency splitting and phase transition of a PT-symmetric integrated electronic system.
Figure 12C:
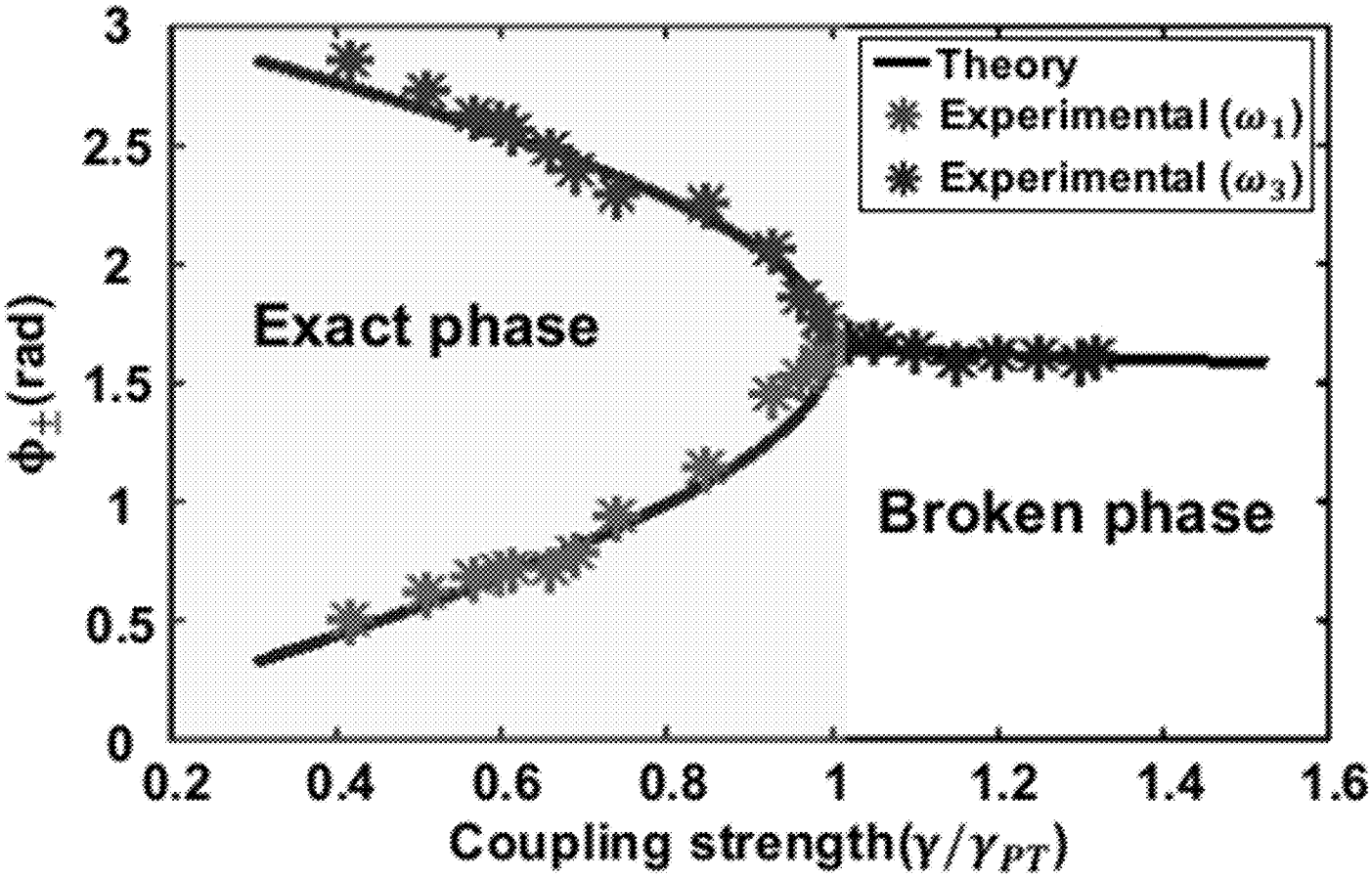
FIG. 12C is a graph showing parametric evolution of the phase difference for frequency splitting and phase transition of a PT-symmetric integrated electronic system.

When the system is in broken phase, the eigenfrequencies begin to coalesce, leading to a single phase difference. The measurements were reported for the system frequencies splitting shown in FIG. 12A and FIG. 12B and inter-component phases, transition compared with the theoretical expressions and simulations shown in FIG. 12C. In the experiments, the coupling parameter c=0.25, conductance value L=6.8 nH and natural frequency $\omega_0$=3.23 GHz. The tuning of parameter $\gamma$ is achieved by adjusting the gain and loss of two coupled resonators. It was observed that the voltage magnitudes of two resonators are equal to each other in the exact phase. These experimental results are matched with the theory prediction in EQ. 9 and EQ. 11. When the system is in broken phase, the imaginary part of eigenfrequency makes the oscillation exponentially grow or decay. However, due to the nonlinearity of circuits, the amplitude of gain side will not keep growing and end up at a saturation level. This is the main difference to distinguish which phase the system is in. Another phenomena is that, with the increasing of $\gamma$, the saturation amplitude of gain side will rise while the saturation amplitude of loss side will drop.

Figure 13A:
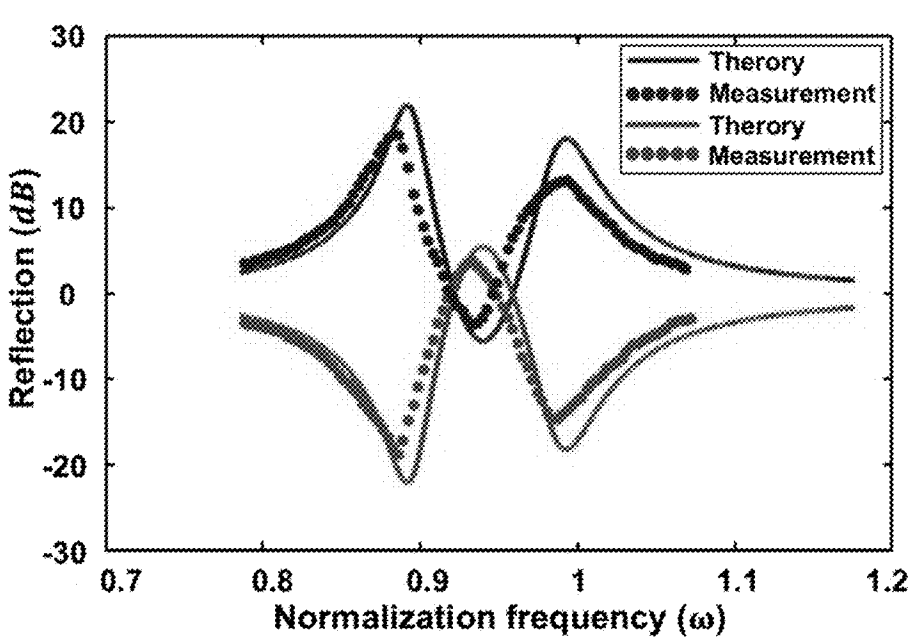
FIG. 13A is a visualization and graph of a single port scattering experiment with a simple PT-symmetric integrated electronic dimer in a first configuration.
Figure 13A:
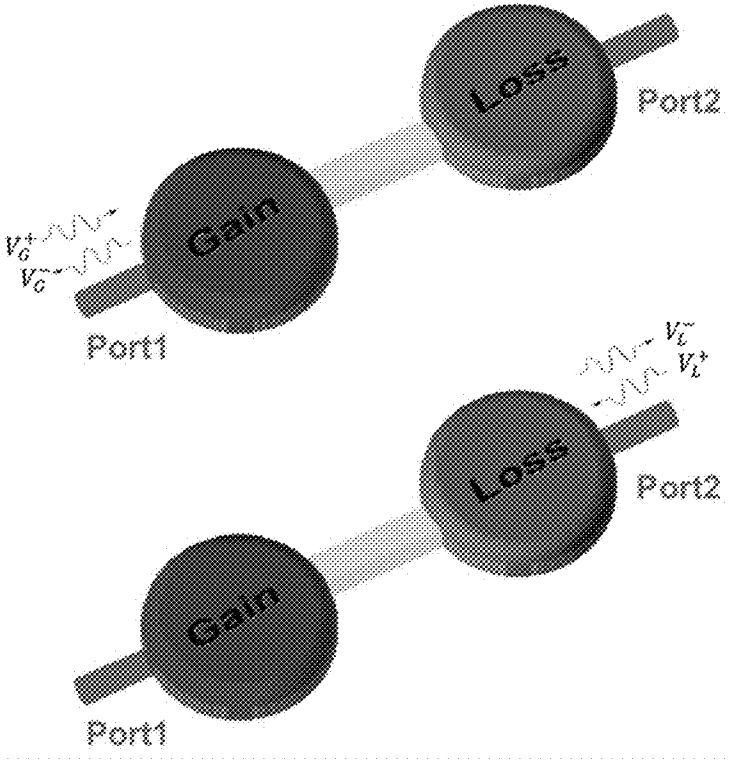
Figure 13B:
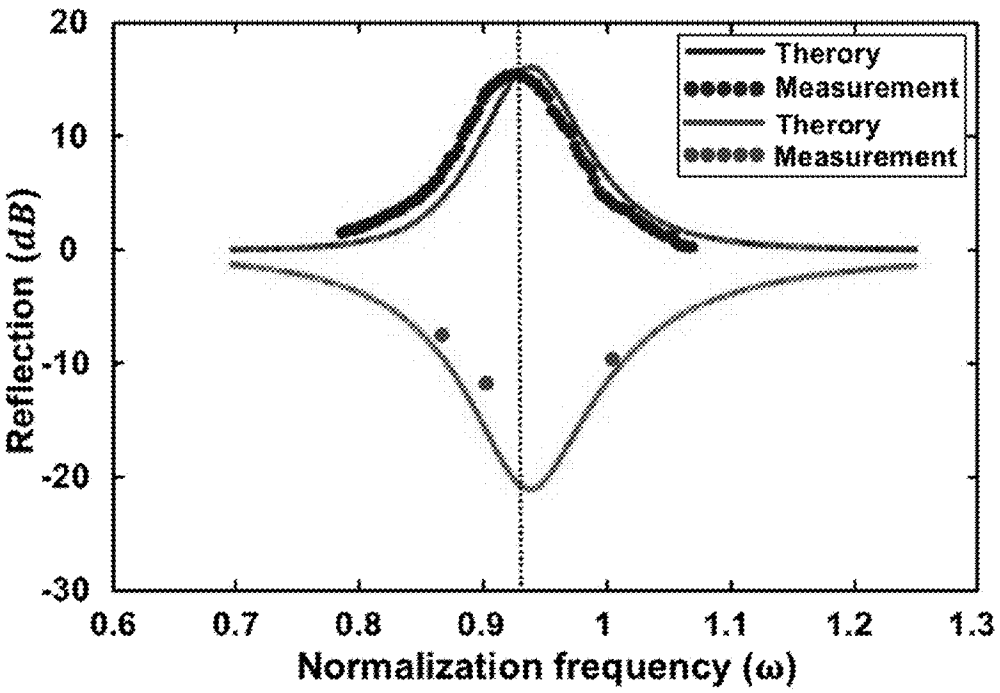
FIG. 13B is a visualization and graph of a single port scattering experiment with a simple PT-symmetric integrated electronic dimer in a second configuration.
Figure 13B:
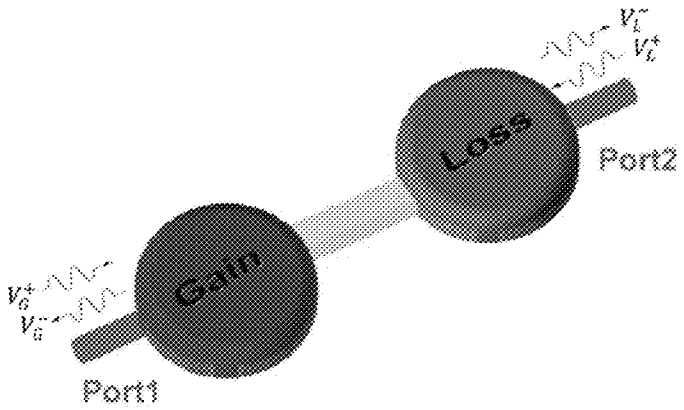

PT-symmetric systems also possess other properties in linear region. The theory of classic linear PT-symmetric electronic system shows that: 1) under single port scattering case, the scattering signals satisfy generalized unitary relations; 2) under two port scattering case, the two-port PT-symmetric electronic system can act as a simultaneous coherent perfect amplifier or absorber (CPA). Although these phenomenon have been experimentally observed before in sub-RF frequency (30 KHz, 3 MHz), they were observed again in microwave domain shown in FIG. 13A and FIG. 13B.

To keep the system in linear region, in these scattering experiments, small amplitude signals with varying frequency are sourced into the system. Experimentally, the equivalent of a transmission line (TL) with characteristic impedance $Z_0$ could be attached to either side of the system at the RLC circuit voltage node in the form of a resistance $R_0=Z_0$.

Nonlinearities are unavoidable when components are integrated on CMOS and the system works at high frequency. The XDP in the PT-symmetric integrated electronic system is naturally a nonlinear gain generator. Mathematical derivation shows that the negative conductance generated by XDP is both frequency-dependent and amplitude dependent. Experimentally, it is observed that a strong nonlinear exhibits in both exact phase and broken phase. T output voltage amplitude was first monitored at gain side as the power of the input probe at loss side was varied when the system was in the exact or broken phases. A clear nonlinear response was observed in both the exact phase and the broken phases shown in FIG. 14, with a more obvious nonlinear response in broken phase when input power is small. It shows that nonlinearity was enhanced in broken phase, due to the stronger field localization into the resonator with gain. At low power levels, where the input-output relation was linear, the system was reciprocal in both the exact and broken phase shown in FIG. 14. Thus direct experimental clarification of the issue of reciprocity in PT-symmetric systems is shown; that is, PT-symmetry or PT-symmetry breaking alone is not sufficient for nonreciprocal light transmission.

Figure 14:
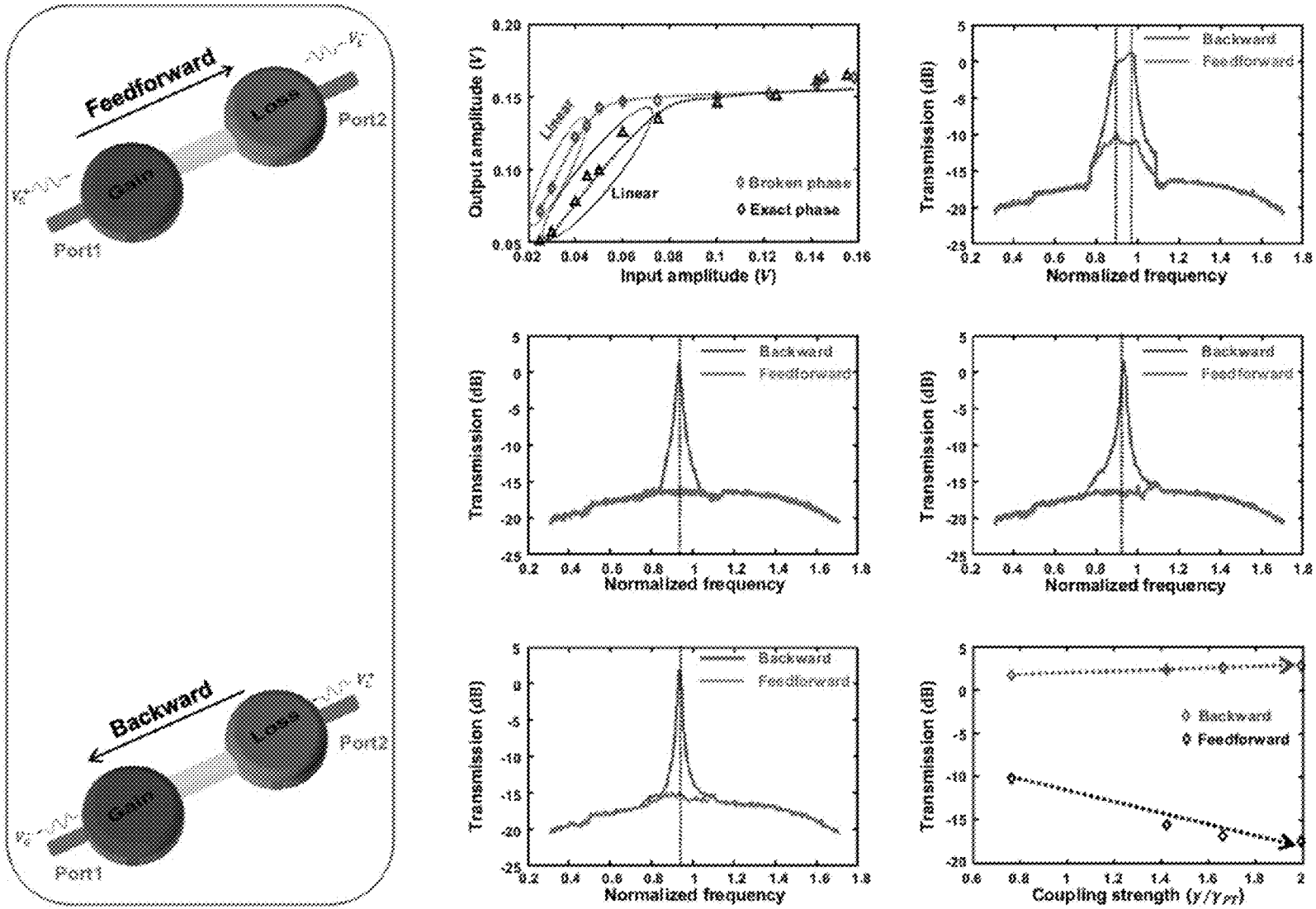
FIG. 14 is visualizations and graphs of experimentally observed nonreciprocal transmission for PT-symmetric integrated electronic dimmer where nonlinearities exist.

Due to the nonlinearity in the system, the PT-symmetry transition is associated with a transition from reciprocal to nonreciprocal behavior. When the gain and loss are balanced as much as possible, forward transmission reduces below −15 dB, but the backward transmission remains high as shown in FIG. 14. The transmission spectra show a double resonance peak at exact phase and a single resonance peak at broken phase, as expected. It also shows that as the system transits into the broken phase, the backward transmission goes higher and higher while the forward transmission goes lower and lower. These results indicate again nonlinearity enhancement (i.e., the threshold for nonlinearity is lower) in the broken-symmetry phase, due to the stronger field localization into the resonator with gain, as compared to the exact phase.

The microwave PT-symmetric integrated electronic system was scaled to more advanced technology. The systems can work in mm-wave domain on 40 nm CMOS technology. The simulation results are matched with those measured on 130 nm CMOS technology. Based on this, a circulator was designed using three coupled RLC resonators with local PT-symmetry. The simulation results show that circulator performs very well in mm-wave domain, making it a potential alternate for magnetic-optic circulator for future 5G communication.

Another embodiment, described below, is described with respect to FIGS. 15-43. Harnessing parity-time (PT) symmetry with balanced gain and loss profiles has created a variety of new opportunities in electronics from wireless energy transfer to telemetry sensing and topological defect engineering. However, existing implementations often employ ad-hoc approaches at low operating frequencies and are unable to accommodate large-scale integration, challenging to unleash the full potential of PT-symmetric electronics. Described below is a fully integrated realization of PT symmetry in a standard complementary metal-oxide semiconductor IC technology. The IC not only demonstrates salient PT symmetry features such as phase transition, but also achieves new capabilities in manipulating broadband microwave generation and propagation beyond the limitations encountered by exiting schemes. With the unique gain-loss tuning means, the IC shows 2.1 times bandwidth and 30 percentage noise reduction compared to conventional microwave generation in oscillatory mode, and displays as large as 21 dB non-reciprocal microwave transport from 2.75 to 3.10 gigahertz in non-oscillatory mode as a result of significantly enhanced nonlinearities.

Symmetry is one of the most essential notions to influence the fundamental properties of physical systems. Quantum systems whose Hamiltonians commute with a joint parity-time (PT) operator (PT) operator, possess a ($PT\hat{H}=\hat{H}PT$) special kind of symmetry, known as PT symmetry. In general, open quantum systems interacting with environments can be described by non-Hermitian Hamiltonians which preserve complex eigenvalues. However, a system with PT symmetry possesses purely real eigenspectra in certain regimes whereas the eigenstates are non-orthogonal to each other. Over the past years, PT-symmetric systems featured with balanced gain and loss profiles have been studied in optics, optomechanics, optoelectronics, and acoustics, and initiated a number of exotic effects and applications including electromagnetically induced transparency coherent perfect absorption-lasing, topological light steering, single-mode lasing, ultrasensitive sensors, optoelectronic microwave generation, and non-reciprocal photon and phonon transmission.

Electronics has recently emerged as a promising field to study PT symmetry due to the flexibility and reliability of controlling active and passive electronic resonators. Experiments have been reported on printed circuit boards and in microelectromechanical systems, showing robust wireless energy transfer, enhanced telemetry sensing, and topological effects. However, these electronic platforms are confined to low-frequency operation below a few hundred megahertz and are difficult to scale to small physical dimensions and complex integrated structures. To explore and unleash the full potential of PT symmetry in electronics, one must look beyond existing ad-hoc implementation approaches. Integrated circuit (IC) technology—the leading nanotechnology for electronics, provides a standard manufacturing process for flexible and customized designs that consist of millions of nanoscale integrated devices. Its scalability in physical dimension enables ICs to be a powerful platform that covers a wide applied spectra from DC to terahertz. It also supports integration of complex three-dimensional structures 32, allowing one to extend a core electronic non-Hermitian unit into higher-dimensional structures to study topological electronics. Despite such intriguing properties, IC technology is yet to be employed to realize PT symmetry, though gain, loss, and their coupling effects do commonly exist there.

On the other hand, as has been shown in the field of optics and acoustics, PT symmetry can provide enhanced ability in wave generation and propagation, making it especially attractive for IC technology. Effective implementations of these functionalities in the microwave domain remain challenging in IC and the capability to exceed the conventional performance limits has long been sought after. In particular, electrical non-reciprocal microwave transmission is highly desirable for diverse on-chip applications, yet existing approach that uses bulky and costly ferromagnetic devices suffers from a number of drawbacks and is incompatible with semiconductor fabrication process. Advancing integrated magnetic-free non-reciprocal devices thus not only demands breakthrough of materials and fabrication technologies, but also relies on our ability to enrich the arsenal of IC design methodology. PT-symmetric systems can break Lorentz reciprocity to produce enhanced non-reciprocity in the presence of nonlinearity. Such a merit has been demonstrated in acoustic wave and light transmissions, but remains unexplored in electronics. Therefore, harnessing PT symmetry for broadband microwave generation and non-reciprocity with chip-scale implementation is particularly appealing and represents immense potential.

A fully integrated implementation of PT symmetry in a 130-nanometer (nm) complementary metal-oxide-semiconductor (CMOS) technology integrated circuit 100 is described herein, and used to create wideband high-quality microwave generation and broadband strong microwave isolation at gigahertz (GHz). A PT symmetry phase transition feature is disclosed on a scalable platform. With the distinctive gain-loss tuning freedom, this disclosure shows that in oscillatory mode, the IC exhibits a wideband microwave generation from 2.63 GHz to 3.20 GHz with an average −120 dBc/Hz noise intensity, achieving 2.1 times bandwidth with 70 percentage of phase noise compared to a baseline conventional oscillator. While in non-oscillatory mode, the intrinsic nonlinearity of the system is greatly enhanced by PT symmetry, leading to 7 to 21 dB non-reciprocal microwave transmission in a broad band of 2.75 to 3.10 GHz. Results show that the introduction of PT symmetry into IC technology could benefit a broad range of chip-based applications including waveform synthesis and generation, frequency modulation, and manipulation of microwave propagation. In various embodiments, a fully integrated PT-symmetric electronic system consists of two capacitively coupled 230 resistor-inductor-capacitor (RLC) resonators 110, 120, one with gain and the other one with equivalent loss (see FIG. 15B). A differential architecture (see FIG. 20) is implemented to obtain superior device matching, better robustness, and higher reliability against noise, interference, and failure. The equivalent single-ended circuit schematic, shown in FIG. 15A is used to simplify analysis. A cross-coupled differential pair (XDP) 290 is used as a negative resistance converter (NRC) in our system (FIG. 15B), which generates a stable and tunable gain beyond 10 GHz (FIG. 15C). XDP 290 includes two NMOS transistors 300, 310 having gates that are electrically connected together. It can also better conserve energy than operational-amplifier based NRCs and Colpitts-type based NRCs, while generating the same amount of gain. These characteristics are ideal for broadband and energy-efficient microwave PT-symmetric electronic systems. The active RLC resonator 110 includes a first terminal 130 and a second terminal 140. The loss RLC resonator 120 has a third terminal 180 and a fourth terminal 190.

Figure 21:
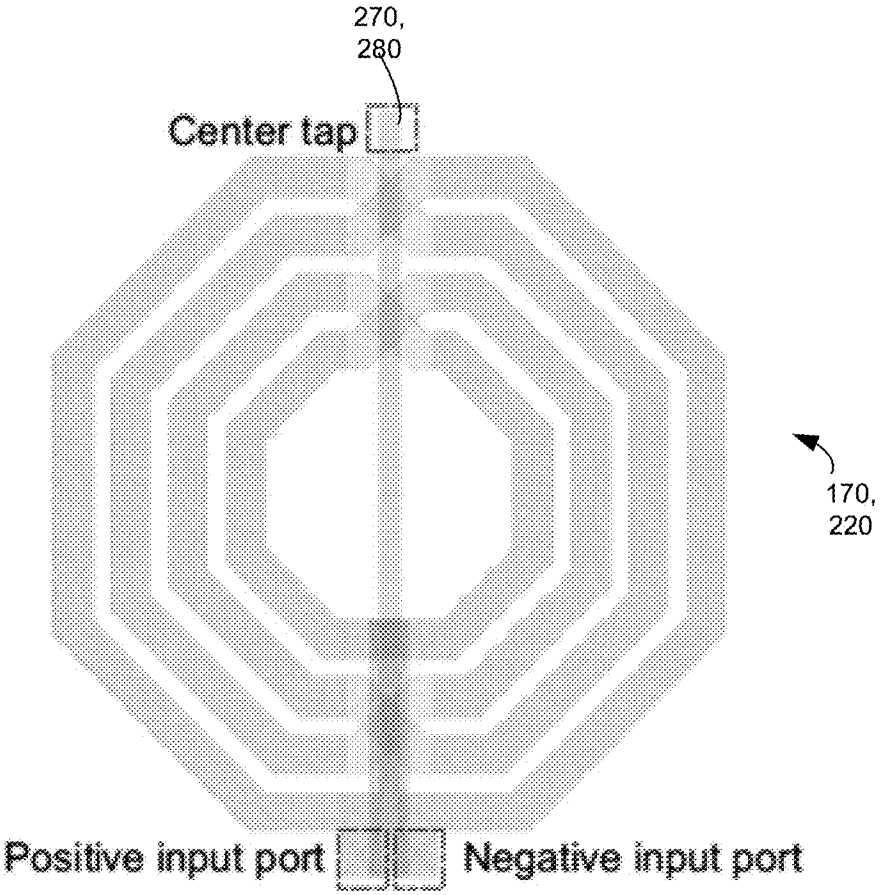
FIG. 21 is a symmetrical physical layout of a symindp.

The active RLC resonator 110 has a gain rate −RG0 150 generated by the XDP 290, a variable loss rate RG1 200, and an intrinsic loss rate RG2, yielding a total gain of −RG=−RG0||RG1||RG2. The total loss rate RL=RL0||RL1 in the passive RLC resonator 120 is contributed by a variable loss RL0 and an intrinsic loss RL1. The capacitance in each RLC resonator 110, 120 comes from a fixed metal-insulator-metal (MIM) capacitor 320, 340 and a varactor 330, 350. The coupling capacitor consists of two equal MIM capacitors in serial connection via an on-chip switch (SW 250, FIG. 15A, referred to as a coupling element in some embodiments). The inductance 170, 220 in each RLC resonator 110, 120 is provided by a symmetrical parallel inductor (FIG. 21). Both RLC resonators 110, 120 have the same natural frequency $\omega_0$=3.20 GHz. The system is integrated on one monolithic chip with a core area of 200×750 μm2 using a standard 130 nm CMOS technology (FIG. 15D). Note that alternative fully integrated PT-symmetric structures could also be implemented (described below). To show the functionalities and performances, a chip was bonded on a test board with golden wires (FIG. 15D). The board provides power supply, control voltages, and radio-frequency connectors for measurements. The gain and loss rate, and varactor capacitance can be flexibly adjusted by the control voltages. The PT symmetry condition is satisfied by setting RG≈RL=R, LG≈LL=L, and CG≈CL=C. The detailed circuit parameters are provided in the Method section below.

PT Symmetry Phase Transition.

We first numerically analyze the PT symmetry transition of our system based on the small signal model—a common methodology in analyzing analog circuits. The system is considered as a linear time-invariant system, which is valid for small signal inputs. By applying Kirchoff's law on the equivalent circuit (FIG. 15A), four eigenfrequencies are found (Methods), i.e., $$\omega_{1,2} = \pm\frac{\sqrt{\gamma_{EP}^2-\gamma^2}+\sqrt{\gamma_{UP}^2-\gamma^2}}{2\sqrt{1+2c}}\cdot\omega_0, \tag{1}$$

$$\omega_{3,4} = \pm\frac{\sqrt{\gamma_{EP}^2-\gamma^2}-\sqrt{\gamma_{UP}^2-\gamma^2}}{2\sqrt{1+2c}}\cdot\omega_0,$$

Here, $\gamma_{EP}=\sqrt{1-2c}-1$ denotes the exceptional point (EP) and $\gamma_{UP}=\sqrt{1+2c}+1$ is the upper critical point, c is defined as the capacitive coupling ratio between the coupling capacitance CC and the RLC resonator's capacitance C; and γ is the normalized tuning parameter of gain (loss), defined as $\sqrt{L/C}/B$. In the unbroken phase $$\left(0<\frac{\gamma}{\gamma_{EP}}<1\right),$$

the system is characterazed by four purely real eigenfrequencies, with two of them positive ($\omega_1$, $\omega_3$) and the other two negative ($\omega_2$, $\omega_4$). In the broken phase $$\left(\frac{\gamma}{\gamma_{EP}}>1,\ \frac{\gamma}{\gamma_{UP}}<1\right),$$

the eigenfrequencies are complex conjugate pairs with non-vanishing real parts. Above $$\frac{\gamma}{\gamma_{UP}}>1,$$

1, the eigenfrequencies become two complex conjugate pairs with purely imaginary parts.

Figure 16A:
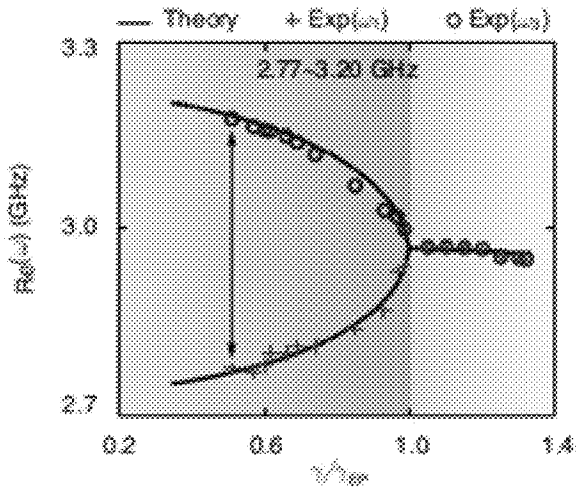
FIGS. 16A-16D are graphs depicting eigenfrequencies and phase transitions of a fully integrated PT-symmetric electronic system.

Experimentally, γ was engineered by adjusting the gain (loss) and maintaining other circuit parameters unchanged. The bifurcation of the eigenfrequencies regards to the coupling factor was clearly demonstrated (FIG. 16A).

Figure 16B:
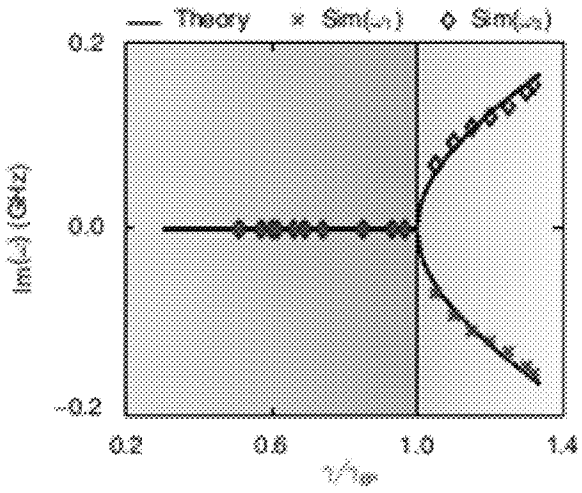

In the unbroken phase, the system has two purely real eigenfrequencies. It was observed that the two RLC resonators 110, 120 had the same magnitude of voltage. When γ increases, the system undergoes a phase transition at the EP, where the real eigenfrequencies branch out into the complex plane. In the broken phase, the system possesses two supermodes formed by the coupling of two RLC resonators 110, 120. Such supermodes have single resonant frequency but with amplification and dissipation respectively. The imaginary parts of the eigenfrequencies in the broken phase were obtained by Simulation Program with Integrated Circuits Emphasis (SPICE) simulation, since the oscilloscope used in our study could not capture the fast-changing dynamics of the exponentially oscillating amplitudes at the terminals (VG and VL) of the resonators 110, 120. In the simulation, we observed an exponential growth (ending up at a saturation level), corresponding to the supermode with gain; the decay rates of the other supermode are the mirror of those for amplification (FIG. 16B). These results are in good agreement with the theoretical predictions.

Wideband High-Quality Microwave Generation.

The resonant behavior in the PT symmetry phase transition of our system provides a new strategy to generate microwave signals. Conventional microwave generation uses gain to fully compensate the intrinsic loss of LC resonators to generate a stable wave. PT symmetry provides a new degree of freedom to modulate microwave generation: by manipulating gain-loss distribution in two coupled resonators, loss can play a role as important as that of gain. This unique gain-loss tuning freedom can enhance the bandwidth of microwave generation beyond conventional microwave generators (i.e., oscillators based on a single-resonator structure or a coupled-resonator structure) with only capacitive tuning or inductive tuning scheme. We theoretically compared the eigenfrequencies of all these systems (below). A PT-symmetric system inherently has a $\omega_0=1/\sqrt{LC}$, larger resonance tuning range given by Eq. (1), enabled by the eigenfrequencies' bifurcation of tuning the gain-loss contrast γ. In comparison, the eigenfrequency of a conventional oscillator only depends on independent of gain-loss strength.

Figure 16C:
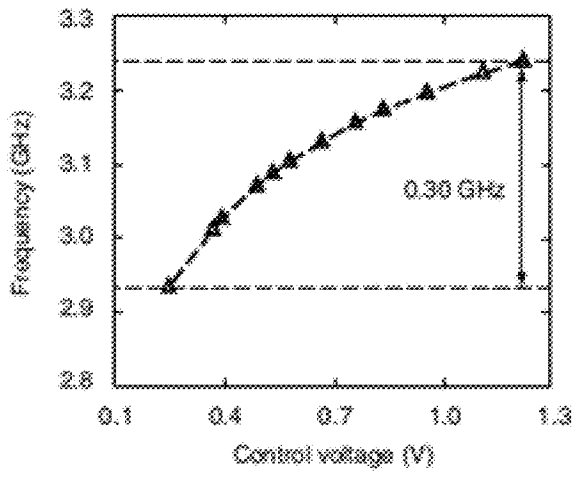

To experimentally show the advantages of a PT-symmetric system for microwave generation, we then decoupled the two RLC resonators 110, 120 via an on-chip switch (SW 250, FIG. 15B). For a fair comparison, the active RLC resonator 110 with a capacitive tuning was regarded as a baseline traditional oscillator (see Methods, below). In the experiments, the baseline yielded a 0.30 GHz (2.93~3.23145 GHz) bandwidth tuning by adjusting the control voltage of varactor (FIG. 16C). In comparison, with the same amount of varactor tuning, the PT-symmetric system achieved a wider bandwidth tuning range of 0.57 GHz (2.63~3.20 GHz) by manipulating the gain-loss contrast (FIG. 16D), effectively enabling 2.1 times frequency tuning range of the baseline. We also observed that phase noise performances of our system were generally 1.5 dB better than the baseline across different oscillation frequencies (FIG. 20), equivalent to 70 percentage of the baseline noise intensity. This quality improvement can be attributed to the enhanced intrinsic passive Q factor in a PT-symmetric system and the subsequently increased carrier power through gain-loss tuning. These experiments demonstrate that PT symmetry can broaden the bandwidth tuning range of conventional microwave generation with improved quality. Our further investigations also show that our system generates four-phase microwaves using the unique topology at the exceptional point (FIG. 31).

Nonlinearity Characterization and Scattering Properties.

Figure 18A:
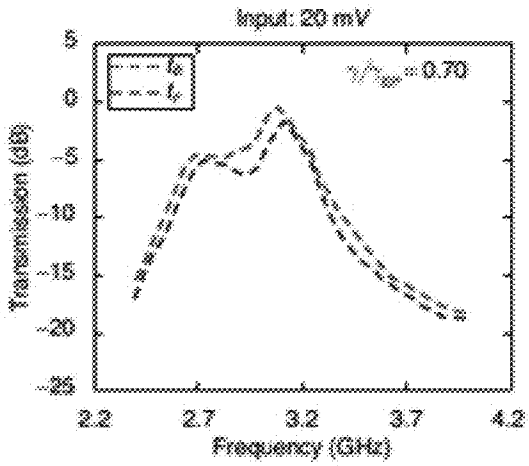
FIGS. 18A-18F are graphs depicting non-reciprocal transmissions of a fully integrated PT-symmetric electronic system.
Figure 18C:
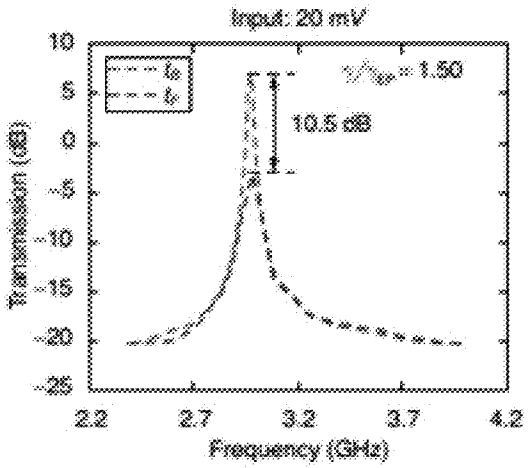
Figure 18E:
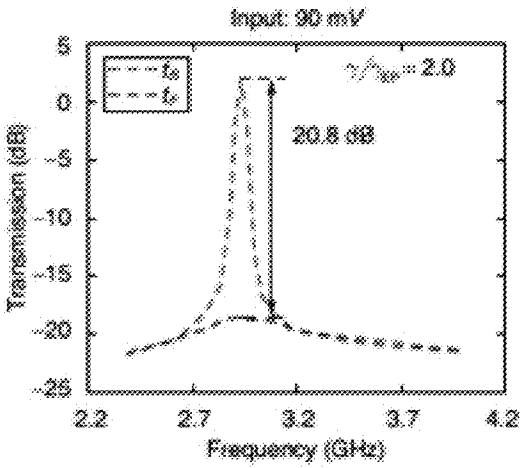
Figure 18B:
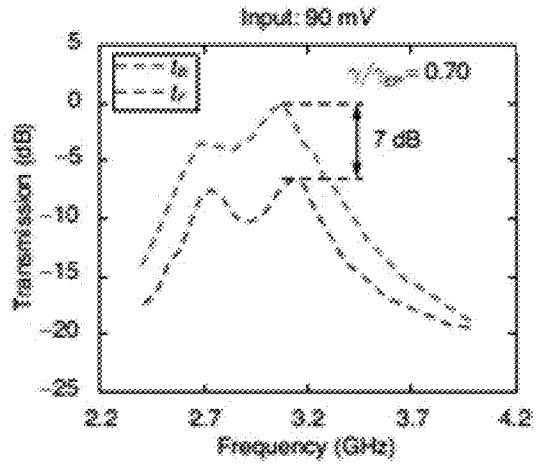
Figure 18D:
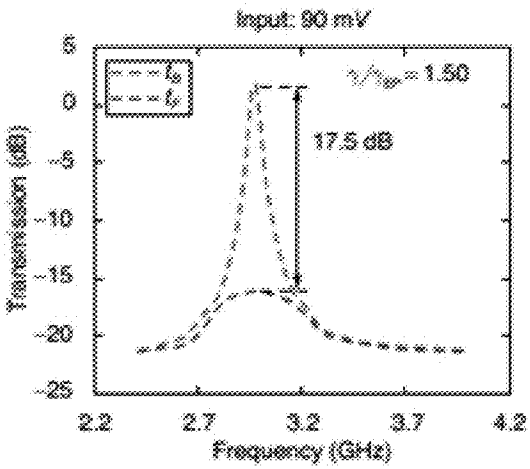

Although a small-signal model is used to simplify the analysis, nonlinearities are prevalent in CMOS integrated systems when they operate at high frequency and in a large-signal domain. The XDP 290 in our system is a nonlinear gain generator, which provides both a frequency-dependent and a complex high-order amplitude-dependent negative conductance, in contrast to the simple low-order amplitude-dependent gain intentionally introduced in previous PT-symmetric systems. To experimentally characterize the nonlinear response of our system, the equivalent of a transmission line (TL) with characteristic impedance Z0 was attached to both sides of the system through an on-chip switch in the form of a resistor R0=Z0. We biased the system in either the unbroken or the broken phase and then monitored the output voltage VG−(VL−) at the gain (loss) side by sending the amplitude-varying input VL+(VG+) into the loss (gain) side (FIG. 15A). For large input voltage (90 mV), a nonlinear response was clearly observed in both phases. For small input voltage (20 mV), while a linear response is observed in the unbroken phase, a nonlinear response is clearly observed in the broken phase (FIG. 18A). This enhanced nonlinearity can be attributed to the field localization in the active RLC resonator 110. Note that in this and the following experiments, we delicately tuned the gain and loss distribution to make our system operate in non-oscillatory mode while keeping the balanced PT symmetry condition.

Based on the characterization, we first studied the reflection of our system in the linear region. The scattering theory of linear PT-symmetric systems has shown that their reflection fulfills generalized unitary relationships, i.e., the gain side reflection rG and the loss side reflection rL satisfy rG rL=1 across the spectrum. To experimentally demonstrate this property, a TL was connected at the gain or loss side (FIG. 15A), and the system was biased in the unbroken phase. Then, a sinusoidal signal with varied frequencies was applied into the system. The incident wave, VG+(VL+), and the reflected wave, VG−(VL−), were extracted from the voltages at either side of the TL, from which the reflection coefficients rG=VG−/VG+ and rL=VL−/VL+ were calculated. The measured reflections in FIG. 18B match well with the theoretical predictions. This scattering property has been demonstrated before for telemetry sensing by magnetically coupling two RLC resonators 110, 120. Our system built upon capacitive coupling would also be promising as integrated chemical sensors if the capacitors of RLC resonators had been devised similarly as previous works. We also investigated the two-port scattering property and observed simultaneous existence of a coherent perfect absorption and lasing mode in this system. Moreover, extending our dimer system with more complex PT-symmetric structures can realize more advanced scattering phenomena, such as unidirectional invisibility.

Magnetic-Free Non-Reciprocal Microwave Transmission.

PT-symmetric systems have demonstrated enhanced non-reciprocal acoustical and optical wave transmissions with introduced nonlinear effects. We then studied the non-reciprocal microwave transport of our system operating at different regions. We measured the forward and backward transmissions of our system at different coupling factors $\gamma/\gamma_{EP}$ by tuning gain-loss contrast. In these experiments, the same experimental setup shown in FIG. 15A was adopted. The signal with variable frequencies was introduced into the gain (loss) side and captured at the loss (gain) side. By measuring the incident wave VG+(VL+) at the gain (loss) side and the transmitted wave VL−(VG−) at the corresponding loss (gain) side, both the forward transmission tF=VL−/VG+ and backward transmission tB=VG−/VL+ were obtained.

Figure 19A:
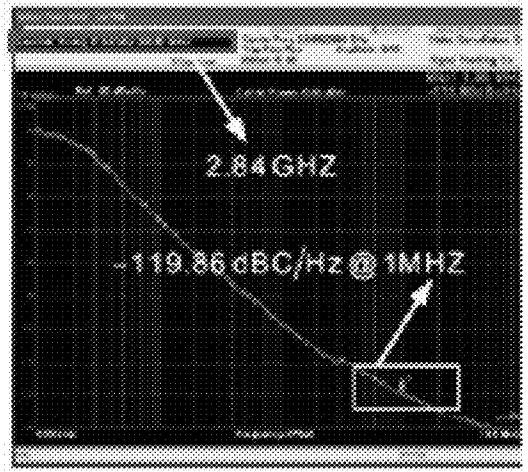
FIG. 19A depicts phase noise performance of a microwave generation of a fully integrated PT-symmetric electronic system at a low, medium, and high frequency.
Figure 19A:
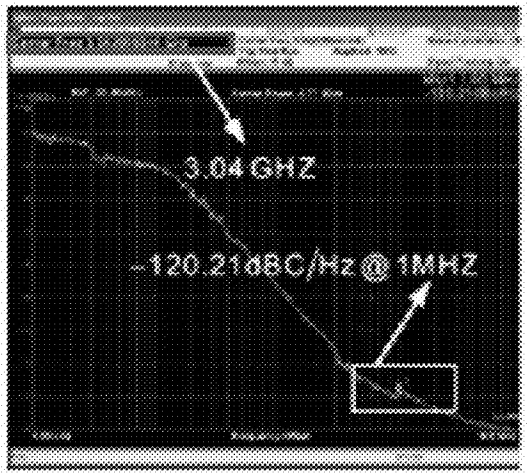
Figure 19A:
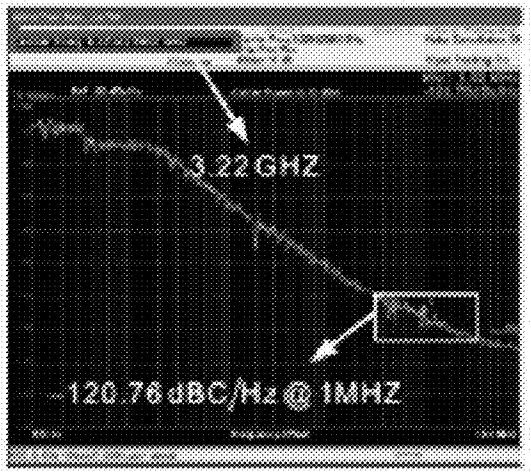

In the unbroken phase (FIG. 19A, 19B), the transmission spectra in both directions show double resonances. However, reciprocal transmission is observed with a 20 mV input amplitude while non-reciprocal transmission is observed with a 90 mV input amplitude: the forward transmission goes up to −7 dB, and the backward transmission is 0.1 dB. In the low input power case, the system is linear and reaches an equilibrium between the two RLC resonators 110, 120, giving rise to the similar microwave transmissions in both directions. Nonlinearity appears with increasing input amplitudes. The two resonators 110, 120 have different levels of nonlinearity, resulting in the non-reciprocal transmission. In the broken phase (see FIGS. 19C, 19D), the transmission spectra in both directions show single resonance. Non-reciprocal transmissions are observed under both input cases with different input amplitudes, and the case with the larger input voltage shows more significant non-reciprocal transmission. In addition, the comparison of the different phases under the same 90 mV input amplitude (see FIGS. 19B, 19D) shows that the nonlinearity is greatly enhanced in the broken phase, owing to the field localization in the active RLC resonator 110, and therefore the non-reciprocity is also enhanced: tF reduces to −15.6 dB, and the tB slightly increases to 1.9 dB. Moreover, the non-reciprocity of the system is improved in the broken phase (see FIG. 19E) under the same 90 mV input: tF decreases to −18.7 dB while the tB increases to 2.1 dB, due to the further enhanced nonlinearity by increasing coupling factor $\gamma/\gamma_{EP}$. By sweeping the coupling factor $\gamma/\gamma_{EP}$ at a fixed 90 mV input amplitude (see FIG. 32), this non-reciprocal behavior was observed over a broad bandwidth (2.75 to 3.10 GHz) at the resonance with the minimum isolation (see methods, below) over 7 dB (FIG. 19F).

Recent device demonstrations have produced non-magnetic non-reciprocity in silicon based on temporal modulation, but often exhibit narrow bandwidths and have significant area over heads because a number of passive devices are required to perform complex modulations. Our system clearly demonstrates that PT symmetry with nonlinearity offers a new approach to achieving broadband non-magnetic non-reciprocal transmissions by tuning gain-loss contrast. Compared to state-of-the-art CMOS non-reciprocal devices, our fully integrated PT-symmetric electronic system shows strong isolation (7-21 dB) among a wider microwave (2.75-3.10 GHz) bandwidth without complex modulations that require huge and expensive on-chip area. Our system also shows strong non-reciprocity with a lower input power threshold (−21 dBm) compared to nonlinearity induced non-reciprocal devices on other electronic platforms (see FIG. 38). This performance could lay the foundation for abundant application advancements in quantum computing, device protection, and radar communication.

We have reported a fully integrated electronic platform based on CMOS technology for non-hermitian physics, validating the powerful role of IC to study PT symmetry in a scalable manner. Fully integrated PT-symmetric electronics enables new capabilities in the microwave domain compared to the previous electronic platforms. With the unique gain/loss tuning mechanism of PT symmetry, our system shows extended broadband response and improved noise performance for microwave generation over conventional devices. In particular, our chip demonstrates strong non-reciprocal microwave transmission with the enhanced intrinsic nonlinearity of IC, leading to a new generation of integrated non-magnetic non-reciprocal devices. Our results shed light to on PT symmetry as an innovative design approach to overcoming the limitations of IC performances and benefiting numerous applications. In addition, more advanced IC technologies can be used to extend the functional and performance benefit of PT-symmetric systems to the higher millimeter and terahertz frequency range. The study is also expected to motivate further exploration such as PT symmetry in opto-electronics, electro-acoustics, and topological electronics (Supplementary Section 8.2) based on high-dimensional PT-symmetric structures with standard IC technology, enriching scientific discoveries of non-Hermitian physics.

Methods

Differential architecture. The fully integrated PT-symmetric electronic system was implemented in a differential topology (see FIG. 20). The gain −RG 150 is the parallel resistance of −RG0, −RG1 and RG2. −RG0 is generated by the XDP 290. RG1 150 is realized by voltage-controlled MOS resistor. The loss RL0 200 is realized in the same way as RG1 150. By fixing the bias voltage VBIASG of −RG0 and controlling the bias voltage of gain (loss) side MOS resistor, −RG (RL) can be continuously adjusted. The capacitor CG (CL) 160, 210 in each RLC resonator 110, 120 is composed of a MIM capacitor CG1 (CL1) 320, 340 and a varactor CG2 (CL2) 330, 350. The varactor only takes up a small proportion of the total capacitance in each RLC resonator 110, 120 and is used to compensate the mismatch between the fixed MIM capacitor on both sides. The coupling capacitance CC 230, 260 is designed by two equal MIM capacitors CC1 240 and CC2 245 which are serially connected through an on-chip switch (SW 250, FIG. 20A). The inductance LG (LL) 170, 220 in both RLC resonators 110, 120 comes from symmetrical parallel inductors (symindp, see FIG. 22). In the practical implementation, the equivalent of a transmission line (TL) with characteristic impedance Z0 was attached to each side of the system through an on-chip switch in the form of an on-chip resistor R0=Z0. By controlling the switch, the system could be flexibly configured to test one-port scattering or nonreciprocal transmission.

In the differential architecture, each signal is transmitted by a pair of differential wires where the signal is represented by the amplitude difference between the differential wires. For example, in our design, each voltage VG (VL) at the terminal of RLC resonators 110, 120 is represented by a pair of differential signals (VGP and VGN for VG, VLP and VLN for VL). The differential architecture is symmetric with respect to its virtual ground and can be divided into two equal parts (see FIG. 23). Either of them is an equivalent single-ended representation of the differential one and can be used to derive the PT symmetry concept. Note that in single-ended architecture, the gain −RG 150, loss RL 200, and inductor LG (LL) 170,220 will be half, and the capacitor CG (CL) will be double. The PT symmetry condition is satisfied by setting RG≈RL=R, LG≈LL=L, CG≈CL=C. In our system, R∈[90, 380] Ω, L=1.85 nH, C∈[1300, 1550] fF, CC=500 fF, Z0=280Ω.

Phase Transition.

Applying Kirchoff's law on the equivalent circuit representation in FIG. 1*a* yields the following expression:

$$V_G=i\omega' L/2\cdot I_1, I_1-V_G/(R/2)+i\omega' 2C\cdot V_G+i\omega' C_C\cdot(V_G-V_L)=0, \tag{2}$$

$$V_L=i\omega' L/2\cdot I_2, I_2+V_L/(R/2)+i\omega' 2C\cdot V_L+i\omega' C_C\cdot(V_L-V_G)=0. \tag{3}$$

Here, ω' is an angular frequency. Eliminating the current from the relations, scaling the frequency and time by $$\omega_0=1/\sqrt{LC}, \text{ and taking } c=C_C/2C, \gamma=\sqrt{L/C}/R$$

gives the following matrix equation:

$$\begin{bmatrix} 1/\omega - j\gamma - \omega(1+c) & \omega c \\ \omega c & 1/\omega + j\gamma - \omega(1+c) \end{bmatrix} \cdot \begin{bmatrix} V_G \\ V_L \end{bmatrix} = \begin{bmatrix} 0 \\ 0 \end{bmatrix}. \tag{4}$$

Here, ω is the normalized frequency. This linear, homogeneous system has four normal mode frequencies, as required to fulfill any arbitrary initial condition for voltage and current, given by $$\omega_{1,2} = \pm\frac{\sqrt{\gamma_{EP}^2-\gamma^2}+\sqrt{\gamma_{UP}^2-\gamma^2}}{2\sqrt{1+2c}}, \quad \omega_{3,4} = \pm\frac{\sqrt{\gamma_{EP}^2-\gamma^2}-\sqrt{\gamma_{UP}^2-\gamma^2}}{2\sqrt{1+2c}}, \tag{5}$$

where, the PT-symmetric breaking point (γEP) and the upper critical point (yup) are identified as $$\gamma_{EP}=|1-\sqrt{1+2c}|, \gamma_{UP}=1+\sqrt{1+2c},$$

The corresponding phase difference between the two RLC resonators can be expressed as $$\phi_{1,3} = \frac{\pi}{2} - \tan^{-1}\left[\frac{1}{\gamma}\cdot\left(\frac{1}{\omega_{1,3}} - (1+c)\cdot\omega_{1,3}\right)\right]. \tag{6}$$

Frequency Tuning Range of Microwave Generation.

Frequency tuning range for microwave generation is defined as $$FTR = \frac{\omega_{max}-\omega_{min}}{(\omega_{max}+\omega_{min})/2}\times 100\%. \tag{7}$$

Here, $\omega_{max}$ and $\omega_{min}$ are the maximum and minimum frequency in the total tuning bandwidth. Isolation of non-reciprocal transmission. The isolation of our system under a coupling factor 289 γ/γEP is defined as $$I_{ISO}=\max(t_B-t^F). \tag{8}$$

Here, $t_B$ and $t_F$ are the backward transmission and forward transmission of the system with the frequency sweeping.

Chip implementation and fabrication. All CMOS devices were prepared in Cadence Virtuoso (an industry-standard design tool for frontend circuit design). All designs satisfy standard CMOS manufacturing rules of IBM's commercial 130 nm CMOS8RF process, with physical verification performed using Mentor Graphics Calibre (an industry-standard design tool for backend layout design). We resort to Metal Oxide Semiconductor Implementation Service (MOSIS) for fabrication.

Measurement setups. The chip was bonded on a 4-layer FR4 PCB (used as a daughter board in our experiments) by gold wires (see FIG. 29), forming all 38 electrical connections (including power and ground) from the chip to the PCB. The bonding wires were properly designed for use at frequencies above 50 GHz. Our experimental setup comprised a bonded chip in a daughterboard, a motherboard, a power supply, a mixed signal oscilloscope (MSO, Agilent 9404A), an arbitrary wave generator (AWG, KEYSIGHT M8195A) and a personal computer (PC). The daughter board provided control biases to the chip. These biases had two main functions: 1) compensating the mismatch of CMOS components to minimize the unbalance between the two RLC resonators; 2) tuning the gain (loss) such that the system can evolve from exact phase to broken phase. The mother board acted as a power board to supply all power/control voltages to the daughter board. The benchtop power supply was the main power source and used to power the motherboard. The MSO has four pairs of differential channels, and its highest sampling rate is 20 GSa/s. The AWG has four pairs of differential channels, each pair of which can generate arbitrary waves up to 50 GHz with independently varying phase. In the phase transition experiments, the outputs of two RLC resonators 110, 120 were connected to the MSO, where both the eigenfrequencies and phase differences could be directly observed on the panel. In the scattering experiments, the AWG sourced sinusoidal signals with varying frequencies or phase into the chip through TL. Then signals on both terminals of the TL were sent into the MSO such that the incident wave and reflected wave could be captured. In the nonreciprocal experiments, the AWG fed sinusoidal signals with varying frequencies into the system through the gain (loss) side TL. Then both the incident wave on the input terminal of the gain (loss) side TL and the reflected wave on the output terminal of loss (gain) side TL could be captured by MSO. During the scattering experiments and nonreciprocal transport experiments, the AWG were controlled by software on a PC to generate frequency-varying signals.

Referring to FIG. 15, a schematic diagram of the fully integrated PT-symmetric electronic system, where capacitive coupling (Cc) is used to connect two RLC resonators 110, 120, one with gain −RG 150 and the other one with equal loss (RI) 200. The two units can be coupled and decoupled by the switch SW 230. The forward transmission is defined from gain side to loss side. A cross-coupled differential pair (XDP) 290 is used in our design to generate −RG0 150 which is defined as the reciprocal of the total small signal transconductance of the PMOS differential pair and NMOS differential pair, i.e, $-R_{G0}=-2/(g_{mp}+g_{mn})$.

The simulation results show that the negative resistance −RG0 150 remains constant in a wide frequency range up to 10 GHz. The chip is wire-bonded on a daughter printed circuit board (PCB), which provides various control voltages and RF connectors for testing. A mother PCB supply powers to the daughter PCB. The fully integrated PT-symmetric electronic system is fabricated in a 130 nm CMOS whose core area is 200×750 $\mu m^2$.

Figure 16D:
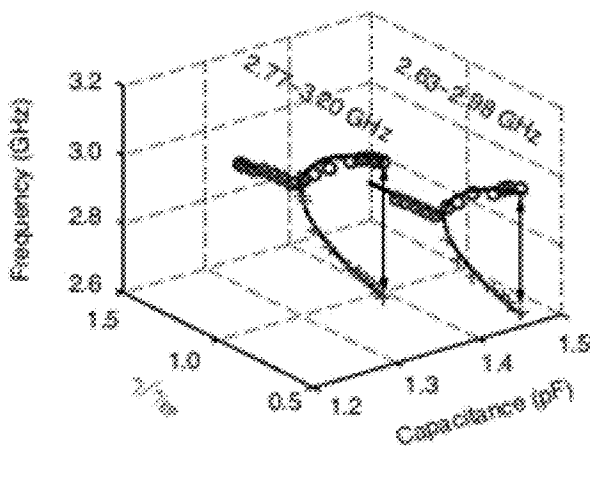

Referring to FIGS. 16A-16D, eigenfrequencies and phase transition of the fully integrated PT-symmetric electronic system with the evolution of coupling factor $\gamma/\gamma_{EP}$. a-b, Real (FIG. 16A) and imaginary (FIG. 16B) parts of eigenfrequencies as a function of the coupling factor γ/γEP when the resonators have a capacitance C=1.30 pF. In both FIGS. 16A and 16B, symbols correspond to experimental (Exp) or simulated (Sim) data, while the curves show theoretical results obtained with the small signal model. FIG. 16C, frequency tuning range (FTR) of the baseline oscillator, which is achieved by adjusting the varactor in the gain resonator through external voltage bias. The tuning range of the capacitance C is from 1.30 pF to 1.55 pF under different control voltages, corresponding to an FTR of [2.93, 3.23] GHz. FIG. 16D, FTR of our system at two fixed capacitances of resonators, C=1.30 pF and C=1.45 pF. By tuning the capacitance from 1.30 pF to 1.45 pF, the FTR changes from the interval of [2.77, 3.20] GHz to the interval of [2.63, 2.98] GHz, enabling [2.63, 3.20] GHz tuning range in total.

Figure 17B:
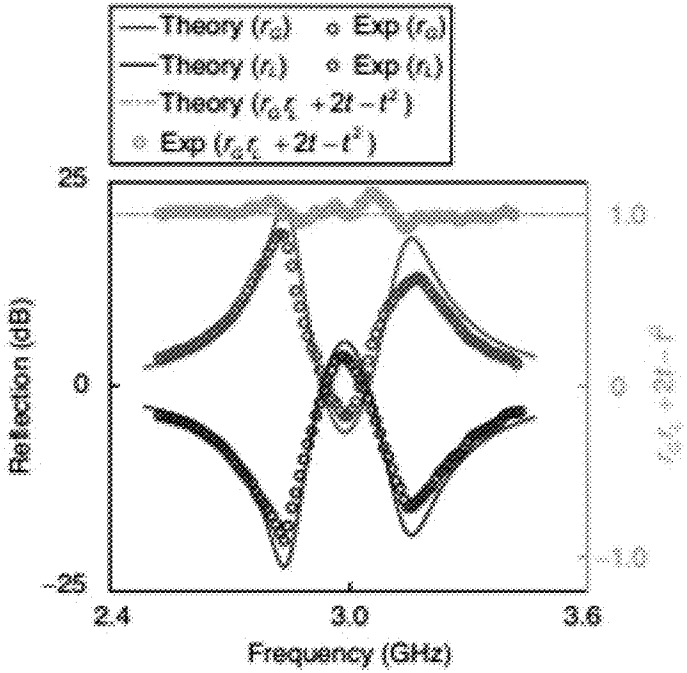
FIGS. 17A and 17B are graphs depicting nonlinearity characterization and generalized power conservation of a fully integrated PT-symmetric electronic system.
Figure 17A:
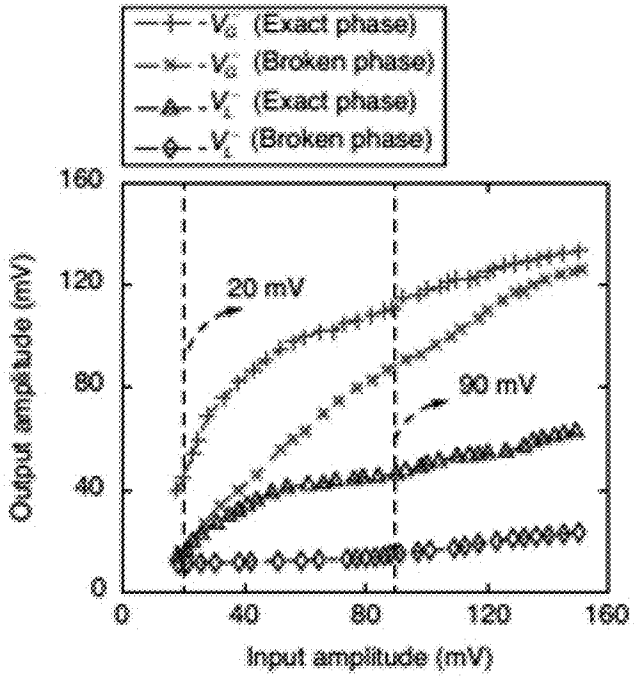

Referring to FIG. 17A, backward and forward input-output responses in both the exact phase and broken phase. Nonlinear responses occur in both regimes when the amplitudes of the input signals are high, but are stronger in the broken phase with a steeper slope. The black dashed-dotted lines mark the input amplitudes we choose to investigate the phenomenon of nonreciprocal transmission. FIG. 17B, demonstrations of generalized unitary relationship (also known as generalized power conservation) of our system. We use two different ways to exhibit this property. First, we use decibel (dB, the left-side y-axis in the figure) to represent forward ($r_G$) and backward reflection coefficients (η) and show the comparison of $r_G$, and n between experimental (Exp) measurements (empty circles) and PT symmetry theory (solid curves) in the linear region of the unbroken phase. The coefficients are symmetric about the 0-dB axis. Second, we demonstrate the quantity $rG \cdot rL+2t-t^2$ (the right-side y-axis in the figure). It shows that the experimental results (Exp) are much close to the PT symmetry theory (dashed curve with a constant value 1) across the spectrum. Note that in this example we use a single-port set-up for scattering measurement, where the transmission t is 0. Both ways verify the property.

Referring to FIGS. 17A-17F, reciprocal transmission (see FIG. 17A in the unbroken phase ($\gamma/\gamma_{EP}$=0:70) with a small input amplitude (20 mV). FIG. 17B, non-reciprocal transmission in the unbroken phase ($\gamma/\gamma_{EP}$=0:70) with increased input amplitude (90 mV). 17*c*, non-reciprocal transmission in the broken phase ($\gamma/\gamma_{EP}$=1:50) with a single peak at a small input amplitude (20 mV). FIG. 17D, enhanced non-reciprocal transmission in the broken phase ($\gamma/\gamma_{EP}$=1:50) with increased input amplitude (90 mV). FIG. 17E, further enhanced non-reciprocal transmission in the broken phase with increased coupling factor ($\gamma/\gamma_{EP}$=2:0) at the same input amplitude (90 mV). FIG. 17F, the isolation $t_B$—$t_F$ optimized by tuning the gain=loss parameter is shown at different probing frequencies in the microwave domain (2.75-3.10 GHz).

Figure 19B:
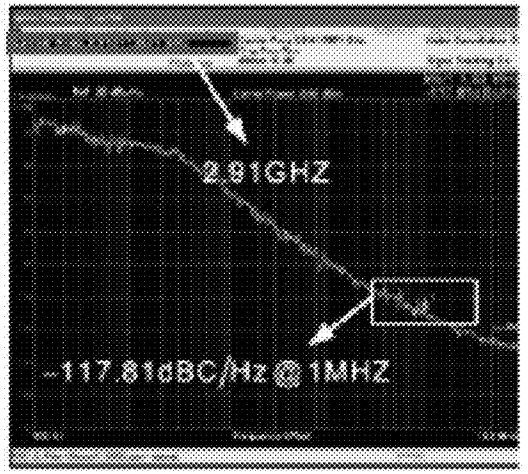
FIG. 19B depicts phase noise performance of a baseline conventional oscillator at a low, medium, and high frequency.
Figure 19B:
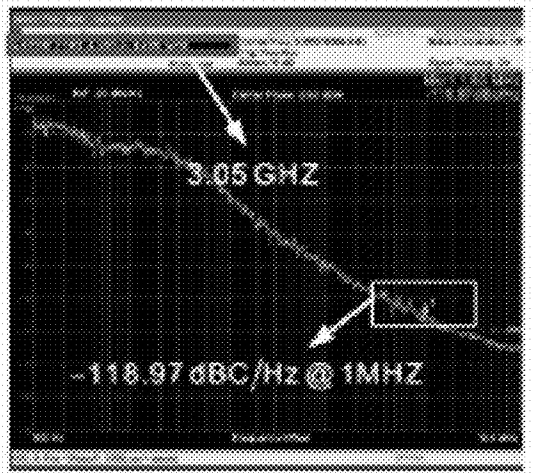
Figure 19B:
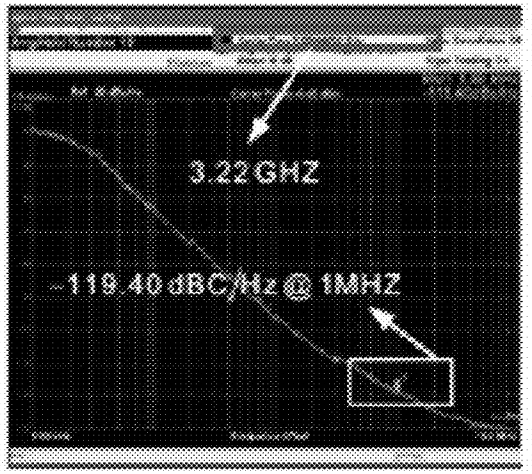

Referring to FIG. 19A, phase noise of our system at different frequencies: 2.84 GHz (low frequency), 3.04 GHz (medium frequency), 3.22 GHz (high frequency). FIG. 19B, Phase noise of the baseline oscillator at different frequencies: 2.91 GHz (low frequency), 3.05 GHz (medium frequency), 3.22 GHz (high frequency).

1. Implementation.

1.1 Differential Architecture and Detailed Circuits.

Figure 20:
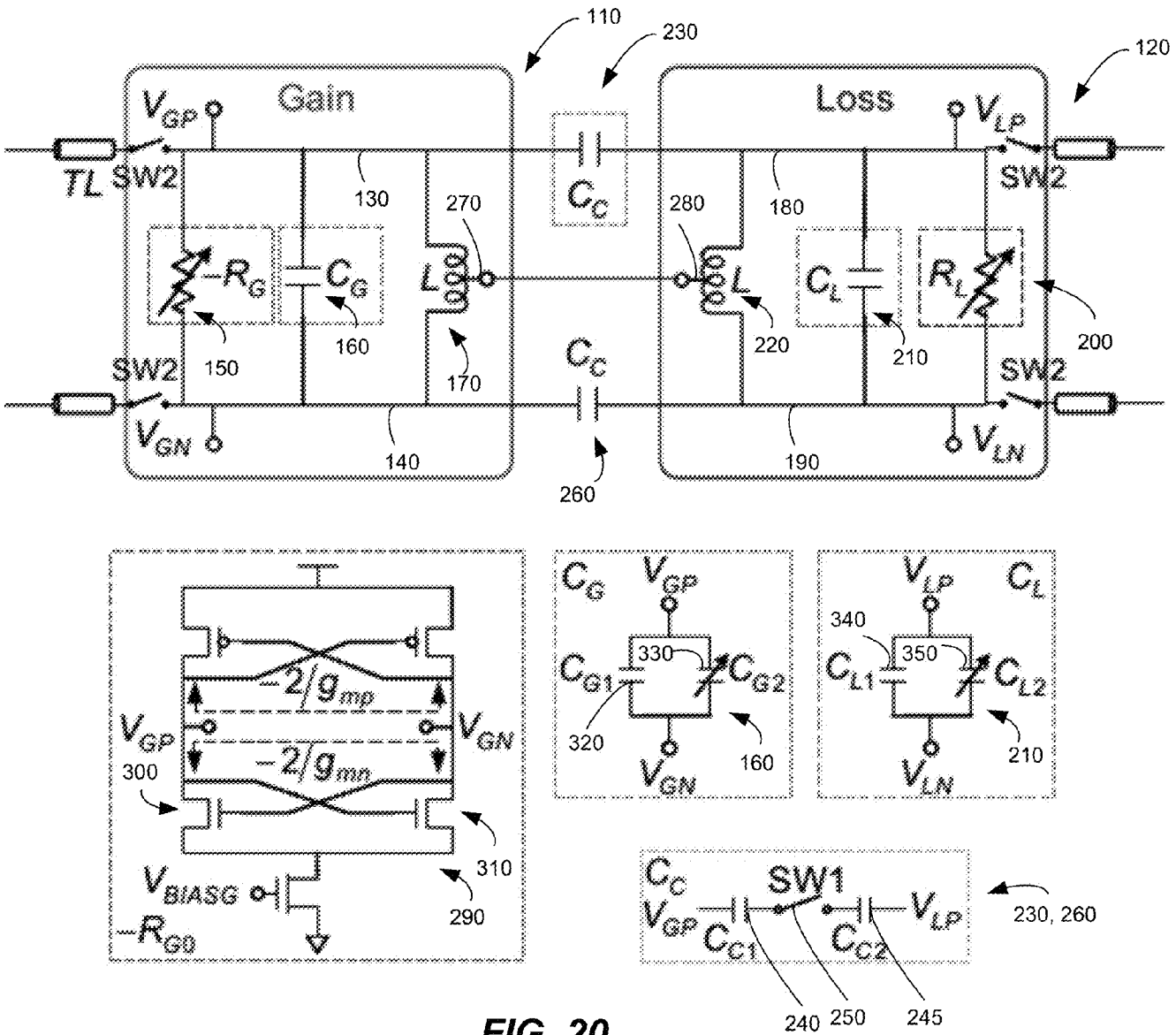
FIG. 20 is a schematic overview of a fully integrated PT-symmetric electronic system with a differential architecture.

The schematic overview of the proposed fully integrated parity-time- (PT-) symmetric electronic system is illustrated in FIG. 20. As it shows, our system was implemented with a differential topology, in contrast with the single-ended architecture commonly used in board-level and MEMs-level PT-symmetric electronic systems. The differential architecture has the advantage to mitigate common-mode perturbations.

Referring to FIG. 20, schematic overview of fully integrated PT-symmetric electronic system with differential architecture. It consists of two RLC resonators 110, 120 with balanced gain −RG 150 and loss RL 200. The gain −RG0 150 is generated by the cross-coupled differential pair (XDP) 290. The capacitances CG (CL) 160, 210 in both RLC resonators 110, 120 are comprised of an inherent parasitic capacitance CG0 (CL0) 160, 210, a fixed high-Q MIM capacitor CG1 (CL1) 320, 340 and a varactor CG2 (CL2) 330, 350. The varactor is used to compensate the mismatch between CG1 160 and CL1 210. The coupling capacitance (CC) 230, 260 is made of two serially connected MIM capacitors (CC1 240 and CC2 245) with an on-chip switch (SW1 250). The two RLC resonators 110, 120 can be coupled (decoupled) by turning on (off) the SW1 250. TLs are attached to the both sides of system by SW2.

Our system consists of two RLC resonators 110, 120, one with active gain −RG 150 and the other one with passive loss RL 200. The gain −RG 150 is the parallel resistance of −RG0 150, RG1 200, and RG2, namely, −RG=−RG0||RG1||RG2. Here, −RG0 150 is generated by the cross-coupled differential pair (XDP) 290; RG1 150 is a variable resistor realized by MOS transistors; RG2 is the inherent loss of the active RLC resonator 110. Similarly, the loss RL 200 is the parallel resistance of RL0, and RL1, that is RL=R10||RL1. RL0 200 is a variable resistor realized by in the same way as RG1 150; RL1 is the inherent loss of the passive RLC resonator 120. By controlling the bias voltage of gain (loss) side MOS transistors, −RG (RL) 150, 200 can be continuously adjusted. The capacitor CG (CL) 160, 210 in each RLC resonator 110, 120 is composed of a parasitic capacitance CG0) (CL0), a fixed Metal-Insulator-Metal (MIM) capacitor CG1 (CL1) 340, 350 with high-quality factor (high-Q) and an adjustable varactor CG2 (CL2) 330, 350. The varactor takes up a small proportion of the total capacitance and is used to compensate for the fabricated mismatch between the fixed MIM capacitors of both sides. The coupling capacitance CC 230, 260 is designed by two equal MIM capacitors CC1 240 and (CC2) 245 in serial connection via an on-chip switch (SW1 250). Note that the two RLC resonators 110, 120 can also be coupled (decoupled) by turning on (off) of the SW1 250.

Referring to FIG. 21, the inductor L 170, 220 in each RLC resonator 110, 120 is a symmetrical parallel inductor (symindp) with three terminals: two input ports and one center tap 270, 280. The center tap connection is provided such that by connecting the center taps of inductors in both RLC resonators, the passive RLC resonator shares the same common-mode voltage with the active one. This symindp with cross-over connections to create a symmetrical layout with low resistance and low parasitic capacitance, is ideally suited for differential resonators. In the practical implementation, the equivalent of a transmission line (TL) with characteristic impedance Z0 was attached to both sides of the system through an on-chip switch (SW2) in the form of a resistor R0=Z0.

Figures 22A, 22B:
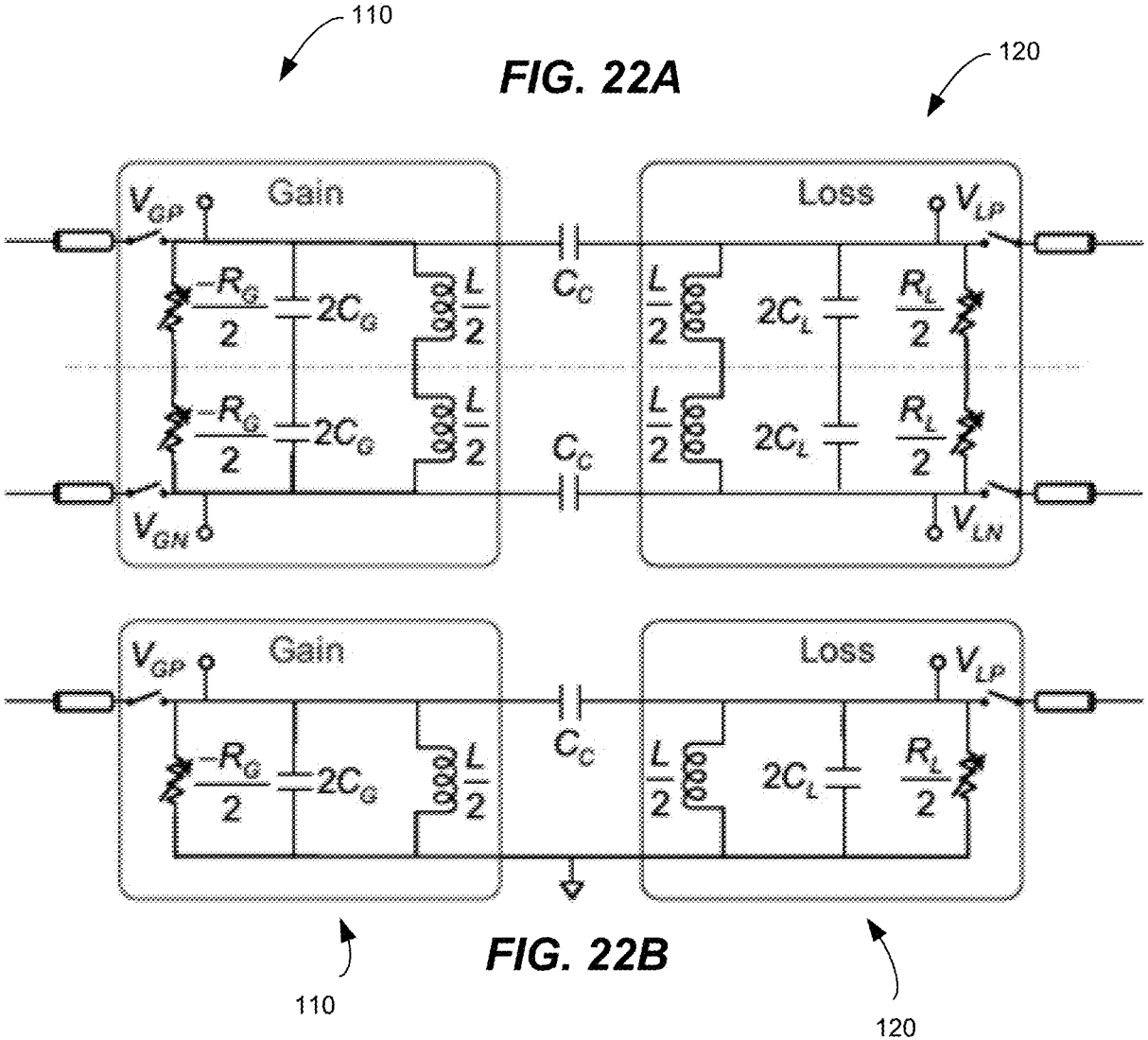
FIGS. 22A and 22B are schematics depicting a transformation of a differential architecture to a single-ended architecture of a fully integrated PT-symmetric electronic system.

A common way to analyze differential circuits is to convert them into single-ended equivalents. As FIG. 22A shows, by using a symmetrical axis, the differential circuit can be divided into two equal parts. Either of them is an equivalent single-ended representation of the differential one, and can be used to derive mathematical expression of the PT-symmetric system. Therefore, the equivalent single-ended representation in FIG. 22B is used as the simplified model for analysis. The difference between these two circuit topologies is that in differential architecture, each signal is represented by the amplitude difference between the differential wires; while in single-ended architecture, each signal is transmitted by only one wire and all the terminal signals are referenced to a common ground. For example, in our system, the voltage VG (VL) at the terminal of each RLC resonator 110, 120 is represented by a pair of differential signals, e.g., VGP and VGN for VG, VLP and VLN for VL. Note that in single-ended architecture, gain −RG 150, loss RL 200 and inductor L 170, 220 will be half, but the capacitor CG (CL) 160, 210 will be double. The PT symmetry condition is satisfied by setting RG≈RL=R, LG≈LL=L, and CG≈CL=C.

1.2 Analysis of Cross-Coupled Differential Pair.

Figure 23:
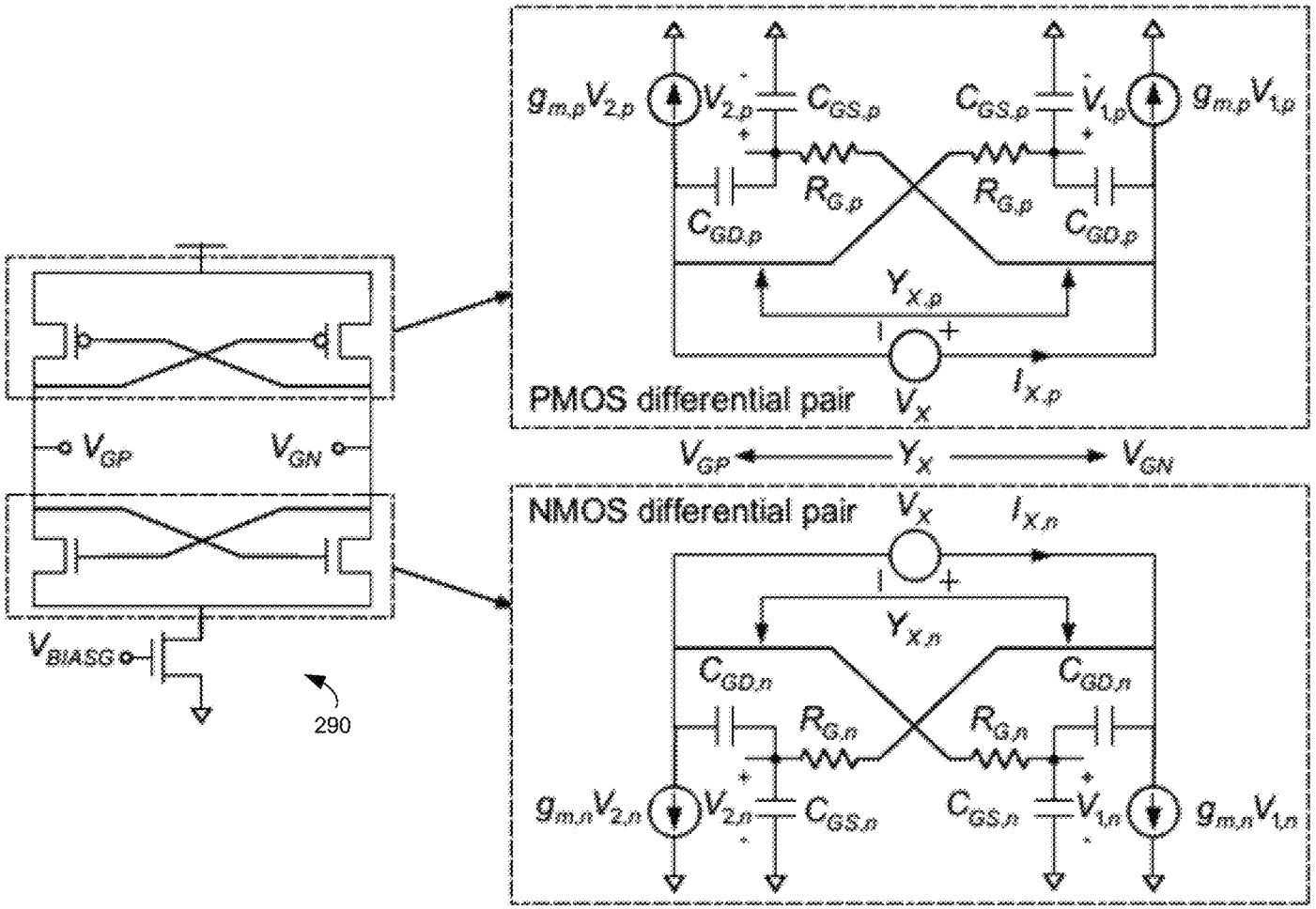
FIG. 23 are schematic representations of a small signal model of a cross-coupled differential pair.

A comprehensive analysis of −RG0 can be obtained through the small signal model of XDP 290 shown in FIG. 23, where for NMOS differential pair we have $$Y_{X,n}(S) = \frac{R_{G,n}C_{GS,n}C_{GD,n}S^2 + [C_{GS,n} + (4 + g_{m,n}R_{G,n})C_{GD,n}] - g_{m,n}}{2[R_{G,n}(C_{GS,n} + C_{GD,n}) + 1]}. \quad (1)$$

and for *PMOS* different pair, $$Y_{X,p}(S) = \frac{R_{G,p}C_{GS,p}C_{GD,p}S^2 + [C_{GS,p} + (4 + g_{m,p}R_{G,p})C_{GD,p}] - g_{m,p}}{2[R_{G,p}(C_{GS,p} + C_{GD,p}) + 1]}. \quad (2)$$

Hence, $$Re\{Y_{X,n}\} = \frac{-g_{m,n} + R_{G,n}\omega^2\left[C_{GS,n}^2 + C_{GD,n}(4 + g_{m,n}R_{G,n})(C_{GS,n} + C_{GD,n})\right]}{2\left[R_{G,n}^2(C_{GS,n} + C_{GD,n})^2\omega^2 + 1\right)}, \quad (3)$$

(4)

Here, the subscript $n$ ($p$) denotes *NMOS* (*PMOS*) differential pair. If $R_{G,n}^2(C_{GS,n} + C_{GD,n})^2\omega^2 \ll 1$ and $R_{G,p}^2(C_{GS,p} + C_{GD,p})^2\omega^2 \ll 1$, then $$Re\{Y_{X,n}\} \approx -\frac{g_{m,n}}{2} + R_{G,n}\omega^2 \cdot \frac{C_{GS,n}^2 + C_{GD,n}(4 + g_{m,n}R_{G,n})(C_{GS,n} + C_{GD,n})}{2}, \quad (5)$$

$$Re\{Y_{X,p}\} \approx -\frac{g_{m,p}}{2} + R_{G,p}\omega^2 \cdot \frac{C_{GS,p}^2 + C_{GD,p}(4 + g_{m,p}R_{G,p})(C_{GS,p} + C_{GD,p})}{2}. \quad (6)$$

Combing *Eq.* (5) and *Eq.* (6), one can obtain $$Re\{Y_X\} = Re\{Y_{X,n}\} + Re\{Y_{X,p}\} = -(g_{m,n} + g_{m,p})/2 + f(\omega). \quad (7)$$

Here, f(ω) is a frequency-dependent term. In large signal domain, Re{$Y_X$} also dependents on the amplitude of oscillation voltage between the two terminals of the differential pair [6]. A reasonable assumption is that when frequency ω is low and the XDP operates in the signal domain, Re{$Y_X$} can be expressed as $$Re\{Y_X\} = -(g_{m,n} + g_{m,p})/2. \quad (8)$$

Figure 24:
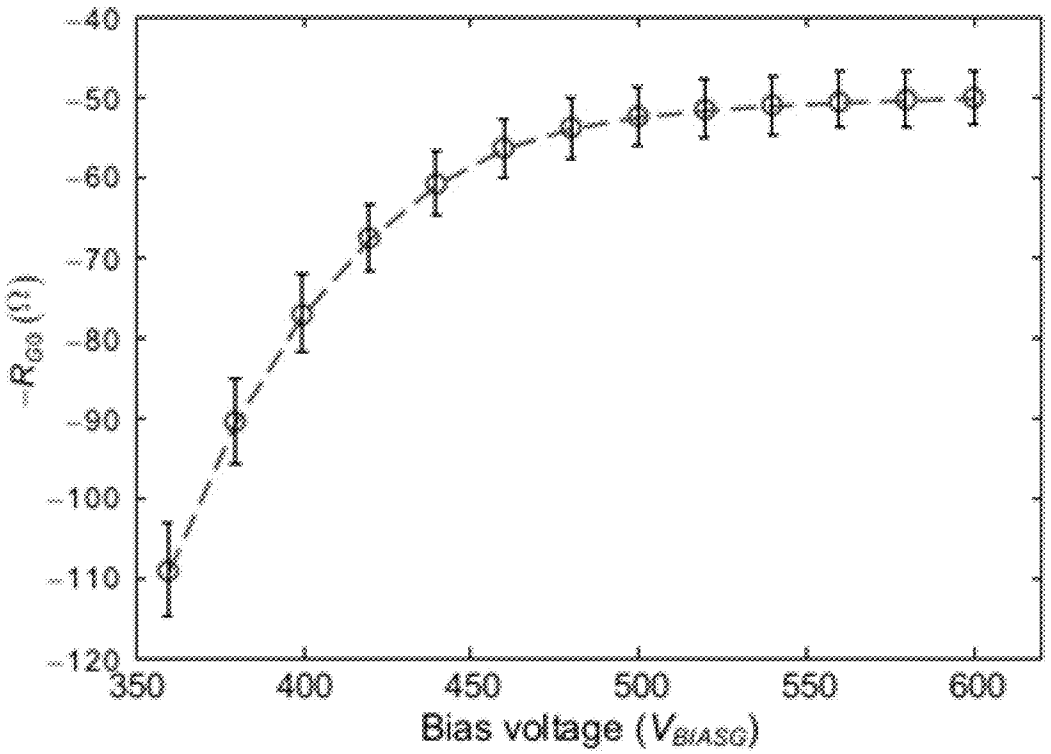
FIG. 24 is graph representing tuning gain with a bias voltage for a fully integrated PT-symmetric electronic system.

Therefore, the negative resistance −RG0 150 can be obtained as $$-R_{G0} = -2/(g_{m,n} + g_{m,p}), \quad (9)$$

which is the reciprocal of summation of small signal transconductance of NMOS differential pair and PMOS differential pair. For theoretical analysis, we consider our system as a linear system with the assumption of small signal condition. FIG. 24 shows the dependence of the negative resistance on the bias voltage. The results are obtained from high-fidelity post-layout circuit simulations, where process, voltage, and temperature (PVT) variations are carefully considered. The error bar at each point is the potential variation range of the negative resistance caused by PVT variations at the same bias voltage. Note that for analog circuit design in mature technology (such as CMOS 130 nm), the simulated results from high-fidelity post-layout simulator (i.e., Cadence Spectre) often match well with the measured results, and thus can be used to verify the functionalities of the designed chip.

2. Scattering Properties.

2.1 Single-Port Scattering.

Figure 25A:
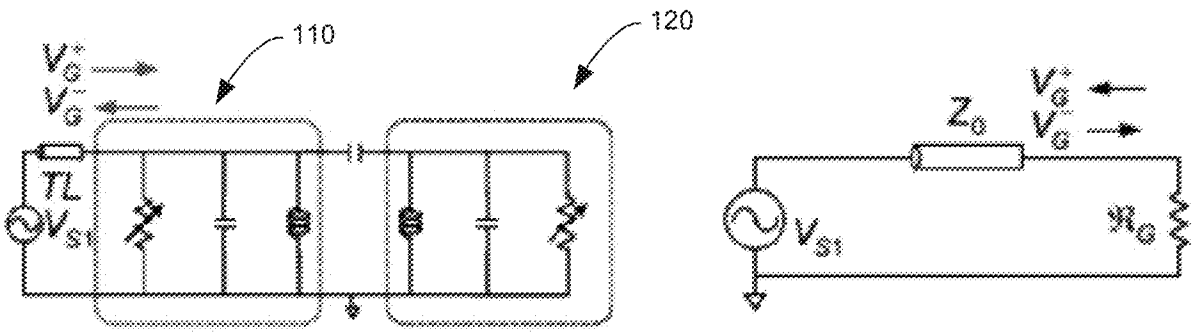
FIG. 25A depicts a circuit schematic and equivalent circuit model for single-port scattering associated with a fully integrated PT-symmetric electronic system.
Figure 25B:
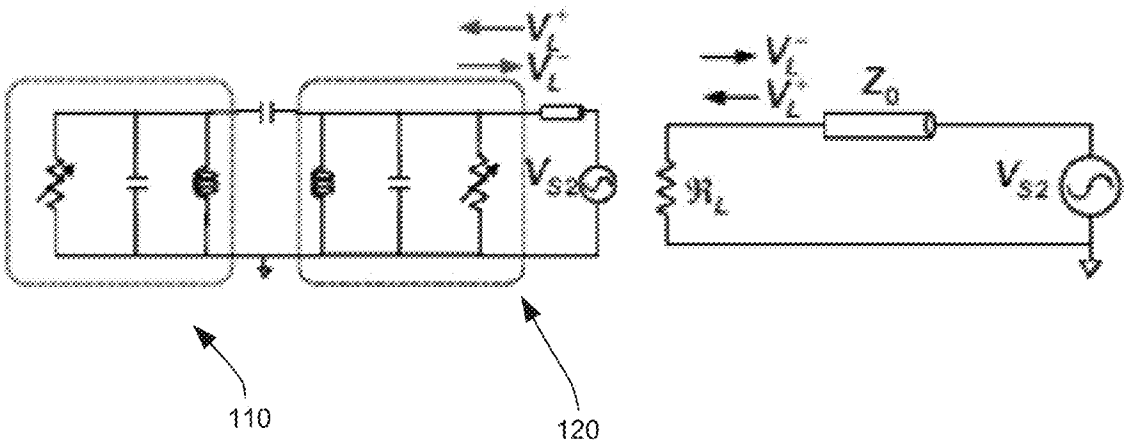
FIG. 25B depicts another circuit schematic and equivalent circuit model for single-port scattering associated with a fully integrated PT-symmetric electronic system.

The theory of linear PT-symmetric systems has shown that single-port scattering fulfills generalized unitary relationship, that is gain side reflection $R_G$ and loss side reflection, satisfy RG·RL=1. We first derive the theory of single-port scattering for our system from the circuit perspective. FIGS. 25A-25B represent the conceptual illustration of single-port scattering and its equivalent circuit model. In scattering theory, the reflection coefficients are defined as the ratio of reflected wave and the incident wave, that is RG=VG−/VG+ and RL=VL−/VL+. In circuit theory, the gain side reflection RG can be readily obtained as $$r_G = \frac{\mathcal{R}_G(\omega') - Z_0}{\mathcal{R}_G(\omega') + Z_0}. \tag{10}$$

While for the loss side, the reflection $r_L$ can be directly written as $$r_L = \frac{\mathcal{R}_L(\omega') - Z_0}{\mathcal{R}_L(\omega') + Z_0}. \tag{11}$$

Figure 26A:
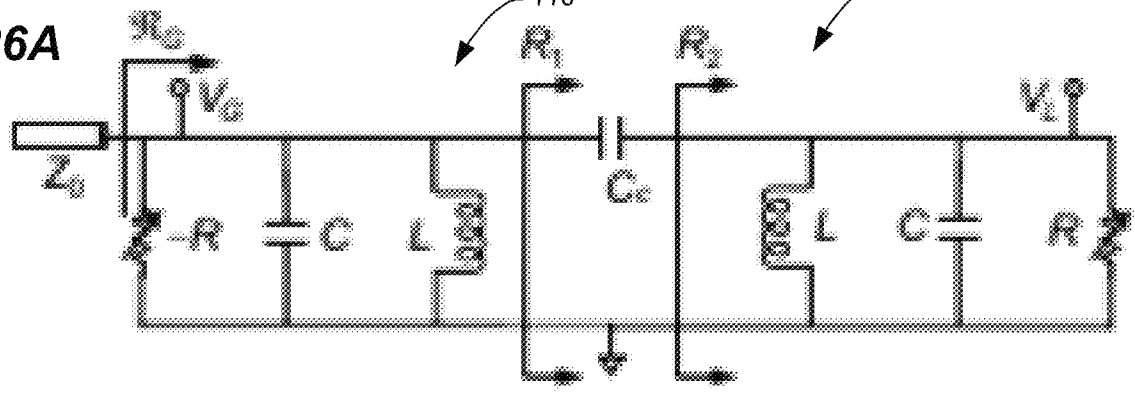
FIGS. 26A and 26B depict circuit models used to calculate various parameters for a fully integrated PT-symmetric electronic system.
Figure 26B:
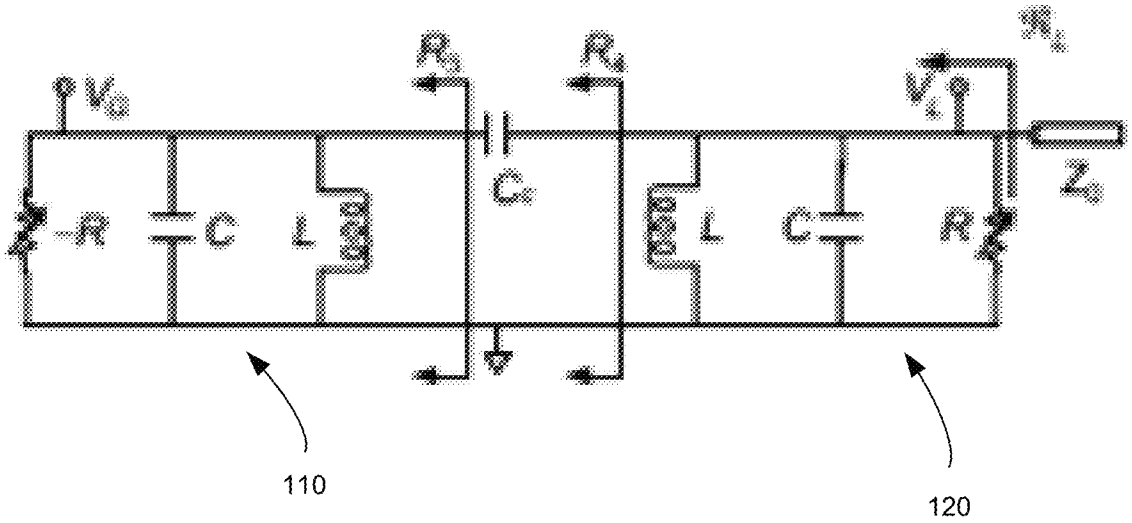

Here, RG represents the equivalent impedance of the system seen from left to right (shown in FIG. 26A); RL represents the impedance of the system seen from right to the left (shown in FIG. 26*b*); and Z0 is the characteristic resistor of TL. Let $\gamma=\sqrt{L/C}/R$, $c=C_C/C$, $\omega=\omega'\sqrt{LC}$, and resort to FIG. 26*a*, then $$\mathcal{R}_G = R \cdot \frac{-\omega^2\gamma^2 + j[\omega\gamma - (1+c)\omega^3\gamma]}{(1-\omega^2)^2 - 2\omega^2 c(1-\omega^2) + \omega^2\gamma^2}. \tag{12}$$

Similarly, we resort to FIG. 22*b* to calculate RL, which is expressed as $$\mathcal{R}_L = R \cdot \frac{\omega^2\gamma^2 + j[\omega\gamma - (1+c)\omega^3\gamma]}{(1-\omega^2)^2 - 2\omega^2 c(1-\omega^2) + \omega^2\gamma^2}. \tag{13}$$

$$\text{Let } E = R\omega^2\gamma^2 : F = R[\omega\gamma - (1+c)\omega^3\gamma];$$

$$G = (1-\omega^2)^2 - 2\omega^2 c(1-\omega^2) + \omega^2\gamma^2, \text{ then}$$

$$\mathcal{R}_G = (-E + jF)/G;\ \mathcal{R}_L = (E + jF)/G. \tag{14}$$

By combing Eq. (10), Eq. (11), and Eq. (14), we can obtain $$\|r_G\|\cdot\|r_L\|=1;\phi_G+\phi_L=\pi. \tag{15}$$

2.2 Two-Port Scattering.

The theory of linear PT-symmetric systems has also shown that two-port scattering exhibits a simultaneous coherent perfect absorber (CPA-) -amplifier property at a special frequency (Janus frequency). We then derive the two-port scattering theory for our system from the circuit perspective. The two-port scattering can be considered as two-port TL model shown in FIG. 27. We can write the basic voltage law of system by using S-parameter model:

$$\begin{cases} \dfrac{V_G^-}{\sqrt{Z_0}} = S_{11}\cdot\dfrac{V_G^+}{\sqrt{Z_0}} + S_{12}\cdot\dfrac{V_L^+}{\sqrt{Z_0}}; \\ \dfrac{V_L^-}{\sqrt{Z_0}} = S_{21}\cdot\dfrac{V_G^+}{\sqrt{Z_0}} + S_{22}\cdot\dfrac{V_L^+}{\sqrt{Z_0}}. \end{cases} \tag{16}$$

Hero, in our system, $$S = 1/(A - iB)\cdot\begin{bmatrix} -iD & 2\omega c\eta \\ 2\omega c\eta & iC \end{bmatrix}. \tag{17}$$

And, $$\begin{cases} A = 2\eta\Omega; \\ B = \Omega^2 - \eta^2 - \omega^2c^2 + \gamma^2; \\ C = (\gamma-\eta)^2 + \Omega^2 - \omega^2c^2; \\ D = (\gamma+\eta)^2 + \Omega^2 - \omega^2c^2; \\ \Omega = \omega(1+c) - 1/\omega; \\ \gamma = \sqrt{L/C}/R; \\ \eta = \sqrt{L/C}/Z_0; \\ c = C_C/C; \\ \omega = \omega'\sqrt{L/C}. \end{cases} \tag{18}$$

We can transform Eq. (16) into the following equation [1]:

$$\begin{bmatrix} V_L^- \\ V_L^+ \end{bmatrix} = \mathcal{M}\cdot\begin{bmatrix} V_G^- \\ V_G^+ \end{bmatrix}. \tag{19}$$

Here, $$\mathcal{M} = \frac{1}{2\omega c\eta}\cdot\begin{bmatrix} A+iB & iC \\ -iD & A-iB \end{bmatrix}. \tag{20}$$

Note that, det(M)=1. Therefore, $$S = \frac{1}{\mathcal{M}_{22}}\cdot\begin{bmatrix} -\mathcal{M}_{21} & 1 \\ 1 & \mathcal{M}_{12} \end{bmatrix}. \tag{21}$$

Generally, the reflection and transmission coefficients for the gain (G) and loss (L) incidence in terms of the transfer matrix elements as $$r_G = -\frac{\mathcal{M}_{21}}{\mathcal{M}_{22}},\ r_L = -\frac{\mathcal{M}_{12}}{\mathcal{M}_{22}},\ t_G = t_L = \frac{1}{\mathcal{M}_{22}}. \tag{22}$$

It can be derived that $$\begin{cases} \|r_G\| \cdot \|r_L\| = \sqrt{\|(\mathcal{M}_{21} \cdot \mathcal{M}_{12})/(\mathcal{M}_{22} \cdot \mathcal{M}_{22})\|} = \sqrt{\|T-1\|}; \\ \phi_G + \phi_L = \pi. \end{cases} \tag{23}$$

Here, transmittance T=TG·TL. In the single-port scattering case, the transmittance T=0, as In other words, Therefore, Eq. (15) is a special case of Eq. (23).

$$M_{22} \to \infty \text{ when } \eta \to 0.$$

$$\|r_G\| \cdot \|r_L\| = 1.$$

Using the scattering matrix, one can derive the conditions that our PT-symmetric system can simultaneously act either as an amplifier or a perfect absorber [1, 7, 8]. For a laser oscillator with-out an injected signal, the boundary condition satisfies $V_G^+=V_L^+=0$, which indicates $M_{22}(\omega)=0$ in Eq. (21). For a perfect absorber, the boundary condition satisfies $V_G^-=V_L^-=0$ which implies $d \in t(S)=0$ in Eq. (21). Therefore, $M_{11}(\omega)=(1+M_{12}M_{21}/M_{22}=0$, and the amplitudes of the incident waves must satisfy the condition $V_L^+=M_{21}(\omega)V_G^+$. For the PT-symmetric structure, the matrix elements M in Eq. (20) satisfy the relationship $M_{11}(\omega)=M_{22}(\omega^*)$. Thus, a real $\omega=\omega_J$ (Janus frequency) exists, that satisfies the amplifier/laser condition simultaneously with the absorber condition $(M_{11}(\omega_J)=M_{22}(\omega_J)=0)$ [1, 7]. Hence the two-port P'0.1% symmetric system can behave simultaneously as a perfect absorber and as an amplifier.

This property can be explored using an overall output coefficient Θ defined as [1, 7]

$$\Theta = (|V_G^-|^2 + |V_L^-|^2)/(|V_G^+|^2 + |V_L^+|^2). \tag{24}$$

Note that in the case of a single-port scattering set-up discussed earlier in this section, the Θ-function collapses to the gain/loss side reflectances. Let $V_L^+/V_G^+$ be a generic ratio, then the perfect amplifier coefficient [1] is obtained as:

$$\Theta_{amp}(\omega) = \frac{\left|\frac{V_L^+}{V_G^+}\mathcal{M}_{12}(\omega) + 1\right|^2 + \left|\frac{V_L^+}{V_G^+} - \mathcal{M}_{12}(\omega)\right|^2}{\left(1 + \frac{|V_L^+|^2}{|V_G^+|^2}\right)|\mathcal{M}_{22}(\omega)|^2}. \tag{25}$$

At the singularity frequency point the $\omega=\omega_J$, the Θ(ω)-function diverges as $\omega \to \omega_J$ and the circuit acts as an amplifier/laser. If on the other hand, we assume that $V_L^+=M_{21}(\omega)V_G^+$ (perfect adsorption condition), we can obtain [1]

$$\Theta_{abn}(\omega_J)=(|M_{22}(\omega_J)M_{11}(\omega_J)|^2)/(1+|M_{21}(\omega_J)|^2|M_{11}(\omega_J)|^2)=0 \tag{26}$$

Measurement Theory of Scattering Properties.

3.1 Measurement Theory of Single-Port Scattering.

In Section 2, we derived the theoretical formula of single-port scattering coefficient. However, the theoretical formula cannot be used to calculate the coefficients for simulation and measurement. Therefore, we need to find feasible method for practical measurement. We take the FIG. 25 for example. It is obvious to know that $VG=VG^++VG^-$. Here, VG is the node voltage of gain side; $VG^+$ is the incident wave, and $VG^-$ is the reflected wave. We rewrite the reflection of gain side RG in Eq. (10) as $$r_G = \frac{\mathcal{R}_G(\omega) - Z_0}{\mathcal{R}_G(\omega) + Z_0} = \frac{V_G^-}{V_G^+} = \beta_G e^{j\phi}, \tag{27}$$

where, β is the module of reflection coefficient and is the phase of reflection coefficient. Therefore, $V_G=V_G^++V_G^-=V_G^+\cdot(1+\beta_G e^{j\phi})=V_G^+\cdot(1+\beta_G \cos(\phi)+\beta_G \sin(\phi))$, and $$\frac{V_G}{V_G^+} = 1 + \beta_G \cos(\phi) + \beta_G \sin(\phi). \tag{28}$$

Here, $V_G^+=V_1/2$. $V_1$ is the voltage of $V_{S1}$.

On the other hand, we also can let.

$$\frac{V_G}{V_G^+} = \alpha e^{j\xi} = \alpha \cos(\xi) + j\alpha \sin(\xi). \tag{29}$$

Here, $V_G$ is the node voltage of gain side. ξ is the phase difference between $V_G$ and source voltage $V_{S1}$; α is the amplitude ratio between $V_G$ and incident wave voltage $V_G^+$. Comparing Eq. (28) and Eq. (29), we can obtain $$\begin{cases} \beta_G \sin(\phi) = \alpha \sin(\xi); \\ 1 + \beta_G \cos(\phi) = \alpha \cos(\xi). \end{cases} \tag{30}$$

Then $$\begin{cases} \beta_G = \sqrt{1 + \alpha^2 - 2\alpha \cos(\xi)}; \\ \phi = \arctan\left((\alpha \sin(\xi))/(\beta_G \cos(\xi) - 1)\right). \end{cases} \tag{31}$$

Therefore, if, we measure the amplitude of $V_G$ and the phase difference ξ between $V_G$ and source voltage $V_{S1}$, we can get the experiment results of reflection coefficient $r_G$ of gain side. Similarly, $r_L$ of loss side can also be obtained.

3.2 Measurement Theory of Two-Port Scattering.

Figure 27:
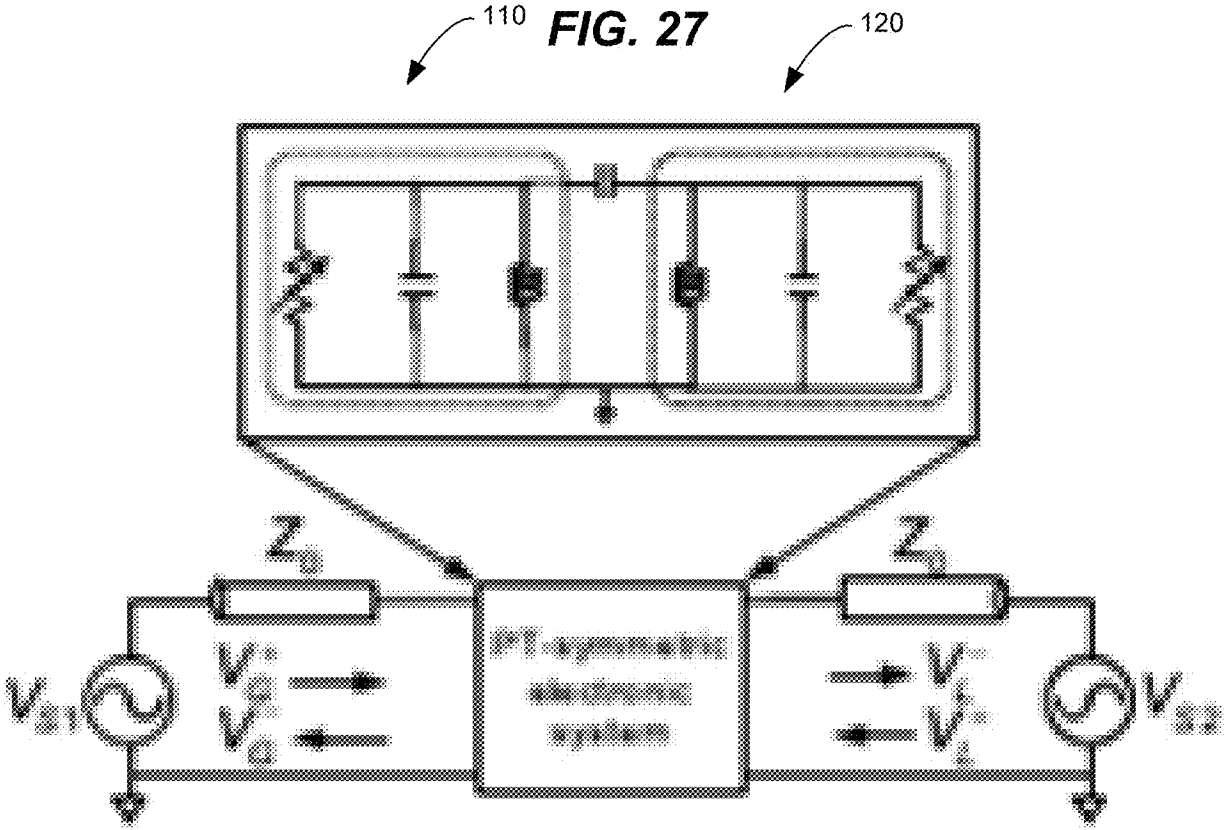
FIG. 27 is a circuit model used to calculate a total output coefficient for a fully integrated PT-symmetric electronic system.

From FIG. 27 and Eq. (27), we can easily get $$\begin{cases} V_G^- = V_G^+ \cdot \beta_G e^{j\phi_1}; \\ V_L^- = V_L^+ \cdot \beta_L e^{j\phi_2}. \end{cases} \tag{32}$$

Then, the formula for measurement is $$\Theta = \frac{|V_G^-|^2 + |V_L^-|^2}{|V_G^+|^2 + |V_L^+|^2} = \frac{|V_L^+ \cdot \beta_L e^{j\phi_2}|^2 + |V_G^+ \cdot \beta_G e^{j\phi_1}|^2}{|V_G^+|^2 + |V_L^+|^2}. \tag{33}$$

Here, $V_G^+=V_1/2$ and $V_L^+=V_2/2$. $V_1$ and $V_2$ are the amplitude of $V_{S1}$ and $V_{S2}$, respectively. Base on the measurement theory of Section 3.1, $\phi_1$, $\phi_2$, $\beta_L$ and $\beta_G$ could be easily calculated. Therefore, Θ can be obtained by plugging the values into Eq. (33).

Figures 28A, 28B, 28C, 28D, 28E:
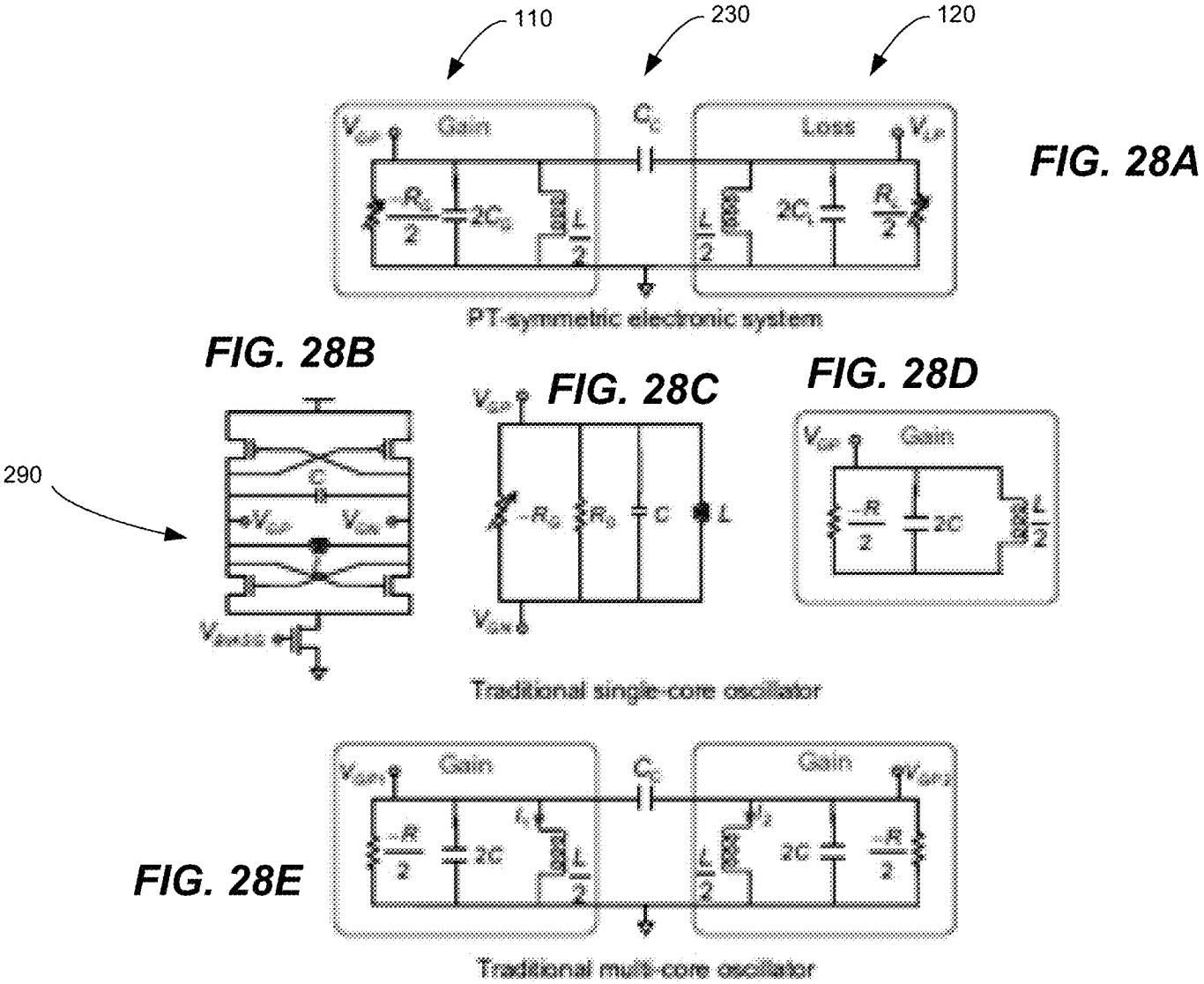
FIGS. 28A-28E depict circuit schematics for different kinds of microwave generators.

Referring to FIGS. 28A-28E, illustration of three kinds of microwave generators. FIG. 28A. The equivalent single-ended circuit schematic of the differential architecture of the fully integrated PT-symmetric electronic system. This figure is taken from FIG. 22B. FIG. 22B. Schematic view of a traditional single-core oscillator. FIG. 22C. Equivalent differential model of the single-core oscillator. FIG. 22D. The equivalent single-ended circuit schematic of the single-core oscillator. FIG. 22E. The equivalent single-ended circuit schematic of multi-core oscillators. We use the multi-core oscillator built upon two capacitively coupled active RLC resonators as an example.

4. Microwave Generation.

4.1 Frequency Tuning Range Comparison.

We theoretically compare the bandwidth of microwave generation of the fully integrated PT-symmetric electronic system and traditional oscillators. As derived in the Methods of the main text, the fully integrated PT-symmetric electronic system (FIG. 28A) has four normal mode frequencies, $$\omega_{1,2} = \pm\frac{\sqrt{\gamma_{EP}^2-\gamma^2}+\sqrt{\gamma_{UP}^2-\gamma^2}}{2\sqrt{1+2c}},\quad \omega_{3,4} = \pm\frac{\sqrt{\gamma_{EP}^2-\gamma^2}-\sqrt{\gamma_{UP}^2-\gamma^2}}{2\sqrt{1+2c}}, \tag{34}$$

where, the breaking point (yEP) and the upper critical point (yUP) are identified as $$\gamma_{EP}=|1-\sqrt{1+2c}|,\gamma_{UP}=1-\sqrt{1-2c}. \tag{35}$$

The corresponding phase difference between the two RLC resonators 110, 120 can be expressed as $$\phi_{1,3} = \frac{\pi}{2} - \tan^{-1}\left[\frac{1}{\gamma}\cdot\left(\frac{1}{\omega_{1,3}} - (1+c)\cdot\omega_{1,3}\right)\right]. \tag{36}$$

Here, y is the gain-loss contrast tuning which is defined as $\gamma=\sqrt{L/C}/R$.

We then derive the theory for conventional single-core oscillators (FIG. 28*b*). Applying Kirchoff's law on the equivalent circuit representation in FIG. 28D yields the following expression:

$$\frac{V_{GP}}{-R/2} + \frac{V_{GP}}{i\omega' L/2} + V_{GP}\cdot i\omega' 2C = 0. \tag{37}$$

Here, R=−RG||R0 with −RG the tunable gain and R0 the inherent loss of the resonator. Using the same normalization methods presented before, that is $$\omega 0=1/\sqrt{LC},\gamma=\sqrt{L/C}/R, \quad \text{Eq. (37)}$$

can be transferred into $\omega^2+i\gamma\omega-1=0$ whose solutions are $$\omega_{1,2} = \frac{-i\gamma \pm \sqrt{4-\gamma^2}}{2}. \tag{38}$$

Eq. (38) suggests that the oscillation happening in a single-core oscillator mainly goes through two phases: start-up phase and stable phase. In the start-up phase, a small-signal gain −RG initially set slightly above the inherent loss Ro is used to compensate for the loss so as to generate an oscillated microwave. The oscillation frequency— the real part of the microwave—is in fact related to the amount of loss. However, as the amplitude of the microwave exponentially grows, the small-signal gain −RG is degenerated in the large-signal domain due to the nonlinearity of the system, whose final value is equivalent to the loss R0, leading toy $\gamma\rightarrow 0$ The oscillation then steps into the stable phase, where the microwave's amplitude saturates at a fixed amplitude level and its oscillation frequency also becomes stable. Such an oscillation frequency is independent of the gain-loss contrast and only determined by the natural frequency ($\omega_0=1/\sqrt{LC}$) of the resonator, i.e., $$\omega_{1,2}=1. \tag{39}$$

Note that in this stable phase, an oscillator generates stable sinusoidal waves for diverse on-chip applications. Obviously, the stable oscillation frequency of conventional single-core oscillators can be tuned only by the capacitance C or the inductance L.

Multi-core VCOs are formed by coupling multiple identical single-core LC VCOs. Here, we use a multi-core VCO built upon two coupled resonators as shown in FIG. 28*e* as an example. This oscillator with coupled-resonator structure without gain-loss contrast is used as another baseline of our system. A similar I-V relations of the circuit can be obtained by using the Kirchoff's law:

$$\begin{cases} V_{GP1} = i\omega'\frac{L}{2}\cdot I_1, \quad I_3 - \frac{V_{GP1}}{R/2} + i\omega' 2C\cdot V_{GP1} + i\omega' C_C\cdot(V_{GP1}-V_{GP2}) = 0; \\ V_{GP2} = i\omega'\frac{L}{2}\cdot I_2, \quad I_2 - \frac{V_{GP21}}{R/2} + i\omega' 2C\cdot V_{GP2} + i\omega' C_C\cdot(V_{GP2}-V_{GP1}) = 0. \end{cases} \tag{40}$$

Using the same normalization methods as the single-core VCOs and considering $\gamma\rightarrow 0$, the solutions are given by $$\omega_{1,2}^M = \pm\frac{1}{\sqrt{(1+2c)}};\quad \omega_{3,4}^M = \pm 1. \tag{41}$$

Comparing Eq. (34), Eq. (39), and Eq. (41), it can be found that Eq. (39) is a special form of $\omega_{1,2}$ in Eq. (34) when $\gamma\rightarrow 0$; Eq. (41) is a special form of Eq. (34) when $\gamma\rightarrow 0$. The comparison shows that in addition to the inherent tuning freedoms preserved by $\omega_0$, $\omega_{1,2}$, and $\omega_{3,4}$ in Eq. (34) also preserve an extra resistive tuning freedom, i.e., $\gamma=\sqrt{L/C}/R$.

Figure 29B:
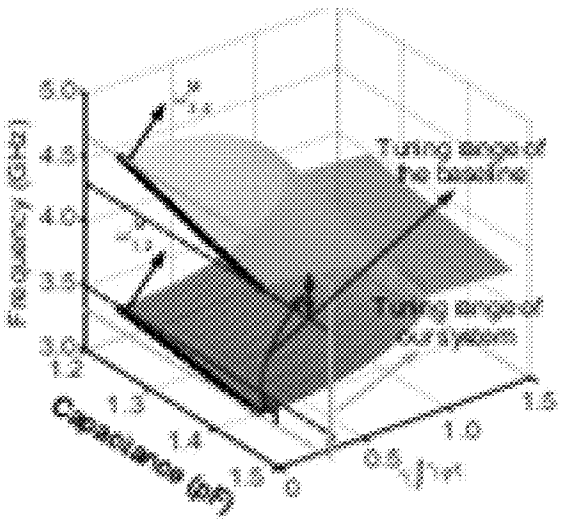
FIGS. 29A-29B depict theoretical comparisons of frequency tuning ranges between different oscillators.
Figure 29A:
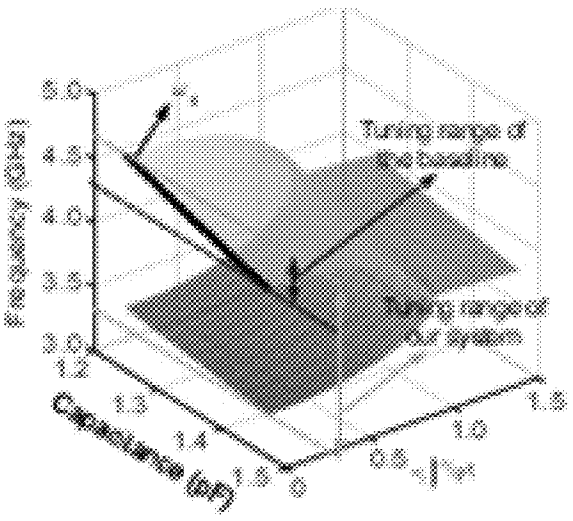

FIGS. 29A-29B compares the theoretical frequency tuning range of three oscillators using the same tunable parameters, exhibiting a larger tuning range of our system. FIG. 29A, comparison between the single-core oscillator and our system. The black line indicates the tuning range of the single-core oscillator. FIG. 29*b*. Comparison between the multi-core oscillator and our system. The black line indicates the tuning range of the multi-core oscillator.

4.2 Phase Noise Comparison.

Figures 30A, 30B, 30C, 30D, 30E:
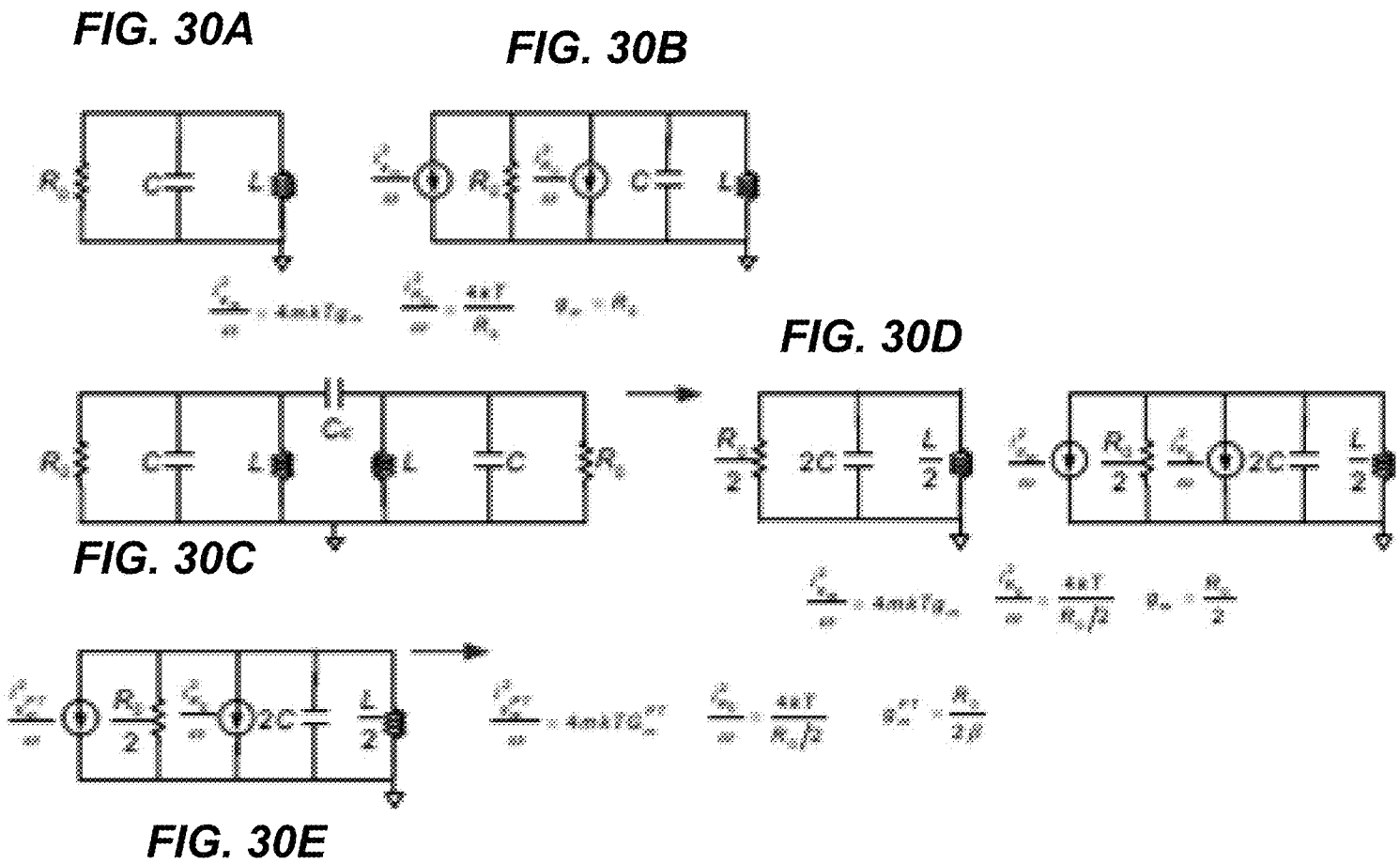
FIGS. 30A-30E are phase noise models of different oscillators.

FIG. 30A shows the passive resonator model for a conventional single-core oscillator whose phase noise (PN) model is illustrated in FIG. 30B. The main noise sources come from resistor thermal noise $$I_{R_0}^2(\omega)=4kT/R_0,\omega>0).$$

and transistor thermal noise $$I_{g_m}^2(f)=4kTmg_m,\omega>0)$$

The classical PN formula of the conventional single-core oscillators is shown below $$\mathcal{L}_{conv}(\Delta\omega) = 10\cdot\log\left[\frac{\mathcal{P}_{sideband}(\omega+\Delta\omega,\ 1\ \text{Hz})}{\mathcal{P}_{carrier}}\right] = 10\cdot\log\left((1+m)\cdot\frac{4kTR_0}{V_{osc,\,conv}^2}\cdot\left(\frac{\omega}{2Q_S\Delta\omega}\right)^2\right). \tag{42}$$

Here, $$P_{sideband}(\omega=\Delta\omega,1Hz)$$

represents the single sideband power of noise at a frequency offset of $\Delta\omega$ from the carrier with a measurement bandwidth of 1 Hz. $\omega$ is the oscillation frequency. $\Delta\omega$ is the frequency offset. k is Boltzmann's constant. T is the absolute temperature. R0 is the inherent resonator resistance. m is a noise factor of the active device. Vosc,conv is the oscillation amplitude. Qs is the quality factor of the resonator as shown in Supplementary FIG. 11A, defined as Qs=ωR0C=R0/(ωL).

It is well-known in the oscillator filed that multi-core oscillators built upon N identically coupled resonators can lead to the PN reduction by 10 log 10 N dB as compared to a single-core oscillator. A detailed theoretical analysis is proposed in a previous work. We provide an intuitive understanding here by using a multi-core oscillator composed of two coupled resonators as an example. FIG. 30C shows the passive resonator model for the multi-core oscillator. One can imagine that the two coupled resonators can be equivalently considered as a single-core resonator with doubled capacitance, halved inductance and halved inherent resistor as shown in FIG. 30D. Then, the oscillation frequency remains the same as the single-core oscillator. According to Eq. (42), PN is reduced by 3 dB in this case. This case study indicates that although the noise sources of two coupled resonators double, the effective Q-factor(Qc) of the system (FIG. 30E) also doubles, i.e., $$\mathcal{L}_c(\Delta\omega) = \mathcal{L}_{conv}(\Delta\omega) - 3 = 10\cdot\log_{10}\left((1+m)\cdot\frac{8kTR}{V_{osc,\,conv}^2}\cdot\left(\frac{\omega}{2\cdot 2Q_S\Delta\omega}\right)^2\right), \tag{43}$$

where Qc=2Qs. Our system built upon two coupled resonators also obey this rule. However, with the unique gain-loss contrast tuning, our system achieves more PN reduction. In conventional oscillators, the provided gain only demands to cancel the inherent loss. However, in our system, the provided gain not only needs to compensate for the inherent loss, but also requires to balance the tunable loss. Assuming the ratio between the provided gain and the inherent loss is $$\beta(\beta>1),$$

the PN of our system is expressed as $$\mathcal{L}_{PT}(\Delta\omega) = 10\cdot\log_{10}\left((1+\beta m)\cdot\frac{8kTR}{(\beta^2 V_{osc,\,conv})^2}\cdot\left(\frac{\omega}{2\cdot 2Q_S\Delta\omega}\right)^2\right). \tag{44}$$

Here, the oscillation amplitude of our system increases to $\beta^2$x as the current flowing into the resonator is quadratically proportional to the gain. Note that in the saturation region, the resonator current $I_D$ is linear with the square of transconductance $g_m^{PT}$ based on the I-V relationship of MOSFET:

$$g_m^{PT} = \partial i_D/\partial V_{GS} = \mu_n C_{ox}(W/L)V_{GS} - V_{th}) = \sqrt{2\mu_n C_{ox}(W/L)I_D}.$$

Comparing Eq. (42) and Eq. (44), we obtain $$\mathcal{L}_{PT}(\Delta\omega) = \left[\mathcal{L}_c(\Delta\omega) - 10\log_{10}\left(\frac{\beta^4(1+m)}{1+\beta m}\right) - 3\right] < \mathcal{L}_c(\Delta\omega) - 3. \tag{45}$$

Eq. (45) shows that the gain-loss contrast tuning of our system can further reduce PN by increasing the power of carrier. Therefore, the PN improvement of our system is attributed to two facts: 1) the coupled-resonator structure of our system can enhance the effective Q-factor of the system, and 2) the gain-loss contrast tuning can increase the oscillation amplitude, decreasing the effect of noise.

Referring to FIGS. 30A-30E; Phase noise models of different oscillators. FIG. 30A. Passive resonator model of a conventional single-core oscillator. FIG. 30B. Phase noise model of the single-core oscillator. FIG. 30C. Passive resonator model of a conventional multi-core oscillator based on two coupled resonators. FIG. 30D. Equivalent resonator model and phase noise model for the multi-core oscillator. FIG. 30E. Equivalent phase noise model of our system.

5. Experiments.

5.1. Experimental Setup.

Figures 31A, 31B, 31C, 31D:
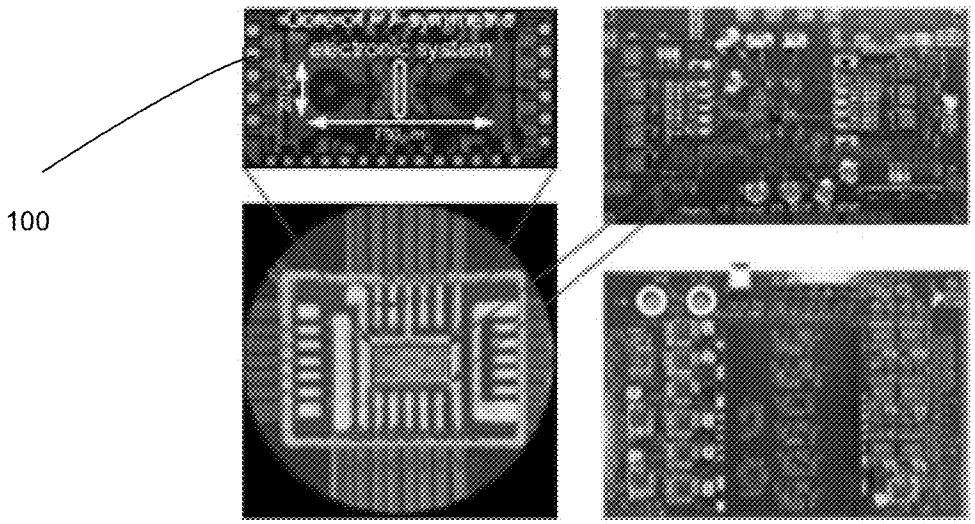
FIGS. 31A-31D are photographs depicting an experimental setup for a fully integrated PT-symmetric electronic system.

We fabricated the chip with a 130 nm CMOS technology. The chip die photo is shown in FIG. 31A. The core area of the system is 200 μm×750 μm. To test the chip, we designed two printed circuit boards (PCBs). One is a daughter board (FIG. 31C) and the other one is a mother board (FIG. 31*d*). The system chip was bonded on the daughter board by gold wires (FIG. 31B). The daughter board provides all the control signals and high-speed inputs (outputs) for the chip, such as gain (loss) bias voltage, varactor bias voltage. All the high-speed input/output terminals of the chip are accessed by high bandwidth surface mount ahead (SMA) on the daughter board. The mother board is used as power supply for the daughter board. Our experimental setup consists of a bonded chip in a daughterboard, a motherboard, a power supply, a mixed signal oscilloscope (MSO, Agilent 9404A), an arbitrary wave generator (AWG, KEYSIGHT $M_{8195}$A) and a personal computer (PC). The MSO has four pairs of differential channels, and its highest sampling rate is 20 GSa/s. The AWG has four pairs of differential channels, each pair of which can generate arbitrary waves up to 50 GHz with independently varying phase.

5.2. Experiment and Simulation Procedures.

In the phase transition experiments, the outputs of two RLC resonators 110, 120 were connected to the MSO. To test the PT-symmetry spontaneous breaking, we used the zig-zagging method to make either eigen-frequency dominant.

Figure 32A:
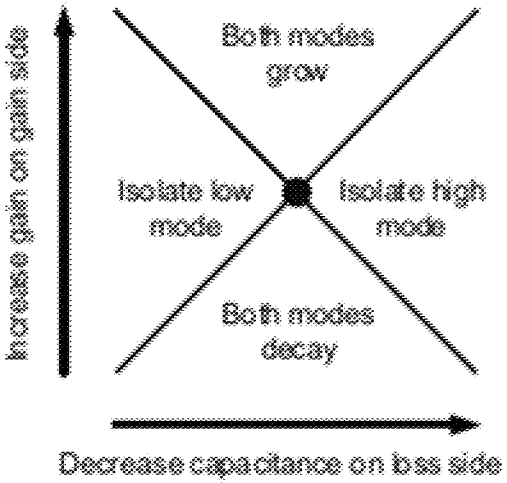
FIGS. 32A and 32B depict a measurement methodology used to obtain the eigenfrequencies of a fully integrated PT-symmetric electronic system.
Figure 32B:
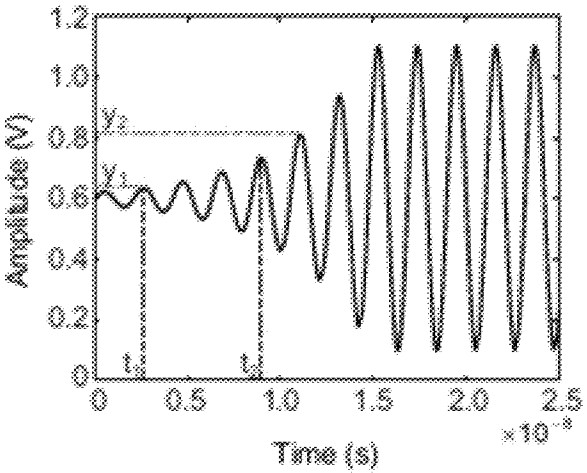

FIGS. 32A-32B: Measurement methodology to obtain the eigenfrequencies of our system. FIG. 32A. The 'X' plane used as the instructions to manually tune our system. FIG. 32B. A simplified example to show how to obtain the imaginary part of eigenfrequencies.

This known method can be best introduced using FIG. 32A. The horizontal axis represents the capacitance difference ΔC=CL−CG between the two resonators. Moving rightward on the figure indicates decreasing ΔC. The vertical axis is the gain. Upward movements indicate increasing gain. The dot at the center of the X represents a point where the gain and loss are exactly balanced, but the capacitance is imbalanced by a small amount ΔC>0. The goal is to attain a stable dimer configuration just barely below that center dot. Then the slightest changes can cause a marginal instability in one, the other, or both modes, allowing each mode to be observed individually in a state of gain-loss balance. An algorithm to find this balance point by zig-zagging along one of the bottom boundary lines of the X follows: 1) Reduce gain until all modes decay by ending just inside a border of the X; 2) Change ΔC a bit in whichever direction doesn't immediately cause instability; 3) Increase gain until something oscillates; 4) Change ΔC enough to kill the oscillation, then a bit further; 5) Repeat 3) and 4) until tiny capacitance changes cause a switching from the high frequency to low frequency zone, with only a tiny "dead zone" in between. Note that as $\gamma \rightarrow \gamma_{EP}$, $\Delta C \rightarrow 0$. Beyond γEP, ΔC was held fixed at its asymptotic value.

In the exact phase, mode frequencies were directly observed by balancing gain-loss and slightly unbalancing the capacitance, then correcting for the imbalance. For each mode, once the system was brought to a state of marginal oscillation, oscilloscope waveform capture recorded VG (t) and VL(t), the voltage data at each side of the system. These data were analyzed for real frequency, and amplitude. This process described above forced the imaginary part of the frequency to be zero, and so the imaginary frequency data was automatically recorded as zero. In the broken phase, the capacitance trim is kept fixed at its asymptotic value, and the gain trim is set to a bit higher than center dot. The exponential growth of transient data obtained in FIG. 14B then directly gives us the imaginary component:

$$\omega_{Im}=(\ln(y_2-V_{cm})-\ln(y_1-V_{cm}))/(t_2-t_1).$$

Here, Vcm is the common mode voltage, which is set to be VDD/2=0.6V in our design. Note that only a piece of the transient curve as shown in FIG. 32B is used to calculate the imaginary part. As the amplitude increases, the gain will be degenerated due to the nonlinearity of the system, which can lead to the computation errors.

In the single-port scattering experiments, the system was biased in the exact phase. Then, a sinusoidal signal with varied frequency was applied into the system. Note that the signal power was chosen to set the system in the linear region. The incident wave VG+(VL+) and the reflected wave VG−(VL−) were extracted from the voltages at either side of the TL, from which the scattering coefficients RG=VG−/VG+ and RL=VL−/VL+ were calculated.

In the two-port scattering simulations, the AWG sourced sinusoidal signals with varying frequencies or phase into the chip through TL. Then signals on both terminals of the TL were sent into the MSO such that the incident wave and reflected wave could be captured. Theoretically, the ideal case of $\Theta_{abs}=0$ and $\Theta_{amp}=\infty$ can only occur when the gain and loss are perfectly balanced. In our system, small imbalance of RLC components existed in the two RLC circuits due to minor fabrication error, which could not be completely compensated by the external tuning. Such a tiny imbalance resulted in a large deviation of theoretical $\Theta_{abs}$ and $\Theta_{amp}$ of our system from the ideally balanced condition (see FIG. 36*a*), and experimental difficulty in measuring $\Theta_{abs}$. Therefore, we performed SPICE simulation with special scanning techniques to obtain the corresponding results with Θ<0 in FIG. 36*b*. When the PT-symmetric dimmer acts as a perfect absorber, the condition must be satisfied. In the simulation, we let $$V_L^+=M_{21}(\omega)V_G^+$$

must be satisfied. In the simulation, we let $$V_L^+=Ae^{i\phi'}(\omega)V_G^+,$$

Each lower data point near the absorption point in FIG. 46B was found by fixing frequency and scanning through values of φ'=90° in tightly spaced increments, then recording the minimum Θ value. Within these φ' scans, an iterative process of measurement and resetting was used at each step, to ensure that A and φ' were within a small tolerance level of the theoretically specified values. The portion of the bottom (blue) curve in FIG. 36B near the minimum is an example of one of these high-precision scans.

In the nonreciprocal experiments, the AWG fed sinusoidal signals with varying frequencies into the system through the gain (loss) side TL. Then both the incident wave on the input terminal of the gain (loss) side TL and the reflected wave on the output terminal of loss (gain) side TL could be captured by MSO.

6. Supplementary Results.

6.1. Comparisons of Microwave Generation.

In our system, a conventional oscillator (FIG. 28B) can be obtained by turning off SW1 to decouple the two RLC resonators in the fully integrated PT-symmetric electronic system shown in FIG. 20. We compare the phase noise performance of the baseline oscillator and our PT-symmetric system at different frequencies (low, medium and high frequency in each individual system) in FIG. 33. The experimental results show that the fully integrated PT-symmetric electronic system generally has better phase noise performance in the tuning range than the conventional oscillator. The table of FIG. 34 summarizes the comparison.

We then further examine the Eq. (34) and Eq. (36) in Section 4.1 at the coalescence frequency $\omega_1=\omega_3$. We find that $$\phi_{1,3}=\pi/2 \text{ if } \omega_1=\omega_3=1/\sqrt{(1+c)}.$$

Figure 35:
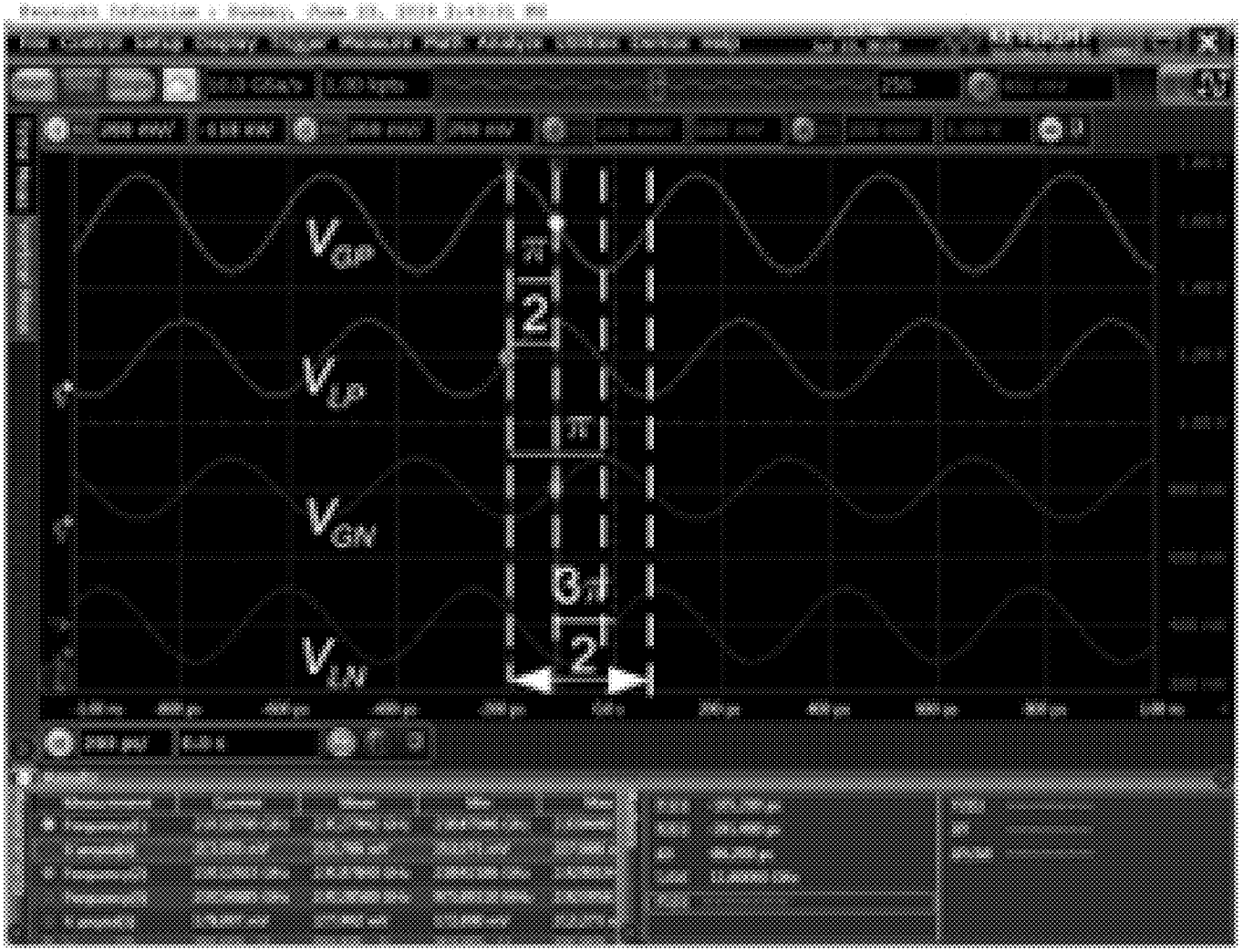
FIG. 35 depicts an example of a quadrature microwave generation by a fully integrated PT-symmetric electronic system.

This indicates that by carefully choosing design parameters at EP, the phase difference between two sides is π/2, then we can achieve quadrature microwave generation. Note that we use a differential architecture to design the system, therefore the phase for VGP, VGN, VLP, VLN is 0, π, π/2, 3π/2. FIG. 35 shows the experimental results of the quadrature microwave generation enabled by our system.

Figure 33A:
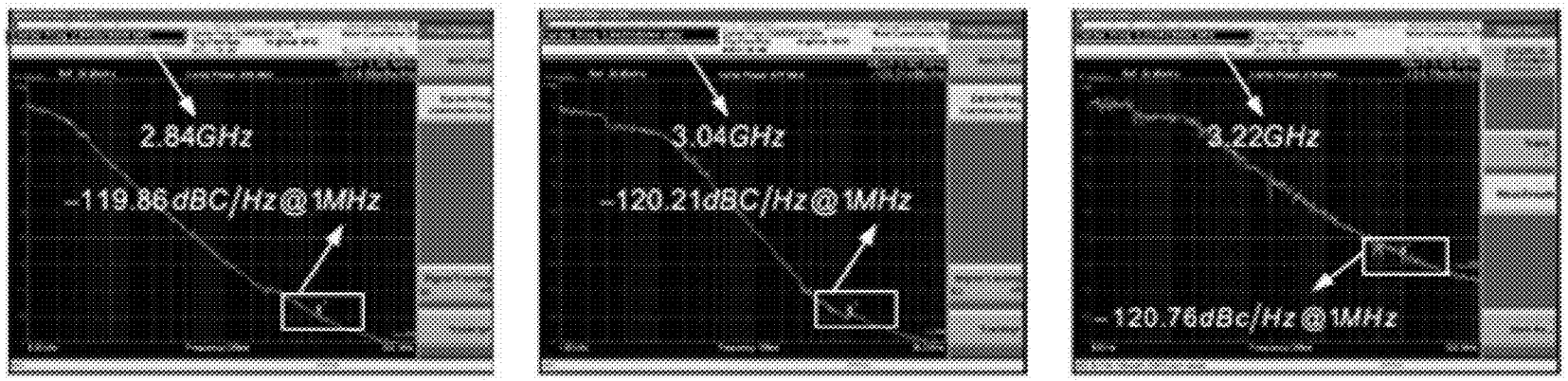
FIG. 33A depicts the phase noise performance of a fully integrated PT-symmetric electronic system at a low, medium, and high frequency.
Figure 33B:
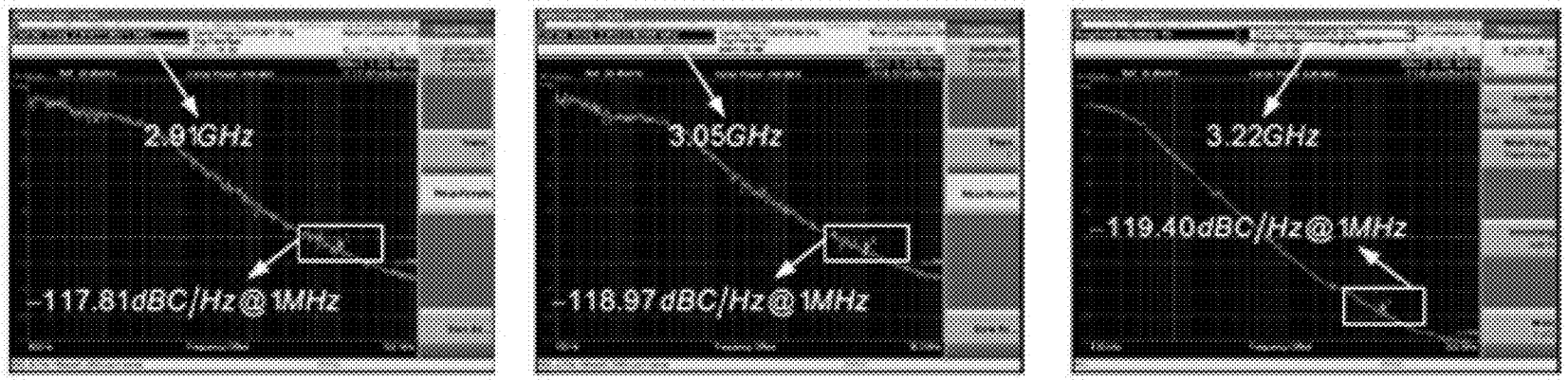
FIG. 33B depicts the phase noise performance of a conventional baseline oscillator at a low, medium, and high frequency.

Referring to FIGS. 33A-33B, comparison of phase noise performance between the fully integrated PT-symmetric electronic system and the conventional baseline oscillator. FIG. 33A. Phase noise of our system at different frequencies: 2.84 GHz (low frequency), 3.04 GHz (medium frequency), 3.22 GHz (high frequency). FIG. 33B. Phase noise of the baseline at different frequencies: 2.91 GHz (low frequency), 3.05 GHz (medium frequency), 3.22 GHz (high frequency).

6.2. Scattering Results.

Figure 36B:
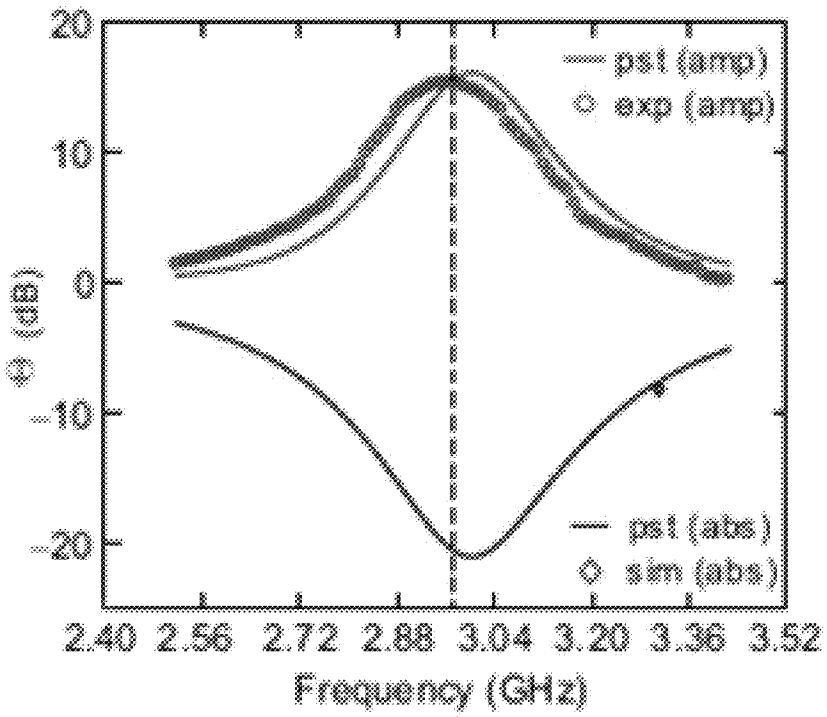
FIGS. 36A and 36B are graphs depicting simulations and experiments of two-port scattering properties of a fully integrated PT-symmetric electronic system.
Figure 36A:
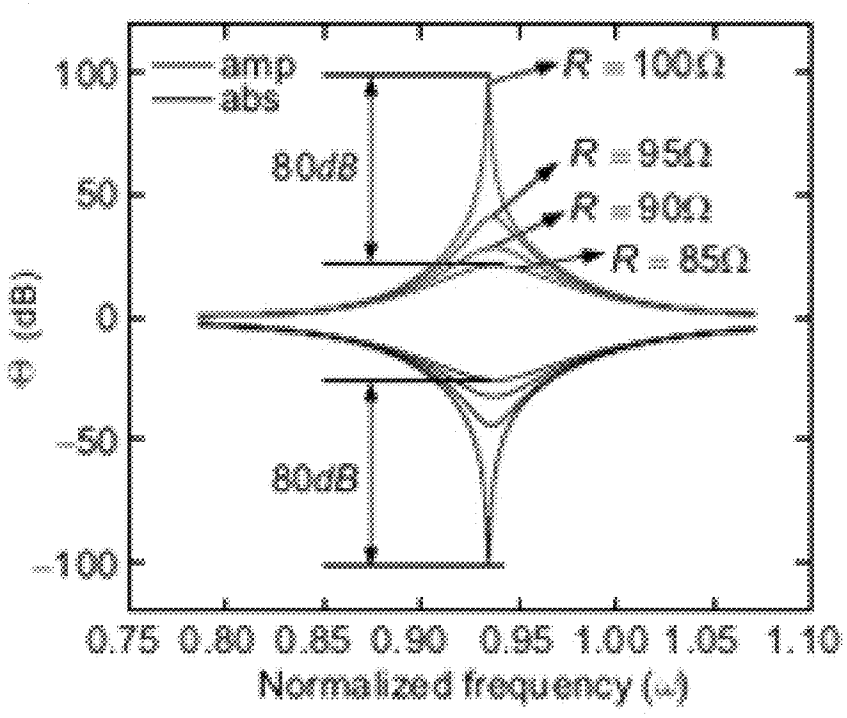

Theoretically, the ωj is uniquely determined by the tuning parameter $$\gamma=\sqrt{(L/C)}/R'$$

when the system is perfectly balanced. A small variation of gain/loss value R in γ will cause the significant deviation of $\Theta_{amp}$ and $\Theta_{abs}$, from ideal value ($\Theta_{amp}=\Theta_{abs}=0$). FIG. 36*a* shows the theoretical simulation of several groups $\Theta_{amp}$ and $\Theta_{abs}$, under different variation of R. R=100Ω can be consider as the case to achieve ideal $\Theta_{amp}$ and $\Theta_{abs}$. Even if there is only 15Ω deviation, the deviation of $\Theta_{amp}$ and $\Theta_{abs}$ is up to 80 dB. Considering the fabrication process leads to the imbalance of CMOS components between the two RLC resonators which cannot be completely compensated by the external tuning, the practical deviation becomes worse. FIG. 36B demonstrates a measured result (red dots) of two-port scattering property when the system suffers from small fabrication mismatches.

Figure 37A:
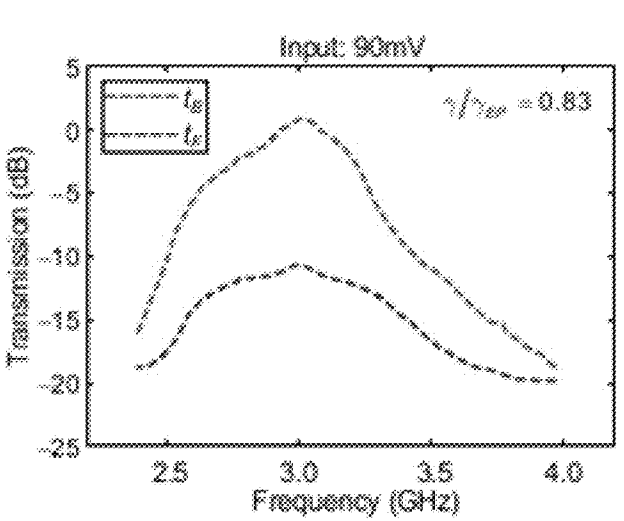
FIGS. 37A-37C are graphs depicting experimental results for a non-reciprocal transmission for a fully integrated PT-symmetric electronic system.
Figure 37B:
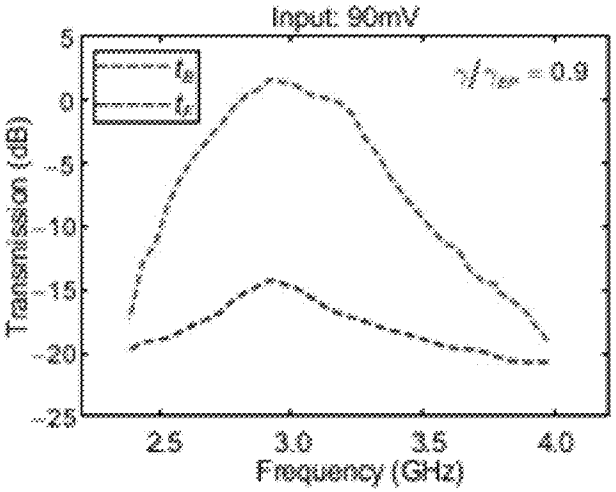
Figure 37C:
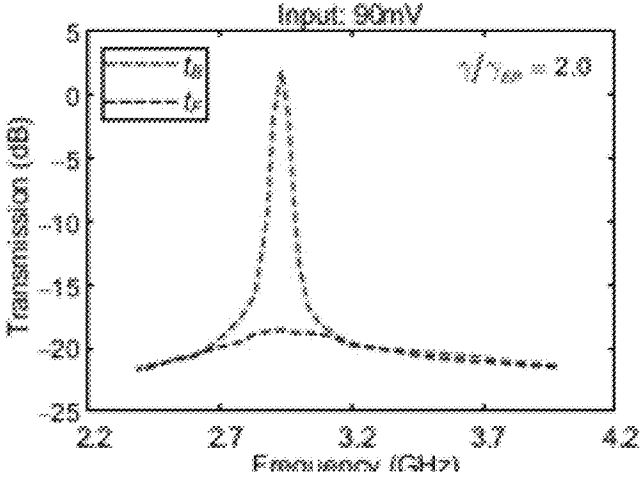

FIGS. 37A-37C: supplementary experimental results for non-reciprocal transmission. FIG. 37A. Nonreciprocal transmission is observed in the exact phase (7/up=0.83) with two peaks, where the forward transmission is up to −10.5 dB while the backward transmission is 1.0 dB. FIG. 37B. Nonreciprocal transmission is observed in the exact phase (γ/γEP=0.9) with two peaks, where the forward transmission is up to −14.5 dB while the backward transmission is 1.9 dB. FIG. 37C. Nonreciprocal transmission is observed in the broken phase (γ/γEP=2) with one peak, where the forward transmission is up to −18.7 dB while the backward transmission is 2.1 dB.

6.3. Non-Reciprocal Microwave Transmissions.

Figure 18F:
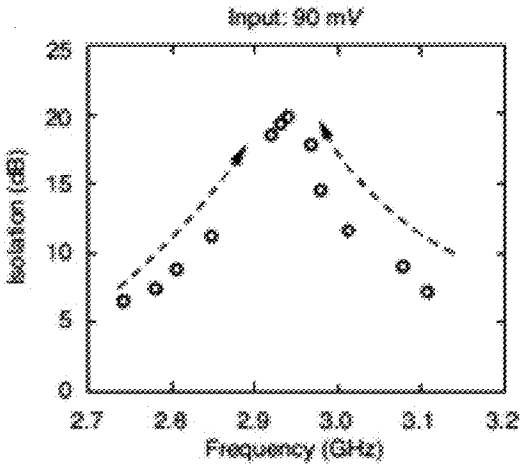

Extra experimental results of non-reciprocal transmission are shown in FIGS. 37A-37C, which together with the FIGS. 18A-E show the non-reciprocal trend of the isolation in FIG. 18F. Our systems shows strong isolation among a wide bandwidth in the microwave domain. Our system also requires lower power threshold and show interesting insertion gain due to enhanced nonlinearity enabled by PT-symmetry as compared with traditional nonlinearity-induced isolation (see table, FIG. 38, which are non-reciprocity comparisons between our system and state of the art isolators based on nonlinearity).

Figure 39A:
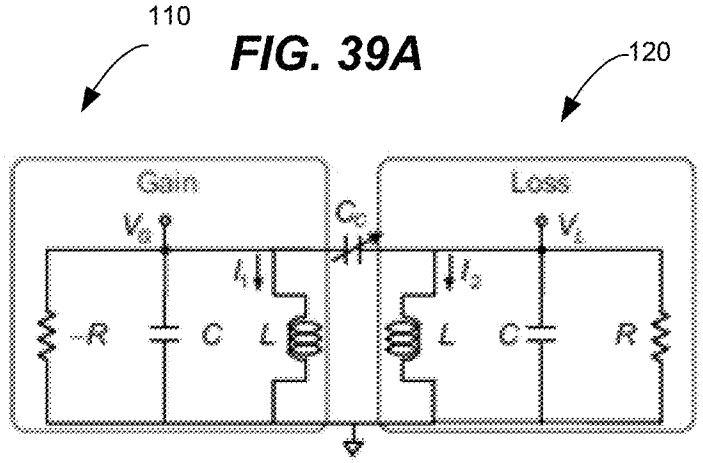
FIGS. 39A-39B are circuit diagrams depicting different architectures for implementing a fully integrated PT-symmetric electronic system.
Figure 39B:
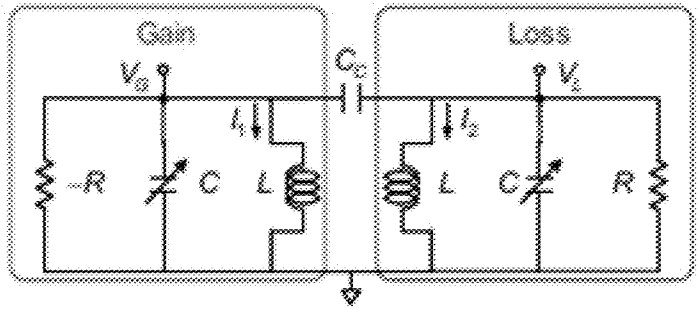

FIGS. 39A, 39B: Versatile architectures to implement fully integrated PT-symmetric electronic system. FIG. 39A. Coupling-tuning architecture. In this architecture, only coupling capacitance Cc is adjustable, all other components are fixed. FIG. 39B. Capacitive tuning architecture. In this architecture, only capacitance in the RLC resonators is adjustable, all other components are fixed.

Figure 40A:
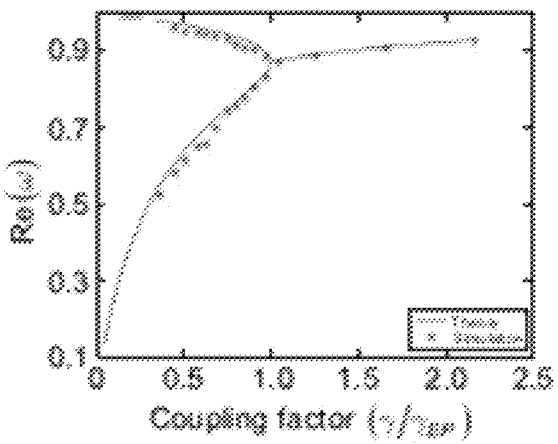
FIGS. 40A and 40B are graphs depicting phase transitions of a fully integrated PT-symmetric electronic system based on a coupling-tuning architecture.
Figure 40B:
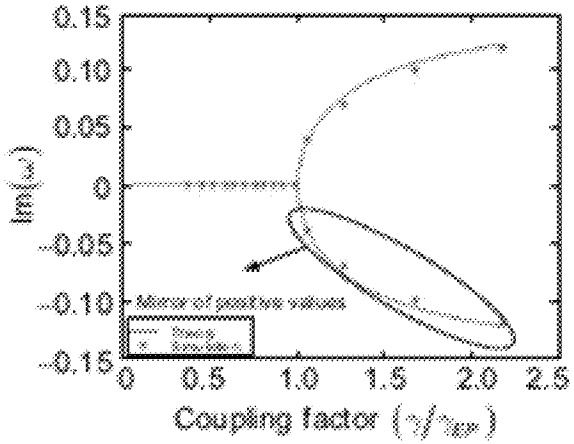
Figure 41A:
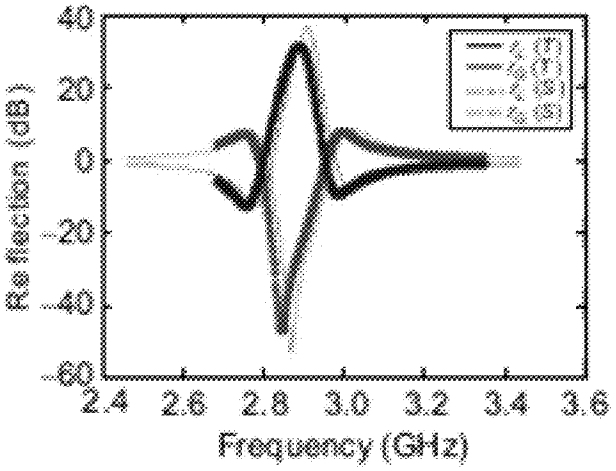
FIGS. 41A and 41B are graphs depicting scattering properties of a fully integrated PT-symmetric electronic system based on a coupling-tuning architecture.
Figure 41B:
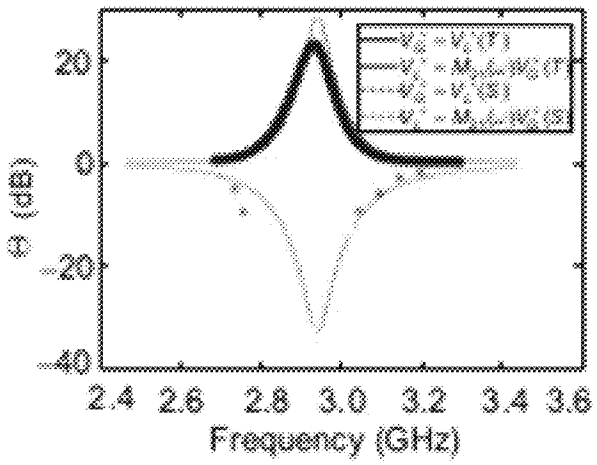

FIG. 40A, 40B: Phase transition of the system based on coupling-tuning architecture. FIG. 40A. Real part of the eigenfrequencies. FIG. 40B. Imaginary part of the eigenfrequencies. The part below the zero axis is the symmetrical part of the positive one. Star symbols are simulations while lines are theoretical prediction.

7. Versatile Fully Integrated PT-Symmetric Electronic System.

In addition to the proposed architecture based on the gain (loss) tuning, it is straightforward for us to implement other architectures for the system by leveraging the flexible tuning mechanisms of IC. We propose two variants of the system by using 130 nm CMOS technology and show them in FIGS. 39A, 39B. The first variant is based on coupling-tuning architecture (FIG. 39A). In this architecture, all the components are fixed except for the coupling capacitance Cc. The Cc can be realized by switched-capacitor arrays or varactors. The second variant uses capacitance-tuning mechanism (FIG. 39B). In this architecture, all the components are fixed except for the RLC resonator's capacitance CG (CL) 160, 210. The CG (CL) can also be realized in the same way as Cc. Although they are different in tuning mechanisms, the theory of the PT-symmetry spontaneous breaking keeps the same. Based on Eq. (35), in the coupling-tuning architecture, γEP and γUP are evolving with the capacitance ratio c while γ is fixed. In the capacitance-tuning architecture, all γ, γEP, and γUP are evolving with the RLC resonator's capacitance C, but −γEP and γUP change faster.

We simulate the first variant of the system by using 130 nm CMOS technology and show the corresponding results in FIGS. 40A, 40B and FIGS. 41A, 41B. The design parameters of this variant are L=3.50 nH, Cc∈[0.3, 1.3] pF, C=0.4 pF, and R=270Ω. All the simulation results are matched with theoretical predictions, demonstrating that ICs can provide versatile structures to study PT-symmetric electronics.

8. Extended Discussions.

8.1 Discussion on Periodic PT-Symmetric Electronic Structures.

PT-symmetric periodic structures, near the spontaneous PT symmetry breaking point, can act as unidirectional invisible media. In this regime, the reflection from one end is diminished while it is enhanced from the other. In electronics, the unidirectional invisibility has been studied by using diverse board-level PT-symmetric systems.

Figure 42A:
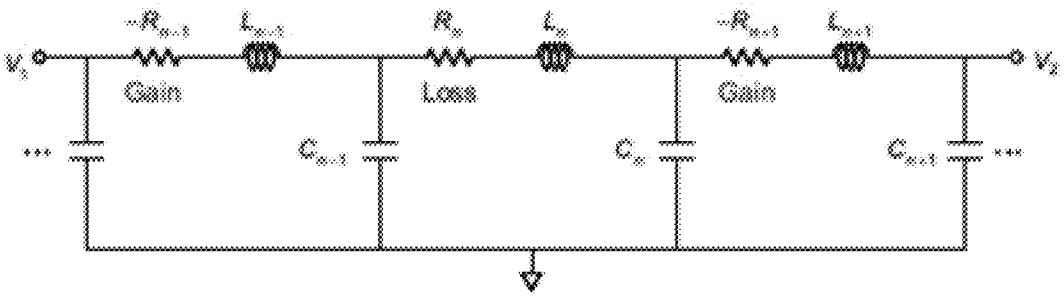
FIGS. 42A and 42B are circuit structures for unidirectional invisibility based on PT-symmetric electronic circuits.

FIG. 42A shows a circuit schematic of a PT-symmetric periodic structure based on a transmission line model, where the resistor Rn, is distributed according to the configuration of PT symmetry composed of a gain (−R) and loss (+R) sequence. Theoretical analysis suggests that such a structure shows PT symmetry phase transition from real to complex eigenvalues as a function of resistance R. It can be used as a counterpart of PT-symmetric Bragg periodic structures in the electronic domain to study the unidirectional invisibility around the exceptional point.

Figure 42B:
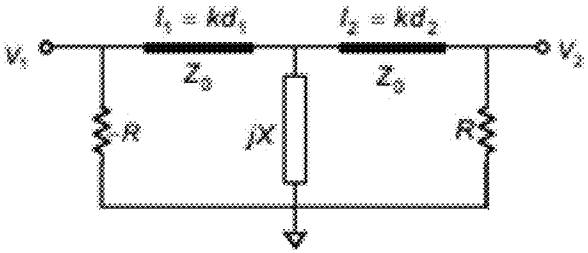

One known system is composed of lumped elements and transmission lines as shown in FIG. 42B. The two parallel resistors are separated by two transmission lines of which the electric lengths are 11=kd1, 12=kd2 and the characteristic impedance is Zo, in which k is the wave number and d1,2 is the physical lengths of the transmission lines. Furthermore, the resistance of reactance component which consists the capacitor C or the inductor L is X=1/ωC or X=ωL between the two transmission lines. Based on the scattering matrix method, the circuit can exhibit an ideal unidirectional performance at the spontaneous PT-symmetry breaking point by tuning the transmission lines between the lumped elements. Additionally, the resistance of the reactance component can alter the bandwidth of the unidirectional invisibility flexibly.

Another known system has the same structure as our dimer. An interesting result of two-port scattering in this paper is that at specific co values, the transmittance becomes t=1, while at the same time one of the reflectances vanishes. Hence, the scattering for this direction of incidence is flux conserving and the structure is unidirectionally transparent. Periodic repetition of the PT-symmetric unit will result in the creation of unidirectionally transparent frequency bands. We recommend these circuit structures for the study of unidirectional invisibility in the electronic domain. With proper optimization and design techniques, all these circuits can be implemented on the IC.

With reference to FIGS. 42A, 42*b*: Circuit structure for unidirectional invisibility based on PT-symmetric electronic circuits. FIG. 42A. Circuit structure for unidirectional invisibility based on a periodic PT-symmetric transmission line circuit. FIG. 42B.

8.2. Discussion on Topological PT-Symmetric Electronics.

Topological properties experience an intriguing degree of diversification when they are combined with PT symmetry. Therefore, there have been considerable efforts devoted to studying topological insulators under the context of PT symmetry. Here, we would like to give some discussions about studying topological effects with non-Hermitian topological electronic circuits.

Figure 43A:
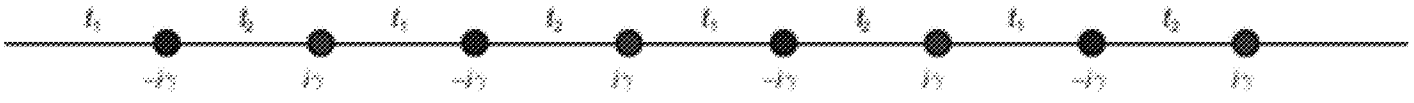
FIGS. 43A-43B are theoretical hopping models and circuit diagrams for topological electronics.
Figure 43B:
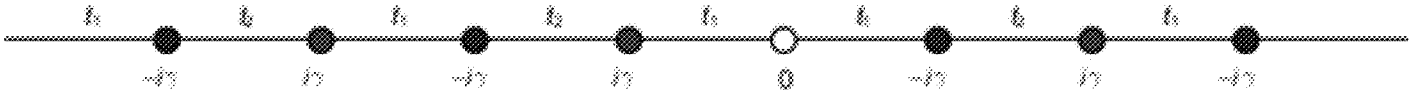
Figure 43C:
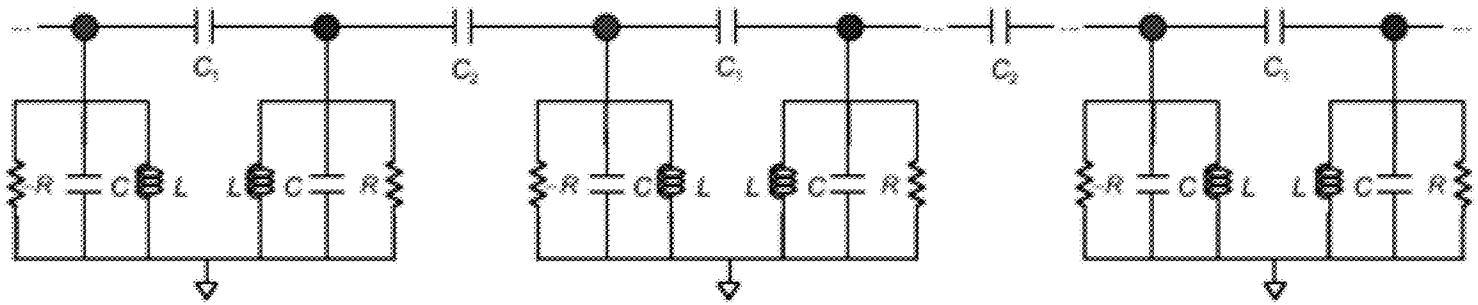

Some known systems have used PT-symmetric electronic circuits to demonstrate various topological effects, such as topological defect engineering, topological insulating phase, and topological wireless power transfer. So far, these experiments have been focused on low-frequency platform, i.e., printed circuit board. A general 1-D PT-symmetric Su-Schrieffer-Heeger (SSH) tight-binding model is illustrated in FIG. 43A, which is based on a chain with alternating hopping t1 and t2, and an alternating on-site gain and loss term ±iy. The non-Hermitian SSH model is represented by the admittance matrix, also termed circuit Laplacian J(w) of the circuit. FIG. 43C shows the corresponding circuit design of the 1-D topological chain, where the hoppings between non-Hermitian cells are represented by capacitors C1, C2, and the on-site gain and loss are realized by resistive elements. In order to design a manifestly PT-symmetric topological midgap state in a waveguide system, a defect site can be inserted into chain as shown in FIG. 43*b*. Realize such a chain in CMOS is conceptually straightforward. However, there are two concerns we want to discuss. First, the parasitics are universal in IC designs. Therefore, the parasitics between the connection of two adjacent non-Hermitian units should be minimized. Second, nonlinearities are also common in ICs. These non-idealities should be included into the theoretical analysis of the 1-D topological chain.

The integrated design methodology equips the system with at least four technical advantages: 1) it can be seamlessly integrated with other on-chip communication module, enabling a very small footprint; 2) the gain generated cross-coupled differential pair (XDP) keeps constant with efficient power consumption in a wide bandwidth, enabling the system work at mm-wave domain, by scaling the design to 40 nm technology; 3) inherent strong nonlinearity exists in the system, enabling significant nonreciprocal transmission; 4) both the gain and loss are adjustable, enabling broadband nonreciprocal transmission. When compared with prior spatio-temporal parametric modulation of waveguides, the design does not require careful parametric modulation, which eases the design and application. When compared with the design based on staggered communication, the design can be easily scaled to more advanced technology.

Technical advantages of PT-symmetric electronics include being (1) magnet-free and fully-integrated, (2) broadband operation, (3) large-scale array integration, and (4) agile reconfigurability. The chip-sized device is compatible with the state-of-the-art (CMOS) semiconductor fabrication process and therefore excels at cost-effective miniaturization. PT-symmetric electronics with active elements and cascaded structure can lead to broadband operation potentially superior to existing passive single module solution. Known PT systems are limited to single loss-gain components, whereas the system described here is able to scale to large PT lattice and array structures that offer untapped much-enhanced microwave and mmW capabilities. Since the properties of a PT system are controlled by its gain/loss factor and coupling coefficients, it is possible to adaptively tune these parameters to achieve software-programmable electromagnetic (EM) interfaces and modules.

In summary, this disclosure extends the concept of PT-symmetric electronics and the PT-symmetric nonreciprocity from centimeter- and meter-scale structures to the domain of fully integrated on-chip micro-scale structures, and more importantly from sub-RF asymmetry transmission to millimeter microwave circulator. It presents PT-symmetric integrated electronic micro-resonators with a clear demonstration of PT symmetry breaking. It demonstrates the enhancement of nonlinearity (reduction of threshold for nonlinearity) in the broken phase. It verifies that PT-symmetry alone is not sufficient to obtain nonreciprocal behavior; operation in the nonlinear regime is also necessary. A PT-symmetric system will always be reciprocal in the linear regime, regardless of whether PT-symmetry is broken or unbroken. This work proves the issue of reciprocity in PT-symmetric systems. This disclosure also demonstrates nonreciprocal microwave signal transmission—without magneto-optic effect—in a PT-symmetric integrated electronic system. Finally, this work can be easily scaled to more advanced CMOS technology, make it potential application for future 5G communication.

Although various circuits described herein depict idealized components such as inductors, resistors, and capacitors within the circuits in specific configurations, real-world inductors, resistors, and capacitors include various parasitic elements. In addition, the various circuit components depicted in the figures and described herein may comprise a combination of elements, or a combination of components and parasitic elements from one or more other components in the circuits.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An integrated circuit comprising:

a first resonator having a first terminal and a second terminal, the first resonator comprising a gain resistor, a gain capacitor, and a gain inductor in parallel and electrically coupling the first terminal with the second terminal;

a second resonator having a third terminal and a fourth terminal, the second resonator comprising a loss resistor, a loss capacitor, and a loss inductor in parallel and electrically coupling the third terminal with the fourth terminal; and a coupling element selectively coupling the first terminal of the first resonator with the third terminal of the second resonator.

2. The integrated circuit of claim 1, wherein:

the coupling element includes at least one capacitor in series with a switch.

3. The integrated circuit of claim 1, wherein:

the coupling element comprises a first coupling element, and the integrated circuit further comprises:

a second coupling element selectively coupling the second terminal of the first resonator with the fourth terminal of the second resonator.

4. The integrated circuit of claim 3, wherein:

the second coupling element includes at least one capacitor in series with a switch.

5. The integrated circuit of claim 1, wherein:

the second terminal of the first resonator and the fourth terminal of the second resonator are electrically coupled together.

6. The integrated circuit of claim 5, wherein:

the second terminal of the first resonator and the fourth terminal of the second resonator are electrically coupled to a ground node for the integrated circuit.

7. The integrated circuit of claim 1, wherein:

the gain resistor and the loss resistor have magnitudes that are substantially similar.

8. The integrated circuit of claim 1, wherein:

the gain resistor comprises a cross-coupled differential pair.

9. The integrated circuit of claim 1, wherein:

the gain inductor includes a first coil tap, the loss inductor includes a second coil tap, and the first coil tap is electrically coupled to the second coil tap.

10. The integrated circuit of claim 1, wherein:

the gain resistor comprises a parallel combination of a cross-coupled differential pair (290), a variable gain resistor, and an inherent loss of the first resonator.

11. The integrated circuit of claim 10, wherein:

the cross-coupled differential pair operates as a negative impedance converter.

12. The integrated circuit of claim 10, wherein:

the variable gain resistor includes two NMOS transistors having gates that are electrically connected together.

13. The integrated circuit of claim 1, wherein:

the gain capacitor includes a parasitic gain capacitance, a fixed Metal-Insulator Metal (MIM) gain capacitor, and an adjustable gain varactor, and the loss capacitor includes a parasitic loss capacitance, a fixed Metal-Insulator Metal (MIM) loss capacitor, and an adjustable loss varactor.

14. The integrated circuit of claim 1, wherein:

the loss resistor includes a parallel combination of a variable loss resistor and an inherent loss of the second resonator.

15. The integrated circuit of claim 14, wherein:

the variable loss resistor includes two NMOS transistors having gates that are electrically connected together.

16. The integrated circuit of claim 1, wherein:

the gain resistor and the loss resistor have magnitudes that vary based on at least one external voltage bias to the IC to facilitate a broadband nonreciprocal transmission by the IC.

17. The integrated circuit of claim 16, wherein:

the broadband nonreciprocal transmission has a frequency range from about 100 Megahertz to about 1 Terahertz.

18. The integrated circuit of claim 1, wherein:

the integrated circuit exhibits Parity-Time (PT) symmetry when a resistance of the gain resistor is approximately equal to a magnitude of a resistance of the loss resistor, an inductance of the gain inductor is approximately equal to an inductance of the loss inductor, and a capacitance of the gain capacitor is approximately equal to a capacitance of the loss capacitor.

19. A Parity-Time (PT) symmetric integrated circuit configured to generate a broadband nonreciprocal microwave transmission, the PT symmetric integrated circuit comprising:

a first resonator having a first terminal and a second terminal, the first resonator comprising an active gain resistor, a gain capacitor, and a gain inductor in parallel and electrically coupling the first terminal with the second terminal, wherein the gain inductor includes a first coil tap;

a second resonator having a third terminal and a fourth terminal, the second resonator comprising a loss resistor, a loss capacitor, and a loss inductor in parallel and electrically coupling the third terminal with the fourth terminal, wherein the loss inductor includes a second coil tap electrically coupled to the first coil tap of the gain inductor; and at least one coupling element selectively coupling at least one of the first terminal with the third terminal, and the second terminal with the fourth terminal, wherein each coupling element comprises at least one capacitor in series with a switch, wherein a negative resistance of the active gain resistor is approximately equal to a magnitude of a resistance of the loss resistor, wherein an inductance of the gain inductor is approximately equal to an inductance of the loss inductor, and wherein a capacitance of the gain capacitor is approximately equal to a capacitance of the loss capacitor.

20. A Parity-Time (PT) symmetric integrated circuit, comprising:

a first resonator having a first terminal and a second terminal, the first resonator comprising an active gain resistor, a gain capacitor, and a gain inductor in parallel and electrically coupling the first terminal with the second terminal, wherein the active gain resistor has a negative resistance, wherein the gain inductor includes a first coil tap;

a second resonator having a third terminal and a fourth terminal, the second resonator comprising a loss resistor, a loss capacitor, and a loss inductor in parallel and electrically coupling the third terminal with the fourth terminal, wherein the second terminal is electrically coupled to the fourth terminal at a ground node for the first resonator and the second resonator, wherein the loss inductor includes a second coil tap electrically coupled to the first coil tap of the gain inductor; and a coupling element selectively coupling the first terminal of the first resonator with the third terminal of the second resonator, the coupling member comprising at least one capacitor in series with a switch, wherein the negative resistance of the active gain resistor is approximately equal to a magnitude of a resistance of the loss resistor, wherein an inductance of the gain inductor is approximately equal to an inductance of the loss inductor, and wherein a capacitance of the gain capacitor is approximately equal to a capacitance of the loss capacitor.

* * * * *